United States Patent [19]

Kondo et al.

[11] Patent Number: 4,986,677

[45] Date of Patent: Jan. 22, 1991

[54] ELECTRONIC TYPEWRITER HAVING IMPROVED PAPER AND INK FEED MECHANISMS SELECTIVELY DRIVEN BY A SINGLE REVERSIBLE MOTOR

[75] Inventors: Hiroatsu Kondo, Zushi; Junichi Yoshikawa, Tokyo; Tetsuya Kawanabe, Yokohama, all of Japan

[73] Assignee: Canon Kabushiki Kaisha, Tokyo, Japan

[21] Appl. No.: 494,839

[22] Filed: Mar. 16, 1990

Related U.S. Application Data

[63] Continuation of Ser. No. 854,194, Apr. 21, 1986, abandoned.

[30] Foreign Application Priority Data

| | | | |
|---|---|---|---|
| Apr. 22, 1985 | [JP] | Japan | 60-86661 |
| Apr. 22, 1985 | [JP] | Japan | 60-86662 |
| Apr. 22, 1985 | [JP] | Japan | 60-86663 |
| Apr. 22, 1985 | [JP] | Japan | 60-86664 |
| Apr. 22, 1985 | [JP] | Japan | 60-86665 |
| Apr. 22, 1985 | [JP] | Japan | 60-86666 |
| Apr. 22, 1985 | [JP] | Japan | 60-86667 |
| Apr. 22, 1985 | [JP] | Japan | 60-86668 |

[51] Int. Cl.[5] ..... B41J 23/34

[52] U.S. Cl. ..... 400/187; 400/229; 400/568; 400/697.1

[58] Field of Search ..... 400/144.2, 185, 186, 400/187, 697.1, 225, 229, 236, 236.2, 551, 568, 569; 101/93.19; 318/696

[56] References Cited

U.S. PATENT DOCUMENTS

| | | | |
|---|---|---|---|
| 4,249,829 | 2/1981 | Link et al. | 400/186 X |
| 4,259,026 | 3/1981 | Hanaoka et al. | 400/185 X |
| 4,353,655 | 10/1982 | Watanabe et al. | 400/144.2 |
| 4,376,585 | 3/1983 | Fromme et al. | 400/185 |
| 4,410,289 | 10/1983 | Koike et al. | 400/185 |
| 4,414,496 | 11/1983 | Watanabe et al. | 318/696 |
| 4,558,965 | 12/1985 | Ueda | 400/144.2 |
| 4,565,128 | 1/1986 | Moriyama et al. | 101/93.19 |
| 4,589,788 | 5/1986 | Lendl | 400/187 |
| 4,601,596 | 7/1986 | Musso | 400/697.1 |
| 4,606,662 | 8/1986 | Komplin | 400/185 X |
| 4,609,297 | 9/1986 | Hubner et al. | 400/187 |
| 4,615,631 | 10/1986 | Ueda | 400/705.1 |
| 4,637,744 | 1/1987 | Valle et al. | 400/185 |

FOREIGN PATENT DOCUMENTS

| | | | |
|---|---|---|---|
| 0038290 | 10/1981 | European Pat. Off. | 400/185 |
| 0118307 | 9/1984 | European Pat. Off. . | |
| 0186212 | 7/1986 | European Pat. Off. | 400/185 |
| 3014822 | 10/1981 | Fed. Rep. of Germany . | |
| 3110952 | 10/1982 | Fed. Rep. of Germany . | |
| 3424045 | 1/1985 | Fed. Rep. of Germany . | |

OTHER PUBLICATIONS

IBM Technical Disclosure Bulletin, "Variable Lift and Feed Increment Ribbon/Correction Mechanism", Greenlief et al., vol. 26, No. 3B, Aug. 1983, pp. 1580–1582.

*Primary Examiner*—David A. Wiecking

*Attorney, Agent, or Firm*—Fitzpatrick, Cella, Harper & Scinto

[57] ABSTRACT

There is disclosed an output apparatus which prints and outputs onto an ink ribbon in an electronic typewriter or the like. One motor is commonly used for print paper feed, ribbon feed, and ribbon lift up/down operations. The ribbon feed mechanism is controlled by the heteromorphic or noncircular rotary cam having grooves of different kinds of radii. The ink ribbon feed operation and the correction ribbon feed and lift up/down operations are also performed by the rotary cam. With this apparatus, the ink and correction ribbons can be efficiently used and the operation timing of the carriage can be accurately controlled.

43 Claims, 48 Drawing Sheets

99
99a
99b
99c
100
100b
101
102
102a
104
107b
59e
59f
F 116
117
118
122a
619a
619
121
120
125
123
122
10
124
52
7
1
126

FIG.32-1A
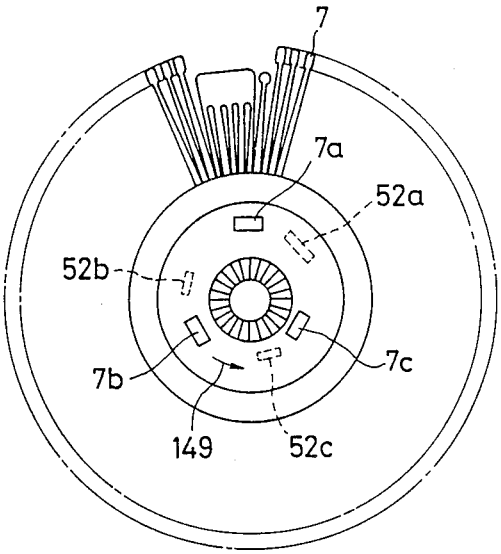
FIG.32-1B
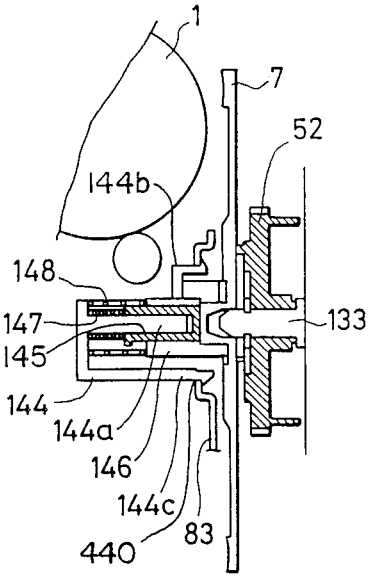
FIG.32-2A
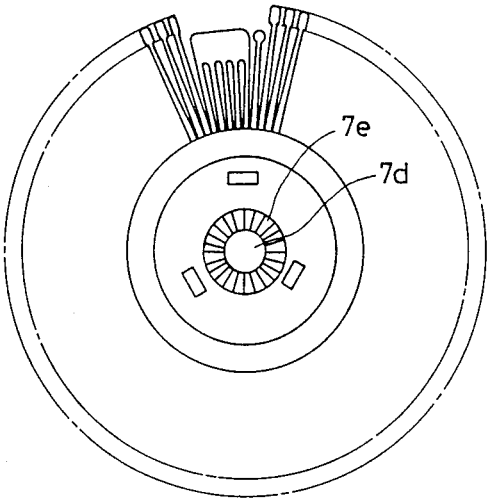
FIG.32-2B
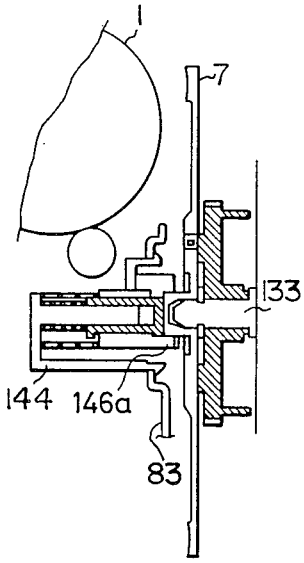
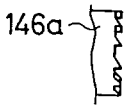
FIG.32-2C FIG. 54
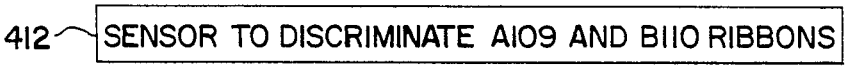
FIG. 55
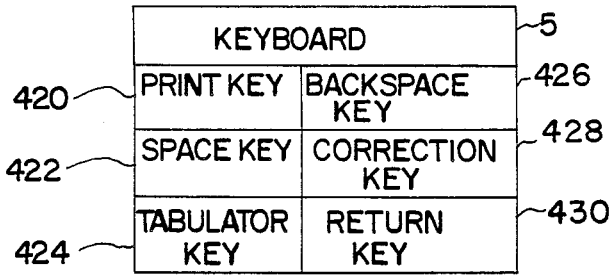
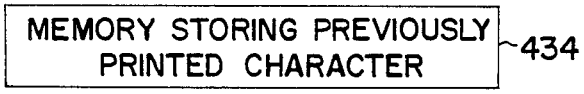
FIG. 56
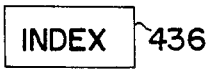
FIG. 57
FIG58
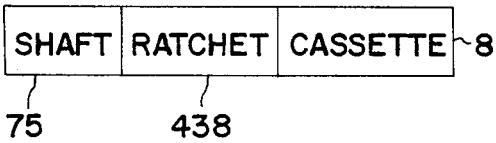
FIG. 59
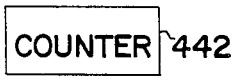
FIG. 60
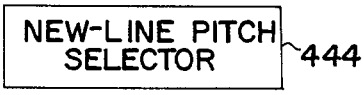
FIG. 61
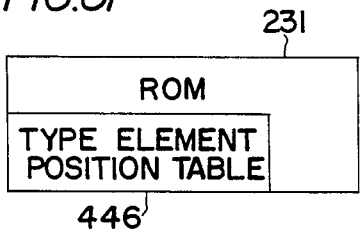

ELECTRONIC TYPEWRITER HAVING IMPROVED PAPER AND INK FEED MECHANISMS SELECTIVELY DRIVEN BY A SINGLE REVERSIBLE MOTOR

This application is a continuation of application Ser. No. 854,194 filed Apr. 21, 1986, now abandoned.

BACKGROUND OF THE INVENTION

1. Field of the Invention

The present invention relates to an output apparatus for printing and outputting onto a print sheet of a typewriter or the like.

2. Related Background Art

In recent years, printing output apparatuses such as a typewriter and the like have been electronized more and more and the printing apparatuses having excellent functions, high processing speed, and high reliability have been manufactured. In most of those printing apparatuses, the respective movable sections are equipped with the devices to drive them and these devices are controlled by one or a plurality of microprocessors.

It is indeed easy to obtain the high reliability for the devices and electronic output apparatuses which are, used in the above-described equipment. However, these apparatuses are still expensive as compared with the mechanical parts which are attached to those devices and apparatuses. Also, a fairly large amount of electric power is required to drive such a printing apparatus. Therefore, although the electronized printing apparatus is suitable for a high-class apparatus, there are difficult problems in the case of providing the low-cost printing output apparatuses having excellent functions and good operating efficiency.

SUMMARY OF THE INVENTION

The present invention is made in consideration of the foregoing points and it is an object of the invention to clarify several mechanisms and controls necessary to provide the low-cost printing apparatus having excellent functions and good operating efficiency.

Another object of the invention is to realize the miniaturization, light-weight, low electric power consumption of the printing apparatus by use of such mechanisms and controls.

As means for solving the foregoing problems, the printing apparatus of an embodiment shown in FIG. 45-2 has an MPU 230, a ROM 231, a RAM 232, a timer 233, and an I/O expander circuit 234.

Still another object of the invention is that since there is the possibility that a new ribbon cassette was loaded after the cover of the apparatus had been opened and closed, the ribbon take-up operation is performed to set the take-up mechanism.

Still another object of the invention is to prevent unnecessary ribbon feed by limiting the above control to the operation before the next printing operation after opening and closing the cover is executed.

Still another object of the invention is that in the case where the next printing operation is requested during execution of the ribbon shift-down operation, the shift-up operation is started before completion of the ribbon shift-down.

Still another object of the invention is that the index is detected at the home position of the print wheel and when an error is generated (or when no error can be detected), the region near the home position is preferentially sought, thereby reducing the seeking time.

Still another object of the invention is that two home positions of the wheel are set and after the carriage is moved to the right, the notched position of the wheel is set to the home position (first home position) so as to see the printed character, and after the carriage is moved to the left, the wheel position is rotated and set to the second home position so as to see the character at the position of the hammer.

Still another object of the invention is to change an amount of movement of the ribbon due to both the ribbon take-up control and the shift-up control.

Still another object of the invention is to allow one motor to be commonly used for paper feed, ribbon feed, and ribbon shift.

Still another object of the invention is to detach the platen from the driving system in the manual operation mode.

Still another object of the invention is to vertically move the correction ribbon up and down by slightly rotating the ribbon shift cam in the correcting operation mode, thereby efficiently using the correction ribbon.

Still another object of the invention is to accurately control the timing for the operation of the carriage.

Still another object of the invention is to constitute the apparatus such that the height of ribbon can be changed while keeping constant the angle of contact surface of the ribbon for the ribbon guide corresponding to the angle of inclination of the type wheel with respect to the vertical direction, and even when the height differs, the slack of the ribbon or the like can be absorbed so that the length of ribbon pulled out of the cassette is constant.

Still another object of the invention is to take up the ribbon in the case of shifting the ribbon from the standby position to the printing position.

Still another object of the invention is to absorb the backlash or play of the gear, belt, and the like by varying an angle of rotation of the feed motor in accordance with each sequence.

Still another object of the invention is to easily control the above-mentioned various kinds of operations of the ribbon by use of the cam having different kinds of radii. Still another object of the invention is to enable the hammer portion to be rotated so as to make the hammer face upward, and thereby enabling the wheel to be further easily exchanged and the like.

BRIEF DESCRIPTION OF THE DRAWINGS

FIGS. 13-1 to 13-3 are diagrams for explaining the ribbon shifting operation;

FIGS. 18-1 to 18-7 are sequence diagrams of a rotary cam to shift up a ribbon;

FIGS. 19-1 to 19-4 are sequence diagrams of the rotary cam to shift down the ribbon;

FIGS. 21-1 to 21-3 are explanatory diagrams showing ribbon feed amounts;

FIGS. 22-1 to 22-6 are sequence diagrams of the rotary cam to shift up a multi-strike ribbon;

FIGS. 23-1 to 23-7 are sequence diagrams of a shift cam;

FIGS. 24-1 to 24-11 are sequence diagrams of the cam for correction ribbon shift-up;

FIGS. 28-1 to 28-3 are sequence diagrams to take up the correction ribbon;

FIGS. 32-1A and 32-2A are front views of the type wheel, and FIGS. 32-1B and 32-2B are cross-sectional views of the type wheel and FIG. 32-2C is side view of edge portion of wheel lock 146 loading mechanism;

FIGS. 45-1 to 45-2 are control circuit diagrams of the apparatus of the invention;

FIG. 54 shows a block diagram of a sensor for discriminating ribbons A109 and B110;

FIG. 55 shows a block diagram of some of the keys on the keyboard;

FIG. 56 shows a block diagram of a memory for storing a previously printed charcter; and FIG. 57 shows a block diagram of an index of the present invention;

FIG. 58 shows a block diagram of ratchet 438;

FIG. 59 shows a block diagram of counter 442;

FIG. 60 shows a block diagram of a new line pitch selector 444; and

FIG. 61 shows a block diagram of type element position table 446 in ROM 231.

DETAILED DESCRIPTION OF THE PREFERRED EMBODIMENTS

The invention will now be described in detail hereinbelow with reference to the drawings.

Figure 2:
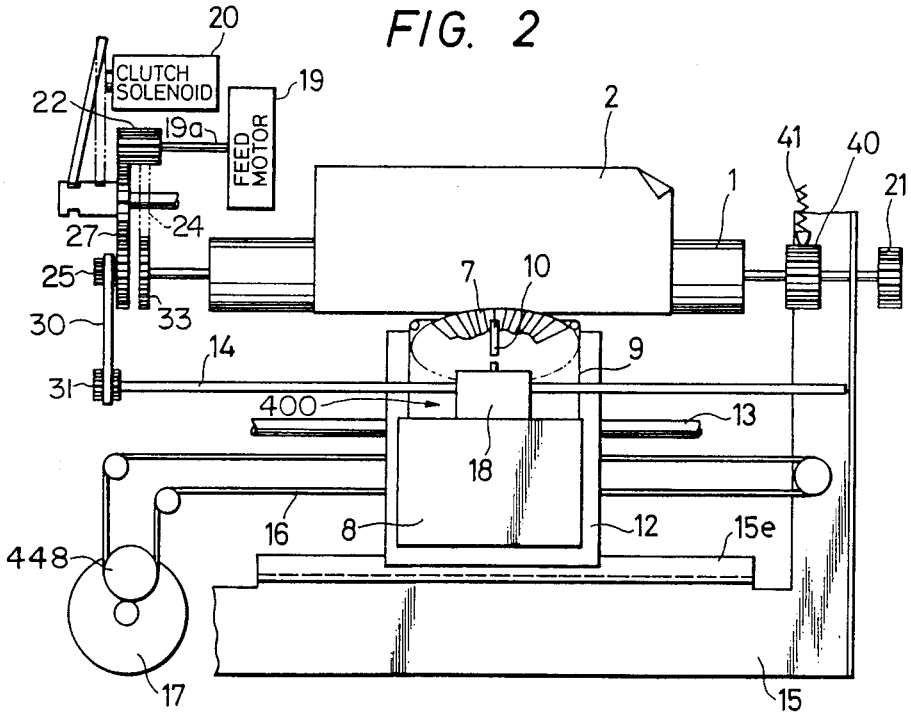
FIG. 2 is a functional systematic diagram.
Figures 1, 45:
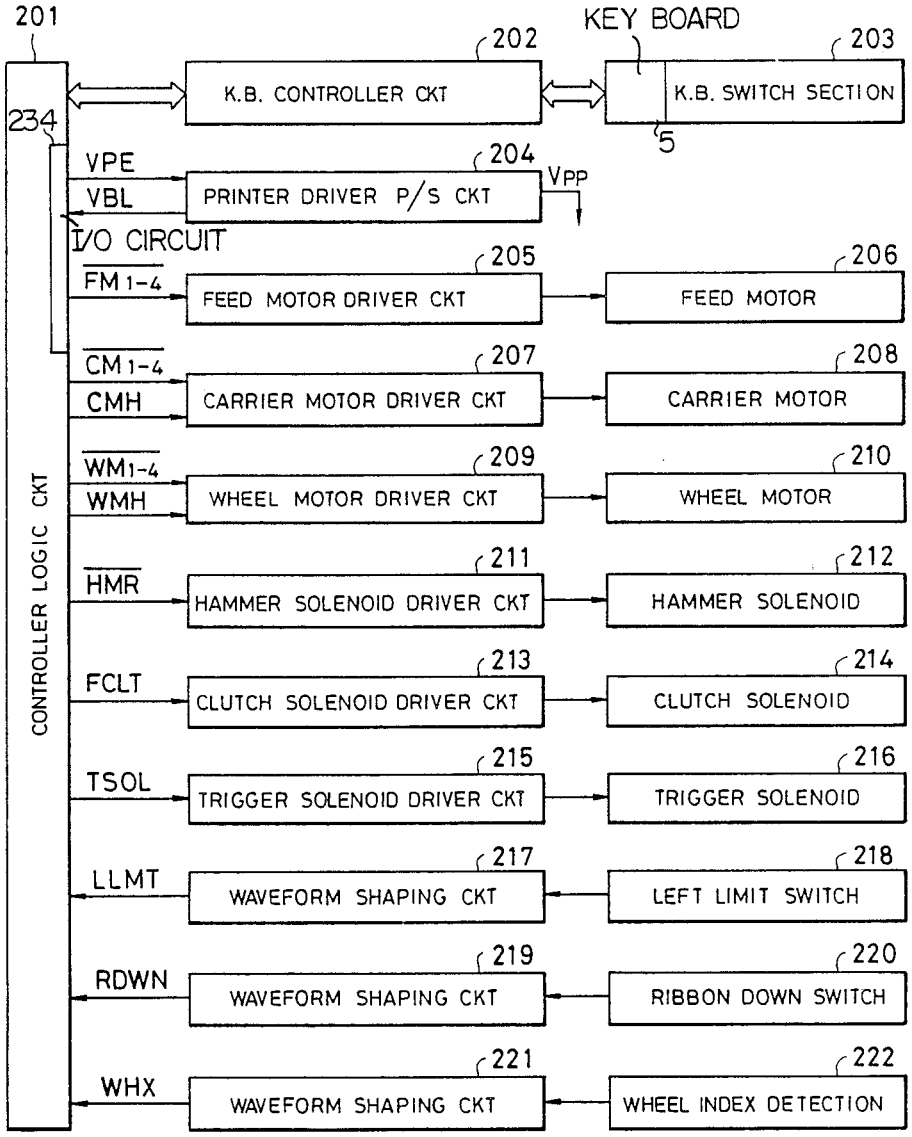
Figures 2, 45:
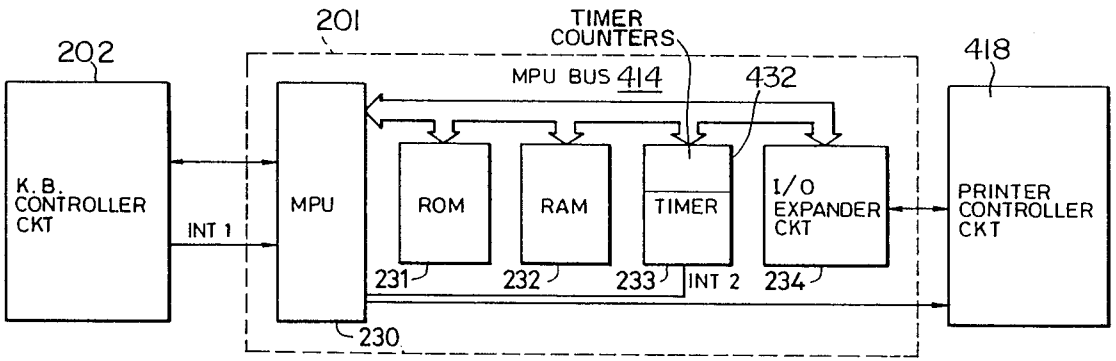

FIG. 45-2 is a control block diagram. A printing apparatus of an embodiment shown in this diagram has a microprocessing unit (MPU) 230, a read only memory (ROM) 231, a random access memory (RAM) 232, a timer 233, and an input/output (I/O) expander circuit 234.

Figure 1:
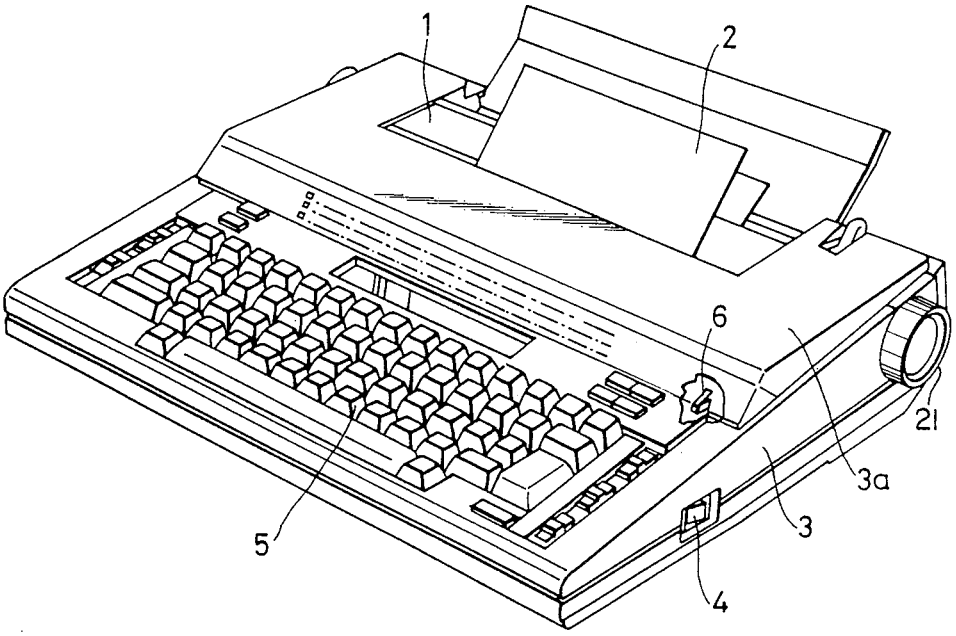
FIG. 1 is an external view of a printing apparatus of the present invention.

FIG. 1 is an external view of the printing apparatus of the invention.

In the diagram, reference numeral 1 denotes a platen; 2 is a recording medium such as print paper; 3 a casing; 4 a power switch to turn on and off a power source; 5 a keyboard; and 6 a hood switch which is turned on and off in dependence on the opening and closing of a hood 3*a*. Platen 1 functions as a first feed mechanism for feeding print paper 2. When the opening/closing of the hood 3*a* is detected and the hood 3*a* is opened, the hood switch 6 generates a signal to shift an ink sheet or ribbon 9 and a correction sheet or ribbon 11, which will be explained later, to predetermined positions and at the same time the switch 6 locks the keyboard by this signal.

FIG. 2 is a schematic diagram for explaining the functional system, in which numeral 1 is the platen 2 is the print paper, and 12 is a carriage which can move in parallel with the platen and which is equipped with printing means 400. The carriage 12 is held on a shaft 13 fixed to the main body of the printing apparatus and rail 15*e* of a main body frame 15.

Figure 29:
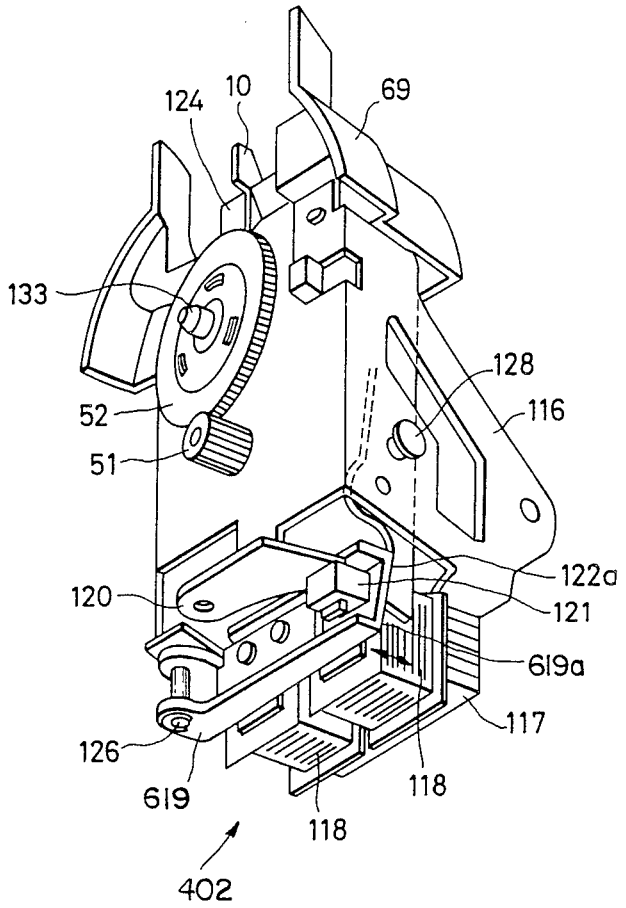
FIG. 29 is a perspective view of a hammer system.

A type wheel 7 has a plurality of types to print and is mounted on the carriage 12 and driven by a wheel motor 18. An ink ribbon 9 is enclosed in a ribbon cassette 8. A part of the ink ribbon 9 is pulled out of the ribbon cassette and fed between the type wheel and the print paper 2. A print hammer 10 is energized by a solenoid 402 as shown in FIG. 29 comprising winding coils 118, laminated yoke 117 and armature 119 in the carriage and hits the back surface of the type wheel, thereby printing onto the print paper through the ink ribbon 9.

The driving force of a carriage motor 17 is reduced by gears 448 and thereafter, the carriage 12 is driven through a carriage belt 16 by the reduced force.

Feed Motor

A feed motor 19 is used to feed the paper, ribbon, and the like. In the ordinary operation mode, the feed motor 19 transfers the driving force through the gears 22 and 24 and a clutch belt 30 to a control rod 14 having a heteromorphoic shape (noncircular cross section). The control rod 14 penetrates the slidable carriage and also controls the correction ribbon which makes it possible to take up the ink ribbon, shift of the ink ribbon in the vertical direction, and correct the printed characters by rotating in the forward and reverse directions as indicated by arrow A, which will be explained hereinlater, in the carriage 12. Thus the control rod 14 is a feed mechanism for selectively feeding one of the ink ribbon 9 and an ink correction sheet or ribbon 11.

Numeral 20 denotes a clutch solenoid. The clutch solenoid 20 can be selectively made operative to allow the driving force of the feed motor 19 to be used for controlling the ink ribbon or for driving the platen. A platen knob 21 is provided to manually drive the platen 1.

Figure 5:
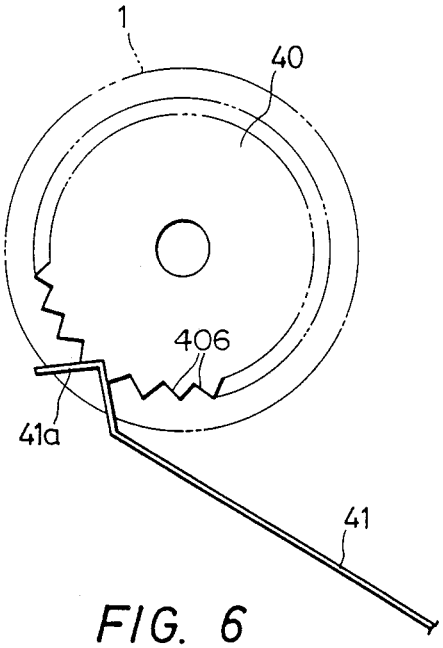
FIGS. 5 and 6 are explanatory diagrams of a detent gear and a detent spring.
Figure 6:
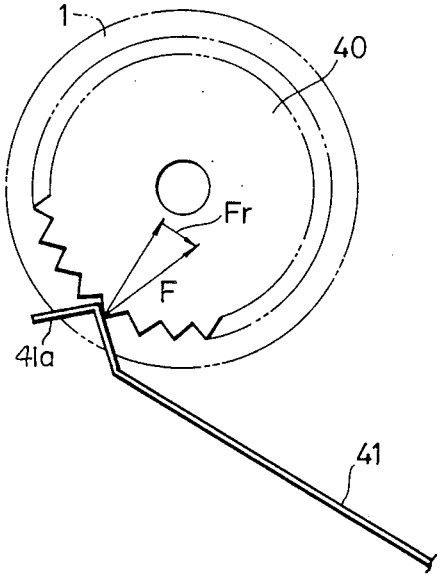

A platen detent mechanism 40 is constituted such that a spring member 41 is engaged with triangular teeth 406 supported coaxially with the platen 1. Therefore, even when the platen 1 is released from the feed motor 19 by the clutch solenoid 20 and becomes free, unnecessary rotation of the platen 1 can be prevented by the platen detent mechanism 40. Further, the platen 1 can be manually fed at predetermined regular intervals by the platen detent mechanism 40. The platen 1 can be manually fed through the platen knob 21 by an operator. The platen 1 can be moved at predetermined regular intervals through the platen detent mechanism 40 as shown in FIGS. 5 and 6. When the platen 1 is in the state shown in FIG. 6, it will necessarily be moved to the state shown in FIG. 5 by force Fr, thereby permitting manual rotation with a click feeling.

In this manner, when the platen 1 is manually rotated, the platen 1 can be disengaged from the motor to drive the platen.

In the case of driving the platen 1 by a low-cost and low-power motor, the torque necessary for the platen 1 to feed the print paper is unconditionally determined. Therefore, the driving force of the motor needs to be reduced by gears or belts or the like so as to obtain the necessary torque.

On the other hand, since those motors ordinarily generate the rotational friction forces from their rotor (not shown), in the case where the reduction gear ratio between the motor and the platen is large as mentioned above, there are the following problems. Namely, when the operator desires to manually rotate the platen 1, the rotational friction force of the motor 19 becomes a large friction force, so that the response speed of the force of the detent mechanism 40 deteriorates. In the worst case, there can occur the situation such that the platen 1 cannot be held at the normal position by the spring member 41 of the detent mechanism 40.

On the other hand, according to the invention, the normal detent function can be effected since the platen 1 is ordinarily disengaged from the feed motor 19.

In addition, another feature of the invention is as follows. When feed motor 19 disengages from the platen 1, the driving force of feed motor 19 is used to drive and shift both the ink ribbon 9 and the correction ribbon.

Further, another feature of the invention relates to a clutch mechanism 408 to implement the above-mentioned points. The clutch mechanism 408 will be first described.

Figure 3:
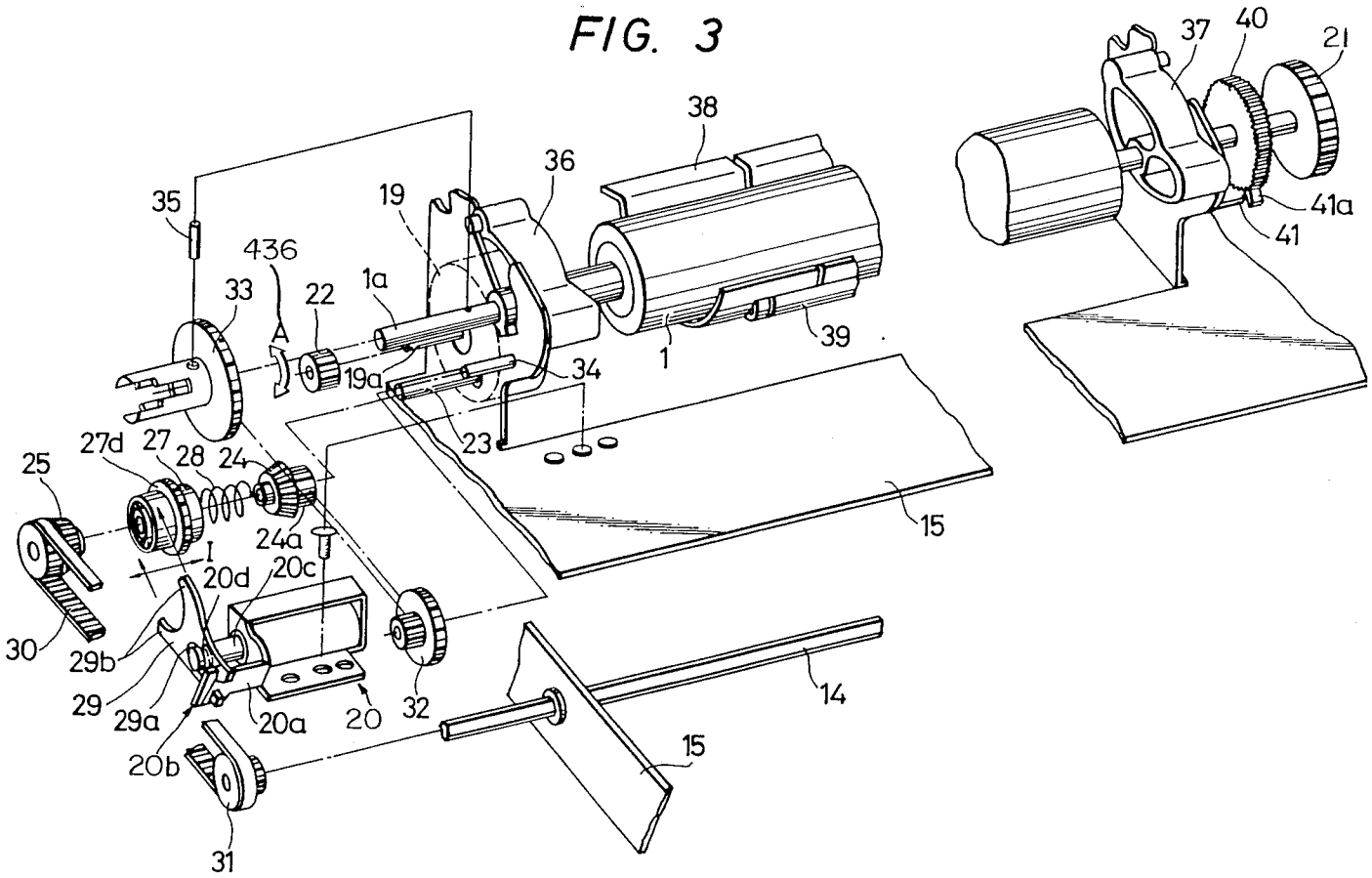
FIG. 3 is an exploded explanatory diagram of the portions around a platen.

FIG. 3 is an exploded explanatory diagram showing an embodiment of the invention. The feed motor 19 indicated by a broken line in the diagram is fixed to the main body frame 15. A gear 22 is fixed on a shaft 19*a* of the feed motor 19. A clutch gear 24 and a clutch belt pulley 25 are axially rotatable, rotatably axially supported by a shaft 23.

Figure 4:
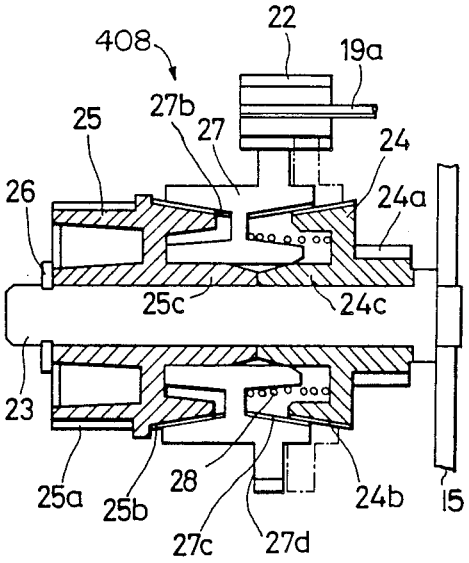
FIG. 4 is a cross sectional view of a clutch.

FIG. 4 is a cross sectional view of the clutch mechanism 408, in which numeral 22 denotes the forward gear, 23 is the shaft, and 26 is a thrust snap ring to restrict the motions of the clutch gear 24 and clutch belt pulley 25 in the thrust direction. The clutch gear 24 has an involute tooth 24*a* and a serration 24*b*. The clutch belt pulley 25 has a belt tooth 25and a serration 25*b* . A slide clutch 27 is rotatably, slidably, and axially supported on a flange 24*c* of the clutch gear 24 and on a flange 25*c*, which will be explained hereinafter, of the clutch belt pulley 25. The slide clutch 27 always engages the gear 22. The slide clutch 27 has involute teeth and serrations 27*b* and 27*c* of internal teeth on both sides. A coil spring 28 always presses the slide clutch 27 to the clutch belt pulley 25. In this state, the serration portion 25*b* of the pulley 25 and the internal tooth serration 27*b* of the slide clutch 27 engage each other. Thus, the rotation of the slide clutch can be transferred to the pulley 25 without any slip.

When the slide clutch 27 slides in the direction of the clutch gear 24 due to the clutch solenoid 20 which will be explained hereinlater, the serrations 25*b* and 27*b* are released as indicated by an alternate long and two short dashed line in FIG. 4. Thus, the serration 24*b* of the clutch gear 24 engages the internal tooth serration 27*c* of the slide clutch 27 and the rotation of the slide clutch 27 is transferred to the clutch gear 24.

The clutch solenoid 20 in FIG. 3 has a head plate 20*a*. The head plate 20*b* is formed with a fulcrum 20*b* into which a lever 29 is inserted. A groove 20*d* of an armature 20*c* of the clutch solenoid 20 engages a screw slotted portion 29*a* of the lever 29. The edge portion of the lever 29 has a furcate structure consisting of two arms 29*b*. The arms 29*b* abut on the slide clutch 27 and a wall 27*d* of involute teeth.

As mentioned above, the rotation of the feed motor 19 is transferred to the slide clutch 27 through the gear 22 and the slide clutch 27 always engages the clutch belt pulley 25 by the spring member 28. Consequently, the pulley 25 rotates and the torque is transferred to the control rod 14 through a clutch belt 30 and a control rod pulley 31. In this transferring system, the feed motor is used to control the ribbon.

In the case of feeding the paper after completion of the printing of one line, when the clutch solenoid 20 is energized it allows the armature 20*c* to be attracted. Thus, the lever 29 is swung in the directions indicated by arrows I around a fulcrum 20*b* as a rotational center, thereby causing the slide clutch 27 to be moved to the side of the clutch gear 24 against the spring force of the spring member 28. When the feed motor 19 rotates with the armature 20*c* attracted, the rotation is transferred through the gear 22 and slide clutch 27 to the clutch gear 24. The motive force is further transferred to the platen 1 through a reduction gear 32, which engages the clutch gear 24, and through a platen gear 33.

A stud 34 axially supports the reduction, gear 32. A pin 35 fixes the platen gear 33 on the shaft 1*a* of the platen 1.

Reference numerals 36 and 37 denote bearings to hold the platen 1 on the main body frame 15; 38 is a paper guide; and 39 is a roller to press the print paper onto the platen 1.

Numeral 40 denotes the detent mechanism comprising a detent gear to provide a click feeling to the rotation of the platen 1 and remove the unnecessary play, and 41 is the detent spring which is fixed to the frame 15. An edge tooth-shaped portion 41*a* of the detent spring 41 engages the teeth 406 of the detent gear 40, thereby allowing the platen 1 to be set at the stable position.

In the case of rotating the platen 1 by the feed motor 19, an angle of rotation of the motor which is necessary to feed the platen 1 from a certain stable position to the next stable position is preliminarily obtained, and the motor is rotated by only the amount which is an integer times as large as the rotational angle obtained.

When the clutch solenoid 20 is in the OFF state, the slide clutch 27 is disengaged from the clutch gear 24, so that the platen 1 is inevitably disengaged from the feed motor 19.

When the operator rotates a platen knob 21 by the hand with the force over the click force of the detent gear 40 in this state, this rotation is transferred to the clutch gear 24 but does not rotate the feed motor 19. Therefore, the clutch gear 24 can be relatively slightly rotated. Even if the platen 1 is stopped at a position other than the stable position which is provided by the detent gear 40 and detent spring 41 due to the manual rotation, in other words, even if the platen 1 is stopped in the state in which the detent spring lies on the tooth-shaped portion of the detent gear due to the manual rotation, the platen 1 can be rotated by a weak detent spring force because of the small rotational friction force of the platen 1, so that the platen can be easily led to the stable position.

FIGS. 5 and 6 are diagrams for explaining the engagement between the detent gear 40 and the detent spring 41.

In FIG. 5, the edge tooth-shaped portion 41*a* of the detent spring 41 completely engages the triangular tooth 406 of the detent gear 40, so that the platen 1 is held in the stable state.

When the platen 1 is rotated by the external force and stopped at the position as shown in FIG. 6, a pressure F is applied to the detent gear 40 by the detent spring 41, causing the platen to be rotated by a component force Fr of the pressure F.

When the rotational friction force of the platen 1 is larger than Fr, the platen cannot be led to the stable position by the detent spring 41.

According to the invention, since the rotational friction force of the platen can be suppressed to a small force, even if the pressure F of the detent spring 41 is small as well, the platen can be moved (rotated from the state of FIG. 6 to the state of FIG. 5).

Carriage

Figure 7:
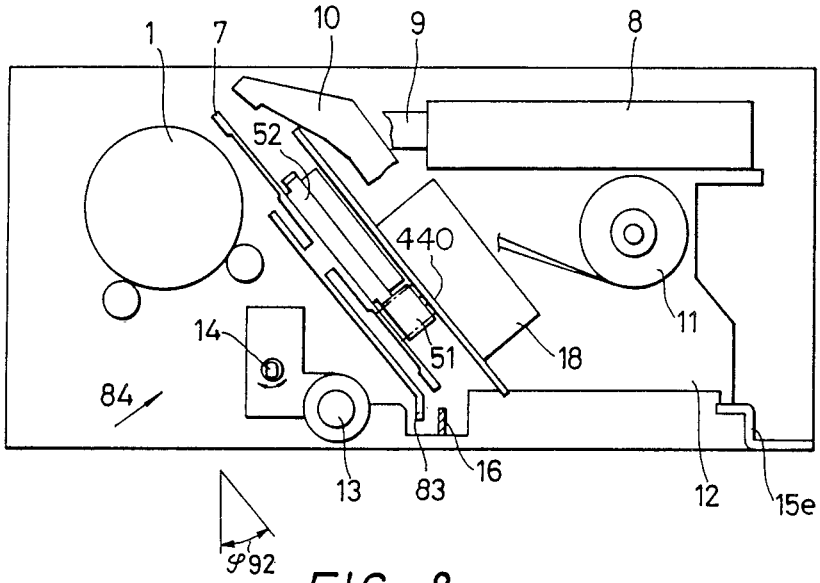
FIG. 7 is a cross sectional view showing the outline of a carriage.

FIG. 7 is a cross sectional view showing the outline of the carriage 12 shown in FIG. 2.

Inclination ζ92 of the type wheel

The carriage 12 is supported by the rear shaft 13 and rail 15*e* and can move in the upward direction of FIG. 7 due to the driving of the carriage belt 16. Further, the rotation of the wheel motor 18, is reduced due to a wheel pinion 51 fixed to a shaft 440 of the wheel motor 18 and a wheel supporting gear 52. By rotating the type wheel 7 which engages the gear 52, a desired character is selected and then hit by the hammer 10 to print it. In this case, the control rod 14 penetrating the carriage 12 is rotatably supported and the driving force of the feed motor 19 (FIG. 2) is transferred to the inside of the carriage, thereby controlling the shift and take-up operations of the ribbon 9 and correction ribbon 11.

Figure 8:
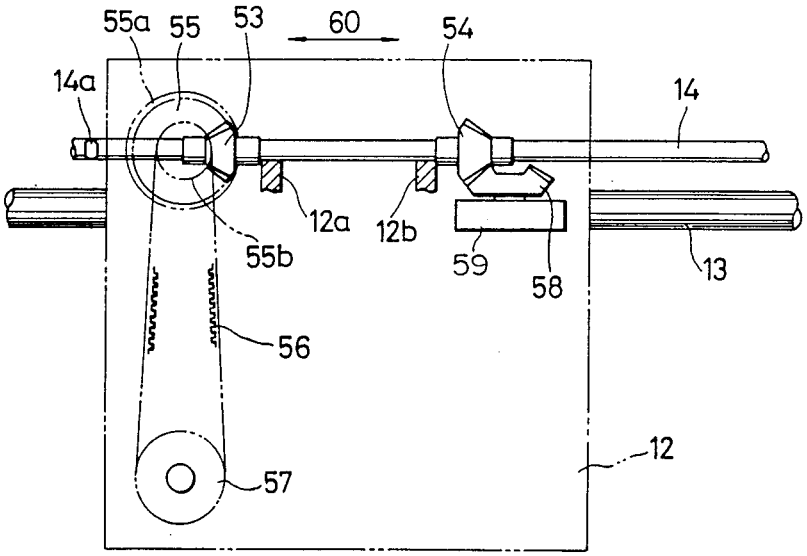
FIG. 8 is a functional diagram showing the relation between a control rod and a carriage.

FIG. 8 is a fuctional diagram showing the outline of the system to transfer the torque from the control rod 14 to the, carriage 12. A first slide bevel gear 53 and a second bevel gear 54 engage the control rod 14 having the cross sectional shape of a heteromorphic (noncircular) shape 14*a*. Each of the slide bevel gears 53 and 54 has a hole of the same shape as the heteromorphic shape 14*a* and can freely slide (in the directions indicated by arrows 60) although they rotate integrally with the control rod 14. These two bevel gears 53 and 54 slide together with the carriage 12 and are positioned by guides 12*a* and 12*b* so that their relative positions with the carriage 12 are not changed.

The torque of the bevel gear 53 is transferred to a ribbon bevel gear 55, which engages the gear 53 and the cassette 8 through a ribbon belt 56 and a ribbon belt pulley 57, thereby allowing the ribbon to be wound.

On the other hand, torque of the bevel gear 54 is transferred to a cam bevel gear 58 which engages the gear 54 and drives a rotary cam 59, thereby controlling the positions of the ink ribbon 9 and correction ribbon 11 and the take-up mechanism of the correction ribbon 11*a*, 66, 67, and 113–115 shown in FIG. 27 (the details of which will be explained later).

Figure 9:
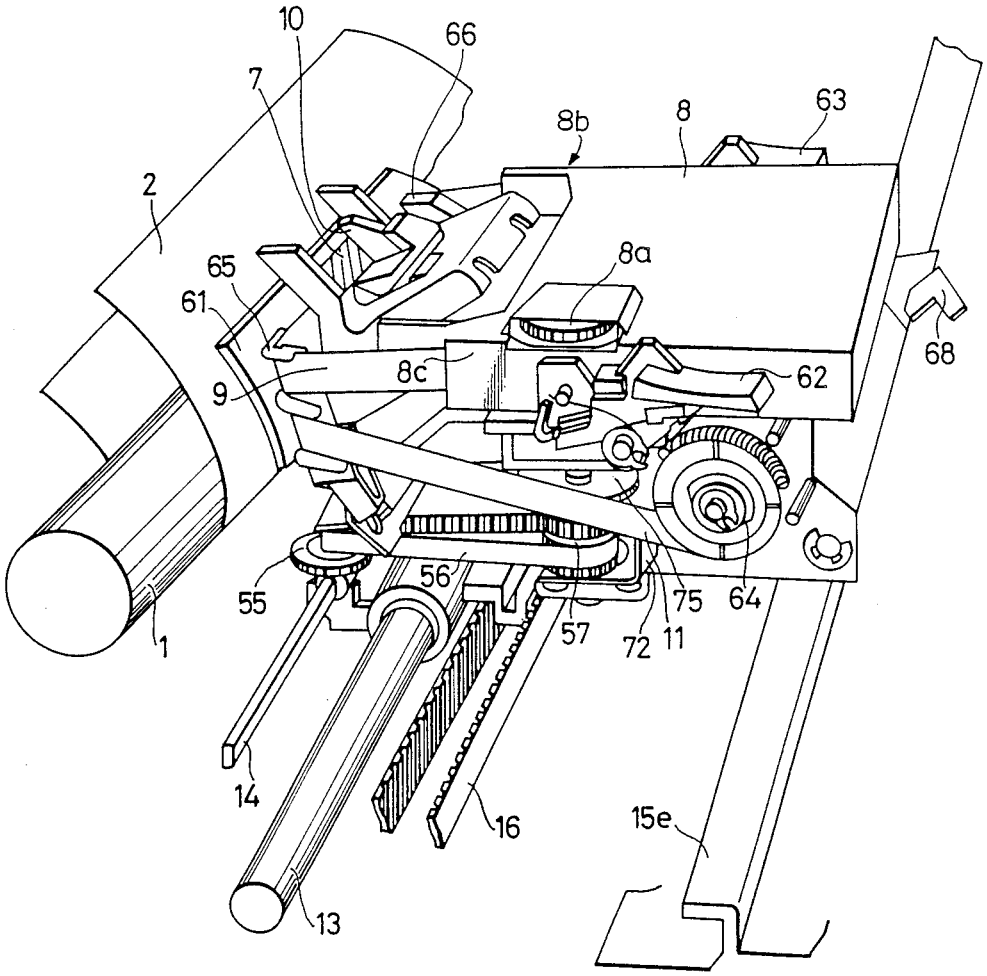
FIGS. 9 and 10 are perspective views of the whole carriage.
Figure 11:
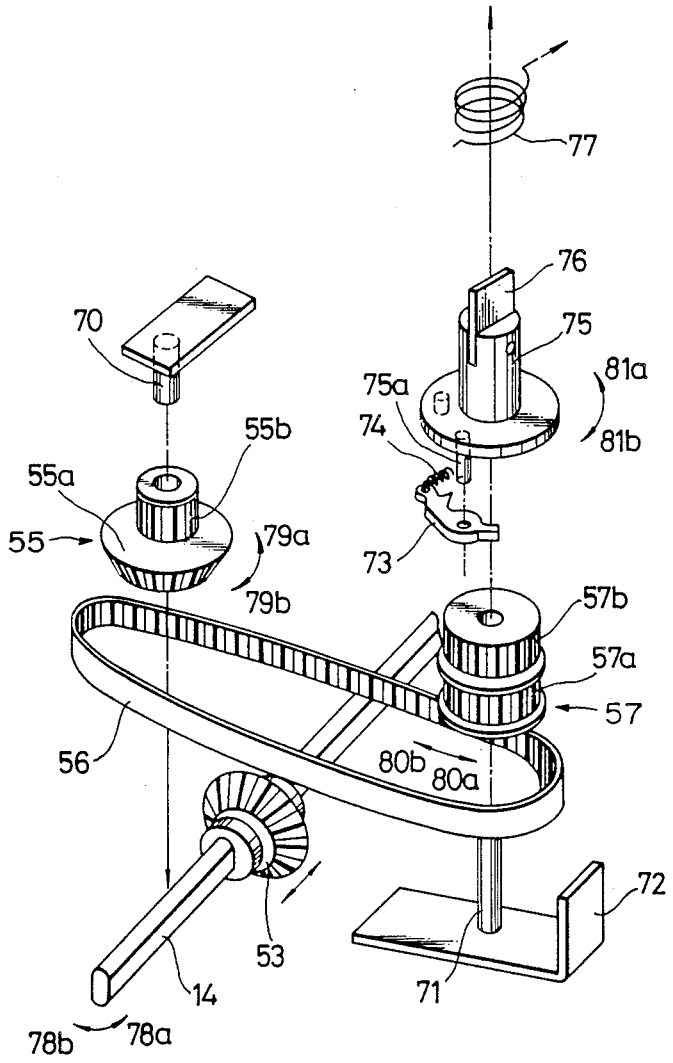
FIG. 11 is a perspective view of a ribbon take-up mechanism.

FIG. 9 shows a perspective view of the whole carriage. The carriage is equipped with a card holder 61 to guide the print paper 2 wound on the platen 1. The cassette 8 is detachably supported on the upper surface of the carriage 12 by cassette press levers 62 and 63. The cassette 8 has a knob 8*a* which is directly coupled with a ribbon take-up shaft 75. The correction ribbon 11 is detachably fixed to a supply spool 64 and engages two ribbon guides 65 and to define the height position of the correction ribbon 11. The correction ribbon 11 is also detachably supported on a take-up spool 67 shown in FIG. 27 (which will be explained hereinafter) on the opposite side, and gradually taken up by a take-up mechanism 11*a*, 66, 67, and 113–115 as shown in FIG. 27 (which will be explained hereinafter). In a manner similar to the above, the ink ribbon 9 is also supplied from a ribbon supply port 8*b* of the cassette 8 and led to the ribbon guides 66 and 65. The ink ribbon 9 is then inserted into a take-up port 8*c* of the cassette, 8 and taken up by a take-up mechanism 53, 55–57, and 71–75 as shown in FIG. 11 in the cassette. On the side of the carriage 12 opposite to the platen 1 side, an indicator 68 (a colored indicator or a light emitting diode) to indicate the current position of the carriage 12 in the typewriter is provided.

Figure 10:
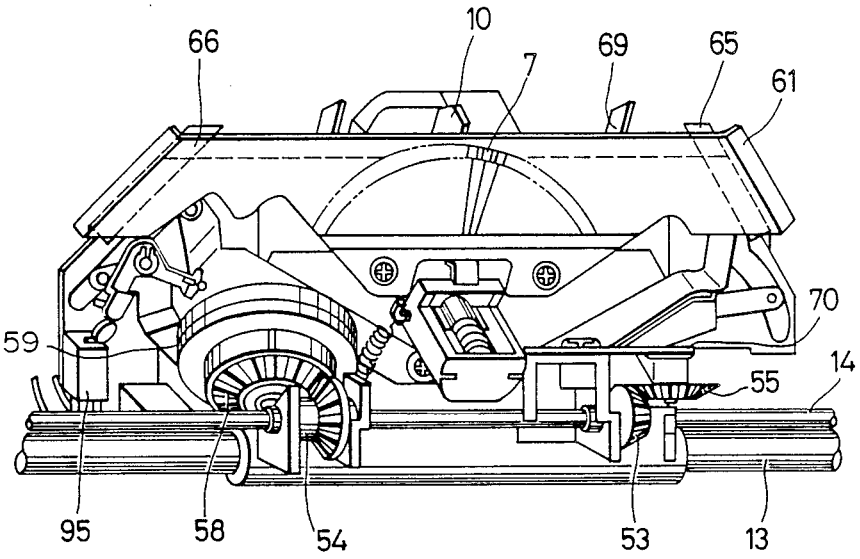

FIG. 10 is a perspective view of the carriage 12 as if the platen 1 was not shown. As will be seen from this diagram, the control rod 14, slide bevel gears 53 and 54, ribbon bevel gear 55, cam bevel gear 58, and ribbon guides 65 and 66 are properly arranged in position. The card holder 61 is also provided. To prevent the ink ribbon 9, correction ribbon 11, and type wheel 7 from contacting and entangled one another at the location near the type wheel 7, a hammer casing 69 is provided at the outer peripheral portion of the type wheel 7 and on the outside of the hammer. The ink ribbon and correction ribbon are slidably moved along the hammer casing 69, thereby isolating them from the type wheel 7.

The transferring system from the control rod 14 will now be described in detail hereinbelow.

Ribbon take-up mechanism

Figure 12:
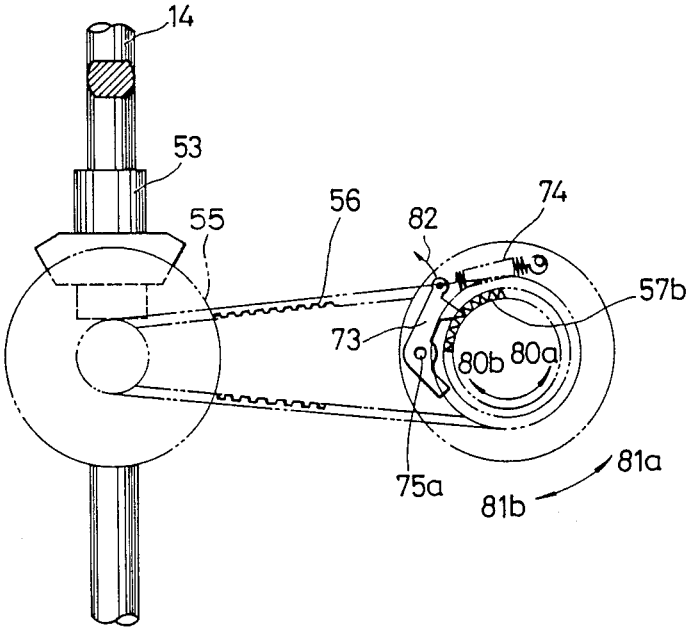
FIG. 12 is a mechanical diagram of a ribbon take-up clutch.

FIG. 11 is a perspective view showing the ribbon take-up mechanism comprising a second feed mechanism for feeding ink ribbon 9. FIG. 12 is a mechanical diagram showing the clutch section in the ribbon take-up mechanism.

When the control rod 14 rotates in the direction indicated by an arrow 78*a*, the slide bevel gear 53 also rotates in the same direction, so that a ribbon bevel gear 55*b* rotates, in the direction indicated by an arrow 79*a* around pin 70. The torque is transferred to a ribbon belt pulley 57*a* from the ribbon belt 56 which engages a belt pulley 55*b* formed integrally with the ribbon bevel gear 55*a*, so that the belt 56 rotates in the direction indicated by an arrow 80*b*. A ribbon feed pawl 73 engages a saw-tooth portion 57*b* formed integrally with the ribbon belt pulley 57*a* and is also axially supported by a shaft 75*a* on a flange of a ribbon take-up shaft 75. The ribbon take-up shaft 75 rotates through the ribbon feed pawl 73 in the direction indicated by an arrow 81*a* around a shaft 71 as a rotational central axis supported by l-shaped member 72. Thus, the torque is transferred to a take-up axis coupling portion 8*a* of the cassette 8 from an element 76 which engages the ribbon take-up shaft 75, thereby allowing the ink ribbon 9 to be taken up. The torque can be transferred from shaft 75 to cassette 8 via a ratchet 438 (FIG. 58). In this case, a spring clutch 77 wound around the ribbon take-up shaft 75 does not act on (i.e., does not obstruct) the motion of the shaft 75 since the rotation of the spring clutch 77 in the direction indicated by the arrow 81*a* is performed on the releasing side.

On the contrary, in the case where the control rod 14 rotates in the direction indicated by an arrow 78*b*, the rotational torque is similarly transferred to the ribbon belt pulley 57*a* and the ribbon belt 56 rotates in the direction indicated by an arrow 80*b* and ribbon bevel gear 55*a* rotates in the direction indicated by arrow 79*b*. However, at this time, the ribbon feed pawl 73 gets over the mountain portion of the saw-tooth portion 576 against the tensile force of a pawl spring 74 and moves in the direction indicated by an arrow 82 (FIG. 12) around the shaft 75*a* as a rotational central axis. Thus, the torque is not transferred to the ribbon take-up shaft 75.

Further, since the spring clutch, 77 is on the fastening side, the ribbon take-up shaft 75 doesn't rotate in direction 81*b* but completely stops and does not act on the cassette 8 at all.

The transferring system (for cam 59) from the slide bevel gear 54 will now be described.

Ribbon height control

Figures 1, 13:
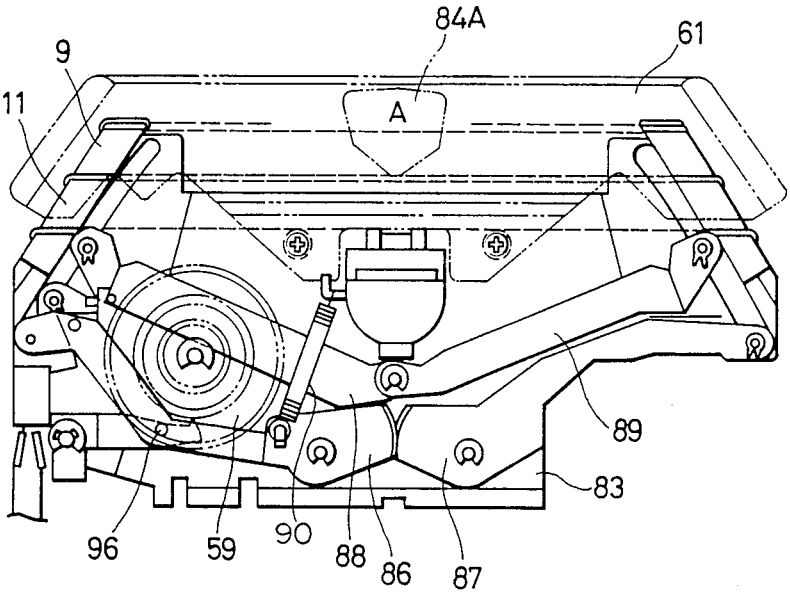
Figures 2, 13:
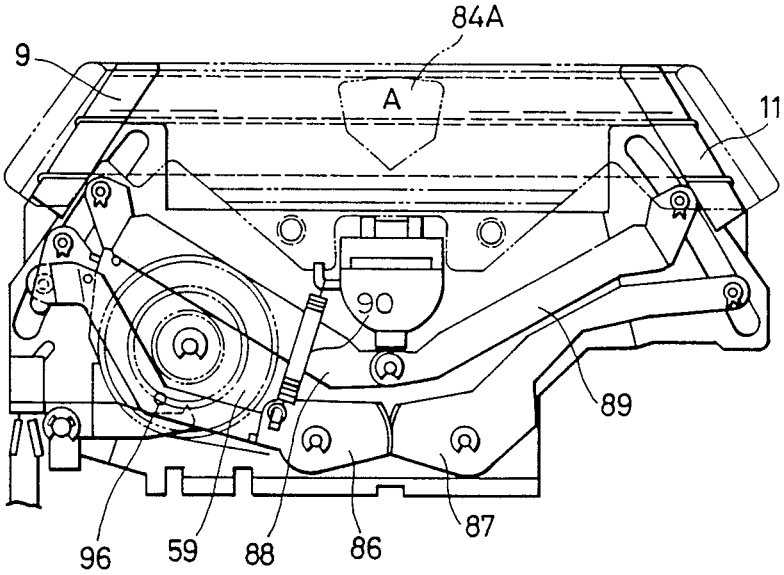
Figures 3, 13:
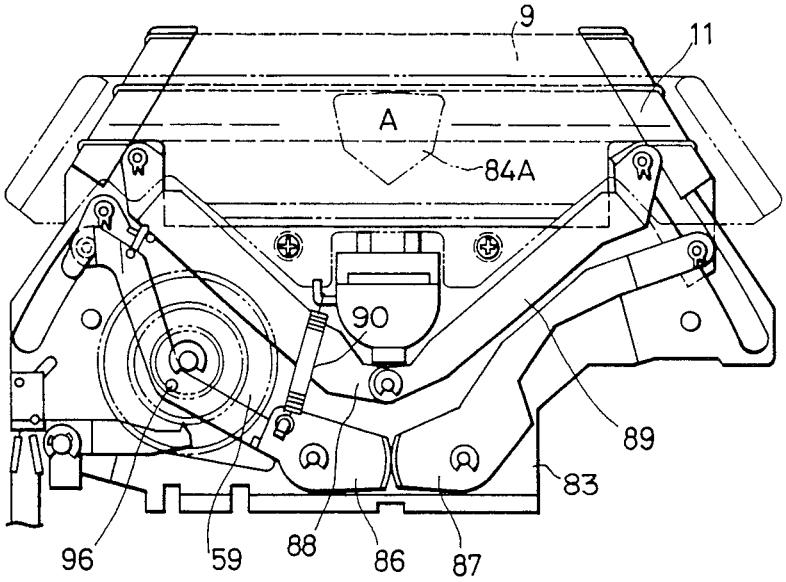

FIGS. 13-1 to 13-3 are diagrams for explaining the operation to control the heights of ink and correction ribbons in the diagram of a front seat plate 83 from the direction indicated by an arrow 84 in FIG. 7.

In FIG. 13-1, the print ribbon 9 is located downwardly from print point "A" 84A and shows "the state in which the character immediately after the printing can be seen by the typist", which is generally the necessary function of the typewriter.

In FIG. 13-2, the print ribbon 9 is lifted up at the height position of the print point "A" 84A. In this height state, the ink ribbon 9 is supplied and taken up and a desired character is selected and hit, thereby allowing the character to be printed.

In FIG. 13-3, the correction ribbon 11 is lifted up at the height position of the print point "A" 84A. In this state, a desired character is selected and hit, thereby enabling the printed character to be corrected (by lifting off the ink or covering the printed character).

Figure 14:
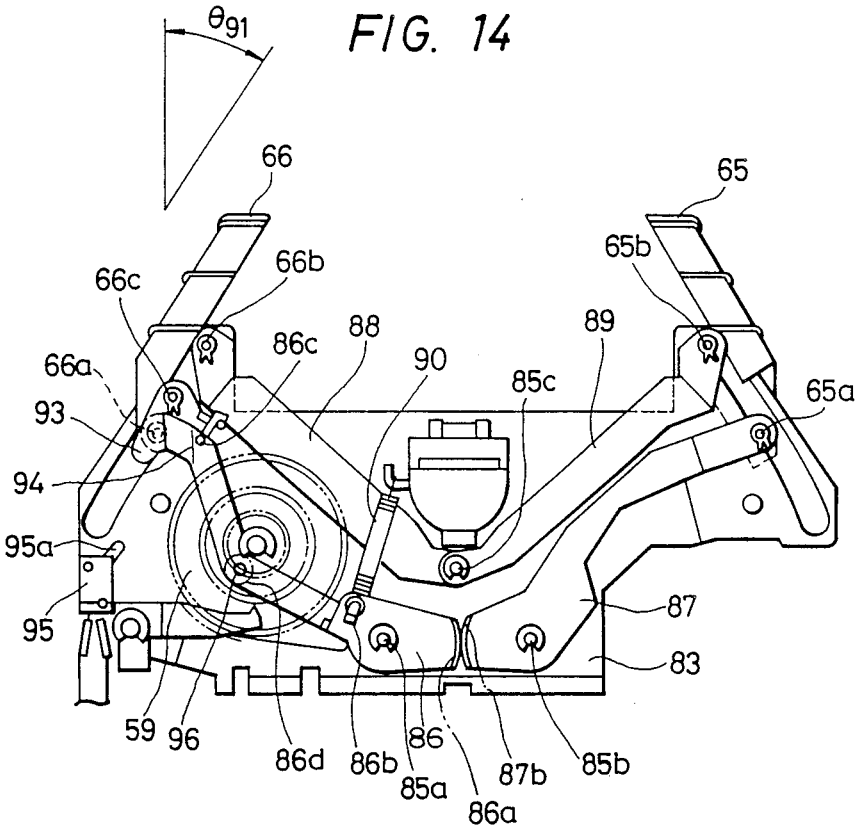
FIG. 14 is a front view of a ribbon shift system.

Inclination angle θ91 of arm in FIG. 14

The lifting system will then be explained with reference to a front view of FIG. 14. Three shafts 85*b*, 85*b*, and 85*c* are fastened to the front seat plate 83 made of metal plate. Ribbon blades 86, 87, 88, and 89 are attached to the front seat plate 83 so as to be rotatable around these three shafts 85*a*, 85*b*, and 85*c* as rotational centers. An axis portion 66*a* projected from the ribbon guide 66 is inserted into the hole portion at the edge of the ribbon blade 86. Likewise, an axis portion 66*b* projected from the ribbon guide 66 is inserted into the hole portion at the end of the ribbon blade 88. In this manner, a link mechanism 66, 83, 85–89 is constituted. Similarly, an axis portion 65*a* projected from the ribbon guide 65 is inserted into the hole portion at the edge of the ribbon blade 87. An axis portion 65*b* projected from the ribbon guide 65 is inserted into the hole portion at the edge of the ribbon blade 89. In this way, a link mechanism 65, 83, 85–89 constituted. Tooth shapes of involute gears are respectively formed at a right end 86*a* of the ribbon blade 86 and at a left end 87*b* of the ribbon blade 87 such that the left and right ribbon guides 65 and 66 are set at the same height positions. The motion of one of the link mechanisms is interlocked with the other one, thereby allowing the bilateral symmetry to be always obtained. A ribbon blade spring 90 is retained on, a hook portion 86*b*, so that an upward force is applied to the ribbon blade 86, thereby reducing the load components which are generated by the weight of the link mechanisms 65, 66, 83, and 85–89.

The angle of inclination θ91 of the ribbon contact surface of the ribbon guides 65 and 66 is determined by the angle of inclination ζ92 of the type wheel 7 in FIG. 7. In the path where the ink ribbon 9 is pulled out of the ribbon supply port 8*b* of the cassette 8 and enclosed into the ribbon take-up port 8*c*, a natural curve is given to the ink ribbon 9 and the ribbon 9 is properly guided so that the one-side slack or the like is not caused due to the angle θ91. It is an object of the link mechanism to operate with the angle of inclination θ91 held and thereby to allow the length of ribbon 9 (the same shall apply to the correction ribbon 11) pulled out of the cassette 8 to always become almost constant irrespective of the heights of the ribbon guides 65 and 66. In the case where the length of ribbon pulled out varies in dependence on the height positions of the ribbon guides 65 and 66, it is necessary to provide a mechanism so as to effectively absorb the slack which is caused due to the change in ribbon length pulled out. However, such a mechanism is unnecessary for the apparatus of the invention, since it is constituted as described above.

The ribbon guide 66 is further provided with an axis portion 66*c* projected. A down sensor chip 93 is rotatably supported around the axis portion 66*c* as a rotational center. Although the down sensor chip 93 is applied with the clockwise rotational force by a down sensor chip spring 94, the sensor chip 93 abuts on a boss 86*c* projected from the ribbon blade 86 and stops. When the ribbon guide 66 is located at the lowest position, the down sensor chip 93 detects this state and acts on a contact lever 95*a* of a down sensor 95. Thus, the down sensor 95 is turned on and generates a signal. (The details will be explained hereinafter.)

As will be understood from FIGS. 13-1 to 13-3 and 14, as a blade guide pin 96 exists at a shorter position of the rotational radius of the cam 59, the ribbon guides are elevated.

Figure 15:
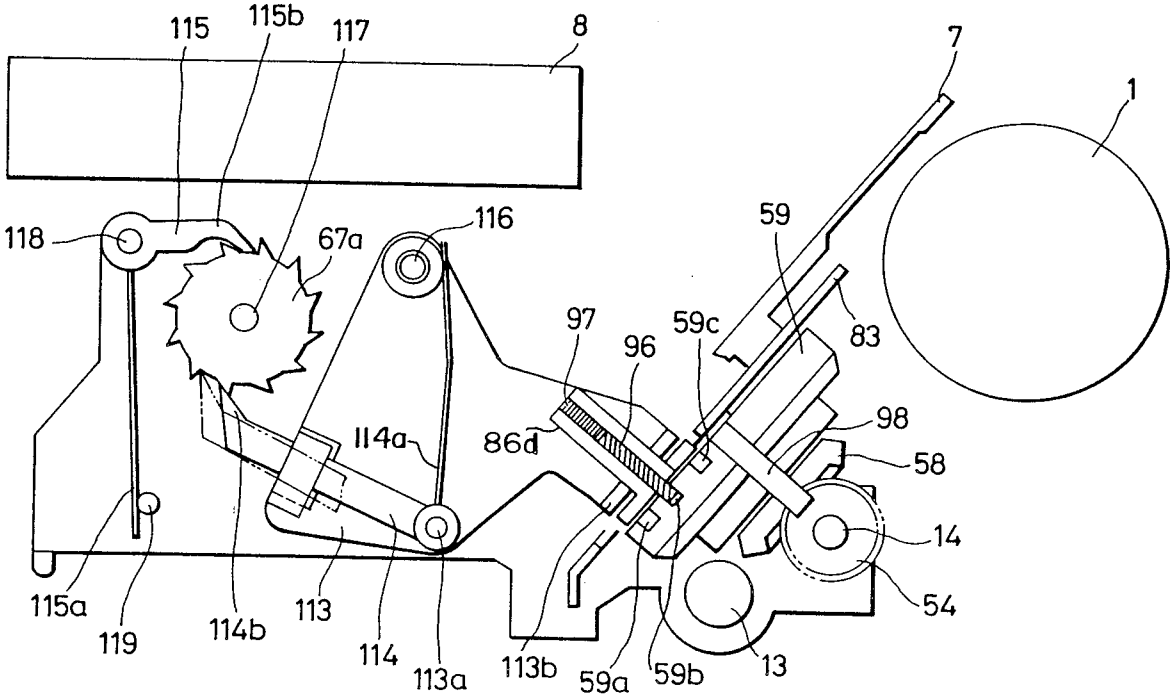
FIG. 15 is a mechanical cross sectional view for control of the height of a ribbon guide.

FIG. 15 shows a cross sectional view of a mechanism to control the heights of ribbon guides 65 and 66. The rotary cam 59, which is rotatable around a cam shaft 98 fastened to the front seat plate 83 as a rotational center, is fundamentally formed with cam grooves 59*a*, 59*b*, and 59*c* at the positions of three different kinds of radial dimensions. On the other hand, a cylindrical projection 86*d* is integrally formed in substantially the central portion of the ribbon blade 86 as shown in FIG. 14. The blade guide pin 96 is slidably inserted into the bore portion of the projection 86*d* against the compression force of a blade pin spring 97. The blade guide pin 96 is led into either one of the cam grooves 59*a*, 59*b*, and 59*c*, so that the ribbon blade 86 is rotated and three kinds of positions as shown in FIGS. 13-1 to 13-3 are provided. Namely, when the pin 96 is led into the cam groove 59*a* , the state of FIG. 13-1 is obtained. When the pin 96 is led into the cam groove 59*b*, the state of FIG. 13-2 is obtained. When the pin 96 is led into the cam groove 59*c*, the state of FIG. 13-3 is obtained.

Structure of the cam

Figure 16B:
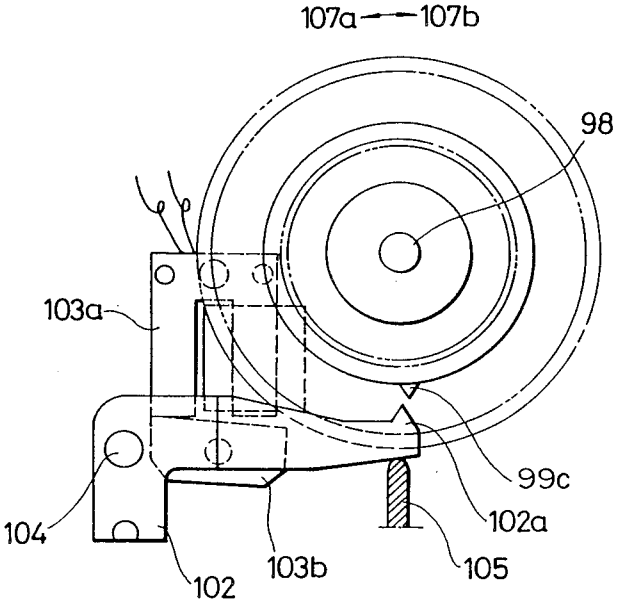
FIGS. 16A and 16B are side and front views, respectively, of a structural diagram of a cam.
Figure 16A:
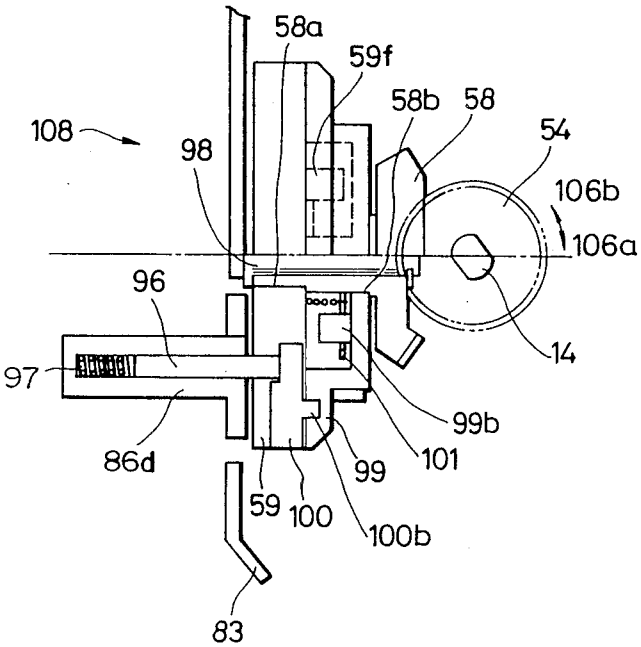
Figure 17:
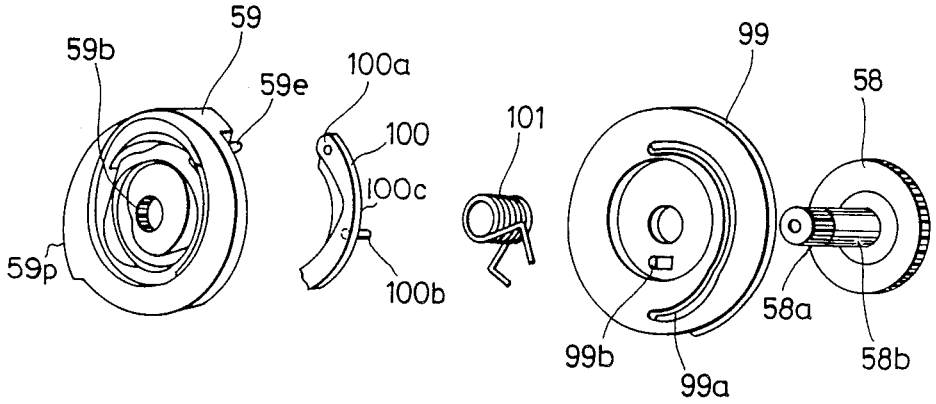
FIG. 17 is an exploded explanatory diagram of the cam.

FIGS. 16A and 16B show a structure of the cam system. FIG. 17 shows an exploded explanatory diagram of the cam system. The cam bevel gear 58 and the rotary cam 59 (refer to FIGS. 10 and 15), which engage the slide bevel gear 54 and rotate around the cam shaft 98, both rotate at an engagement portion 58*a* and move integrally. Engagement portion 58*a* is attached to cam bevel gear 58 by shaft 58*b*. The engagement portions 58*a* and 59*b* are formed with serrations. A shaft portion 59*e* is projected from the opposite surface of the cam grooves 59*a*, 59*b*, 59*c* of the rotary cam 59. A hole 100*a* of a cam element 100, which is rotatable around the shaft portion 59*e* as a rotational center, is inserted therein. An shaft portion 100*b* is projected from the surface 100 *c* on the side opposite to the rotary cam 59 and inserted into a cam groove portion 99*a* of a shift cam 99. The shift cam 99 is rotatably inserted and assembled onto a cam bevel gear shaft portion 58*b* so as to be sandwiched between the rotary cam 59 and the cam bevel gear 58. In this case, a shift cam return spring 101 is retained on a shift cam projection 99*b* and a rotary cam projection 59*f* and arranged so as to be wrapped around the cam bevel gear shaft portion 58*b*. The shift cam 99 is applied with a clockwise rotational force due to the shift cam return spring 101 in the case where the rotating direction is considered from the side of the cam bevel gear 58. The shift cam 99 is stopped and fixed due to the abutment of the projections 99*b* and 59*f*. Housing 86*a* houses blade guide pin 96. (The details will be explained hereinafter.)

A trigger lever shaft 104 is fastened at a location near the rotary cam 59. A trigger lever 102 is rotatably arranged around the shaft 104 and further fixed so as to move integrally with a trigger solenoid chip 103*b* near it. When a current is supplied to a trigger solenoid 103*a*, the trigger solenoid chip 103*b* is lifted up due to the electromagnetic attraction force. In association with this, the trigger lever 102 also rotates counterclockwise and an edge portion 102*a* of the trigger lever moves to the position where it engages a shift cam claw portion 99*c*. On the other hand, when the current supply is stopped, the trigger solenoid chip 103*b* is removed, so that the lever 102 also falls and abuts on a stopper 105 thereby resting in a position so as not to engage the shift cam claw portion 99*c*.

Cam operation

The actual motion and operation of the cam system will now then be described.

Print state

Figures 1, 18:
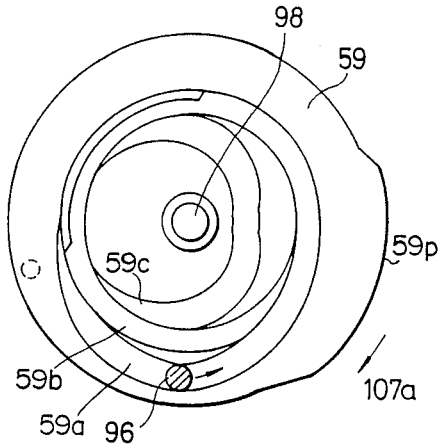
Figures 2, 18:
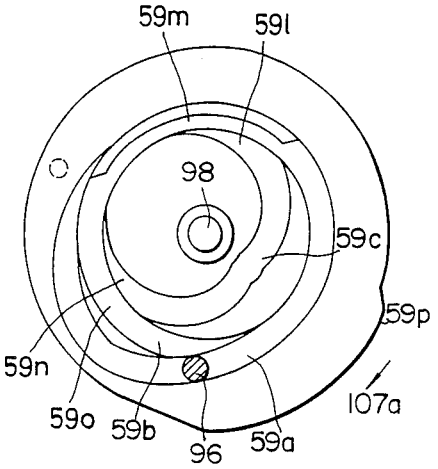
Figures 3, 18:
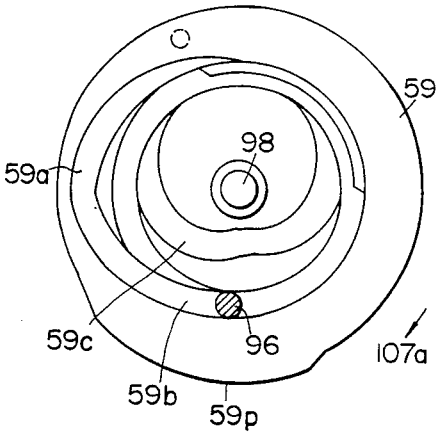
Figures 4, 18:
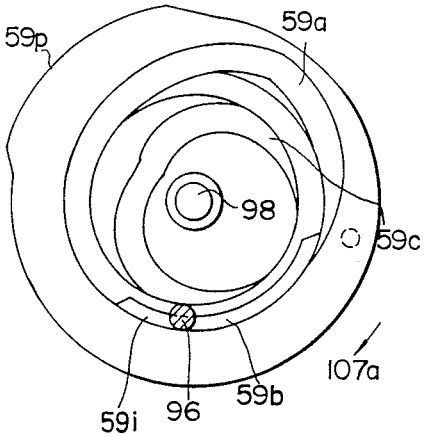
Figures 5, 18:
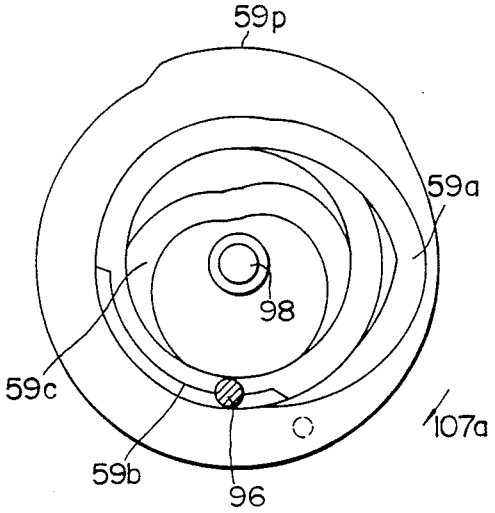
Figures 6, 18:
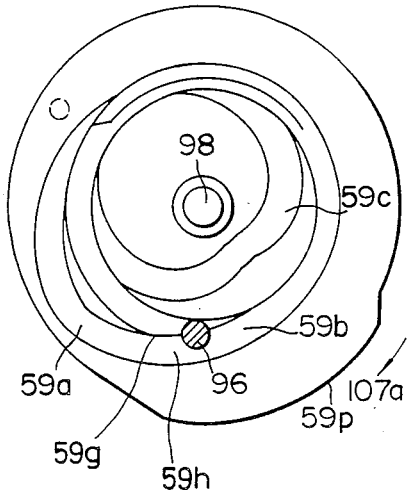
Figures 7, 18:
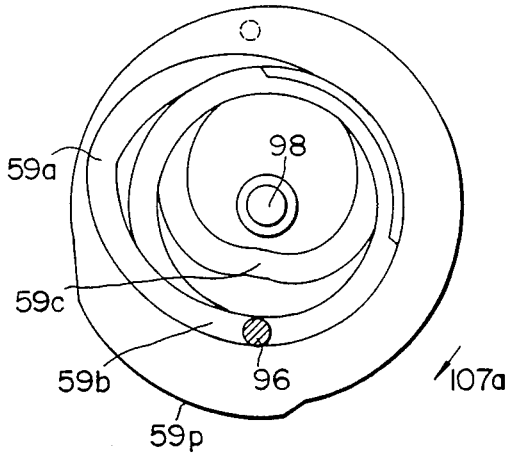

When the control rod 14 rotates in the direction indicated by an arrow 106*a* (refer to FIGS. 16A and 16B; the same direction as the rotating direction indicated by the arrow 78*a* in FIG. 11), the cam bevel gear 58 and rotary cam 59 rotate in the direction indicated by an arrow 107*a*. Since the trigger lever 102 is disposed at the downward position, the shift cam 99 also rotates relatively in the same manner as the rotary cam 59 with the projections 99*b* and 59*f* abutted. This process is shown in sequence diagrams of FIGS. 18-1 to 18-7. These diagrams show the situations when the cam system is seen in the direction indicated by an arrow 108 (FIGS. 16A and 16B) and the cam grooves can be seen. FIG. 18-1 shows the state in which the blade guide pin 96 exists at the position of the cam groove 59*a* in FIG. 15 and corresponds to the state of FIG. 13-1. when the rotary cam 59 rotates in the direction of the arrow 107*a* from this state, the radius of cam groove 59*a* decreases as shown in FIGS. 18-1 to 18-3. In association with this, the blade guide pin 96 rises and reaches the position of the cam groove 59*b* in FIG. 15. This state corresponds to the print state of FIGS. 13-2A and 13-2B. When the cam 59 further continuously rotates in the direction of the arrow 107*a*, the height position of the blade guide pin 96 doesn't change since the radius of the cam groove doesn't change. This is because after the ribbon rose to the middle position, namely, the ordinary printing position when considering the lowest position (in the state of FIG. 18-1), this printing position is held. In addition, since the portion indicated by a numeral 59*i* is the hole for action of the cam element 100, the above motion is not influenced at all. The portion at 59*g* in FIG. 18-6 is relatively higher than the portion at 59*h* in the vertical direction of the Figure, so that the overall loop is inclined in the vertical direction of the Figure. However, the blade guide pin 96 is applied with the rotational force by the blade pin spring 97, so that the pin 96 moves in contact with the inclined surface at any time. Thus, when the cam 59 continuously rotates in the direction of the arrow 107*a*, the height of ribbon of FIGS. 13-2A and 13-2B is always maintained and at the same time, the control rod 14 rotates in the direction of the arrow 78*a*. Consequently, the ink ribbon 9 has been taken up and the apparatus is in the continuous printing mode as mentioned above. Even in the continuous printing mode, the control rod 14 stops rotating to stop the ribbon feed when the type wheel 7 is hit by the hammer 10. The timings in this case will be explained hereinafter.

The portion at 59*l* is higher than the portion at 59*m* and the portion at 59*n* is higher than the portion at 59*o* in the vertical direction of the FIG. 18-6, respectively.

Standby mode

Figures 1, 19:
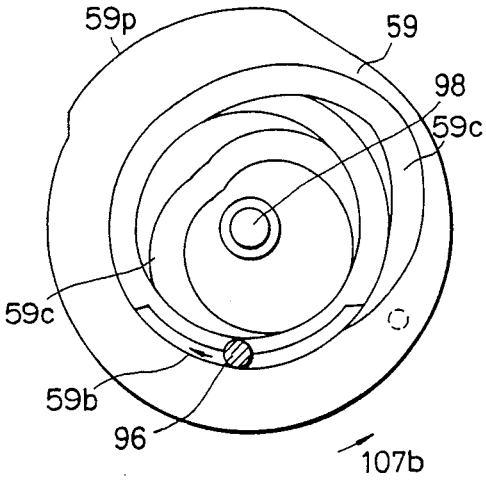
Figures 2, 19:
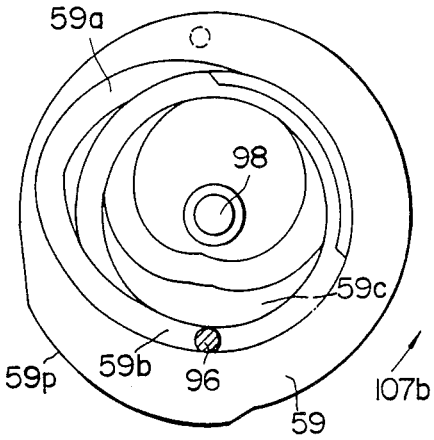
Figures 3, 19:
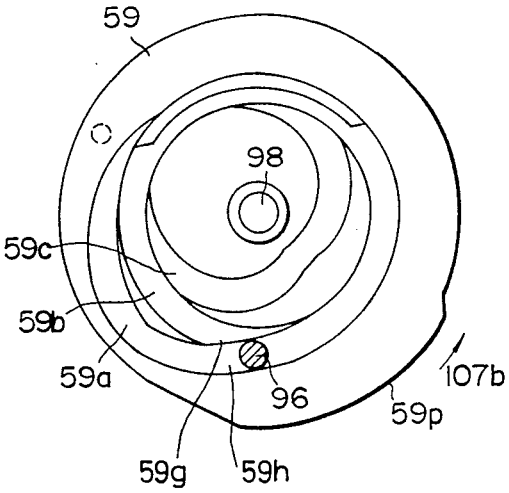
Figures 4, 19:
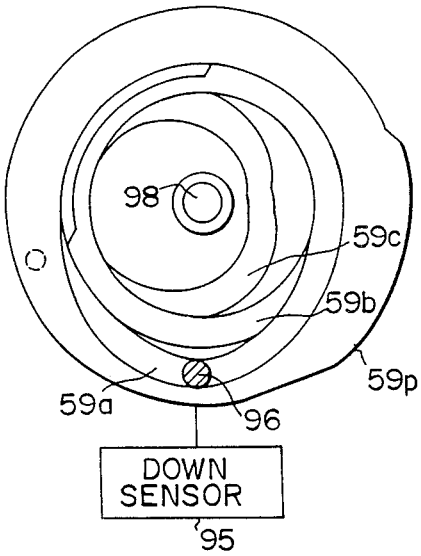

FIGS. 19-1 to 19-4 show sequence diagrams of the process when the apparatus shifts from the printing state to the standby mode. When the control rod 14 rotates in the direction indicated by an arrow 106*b* (refer to FIG. 16A; the same direction as the rotating direction indicated by the arrow 78*b* in FIG. 11) from the printing state (in which the blade guide pin 96 is led into the cam groove 59*b*; refer to FIG. 13-2), the rotary cam 59 rotates in the direction indicated by an arrow 107*b*. Thus, as shown in FIGS. 19-1 and 19-2, the pin 96 slides along the groove of the same radius. When the cam 59 further rotates, the pin 96 is led into the cam groove so that the radius increases as shown in FIG. 19-3 since the portion 59*g* is higher than the portion 59*h* in the vertical direction of the paper as mentioned above. Then, as shown in FIG. 19-4, the pin falls to the position of the cam groove 59*a* and advances to the position where the rotational radius is large, so that the apparatus becomes the standby mode in FIGS. 14 and 13-1.

At this time, since the control rod 14 rotates in the direction of the arrow 78*b*, the ink ribbon 9 is not taken up as mentioned above. Therefore, the ink ribbon 9 is not advanced unused.

Figure 20:
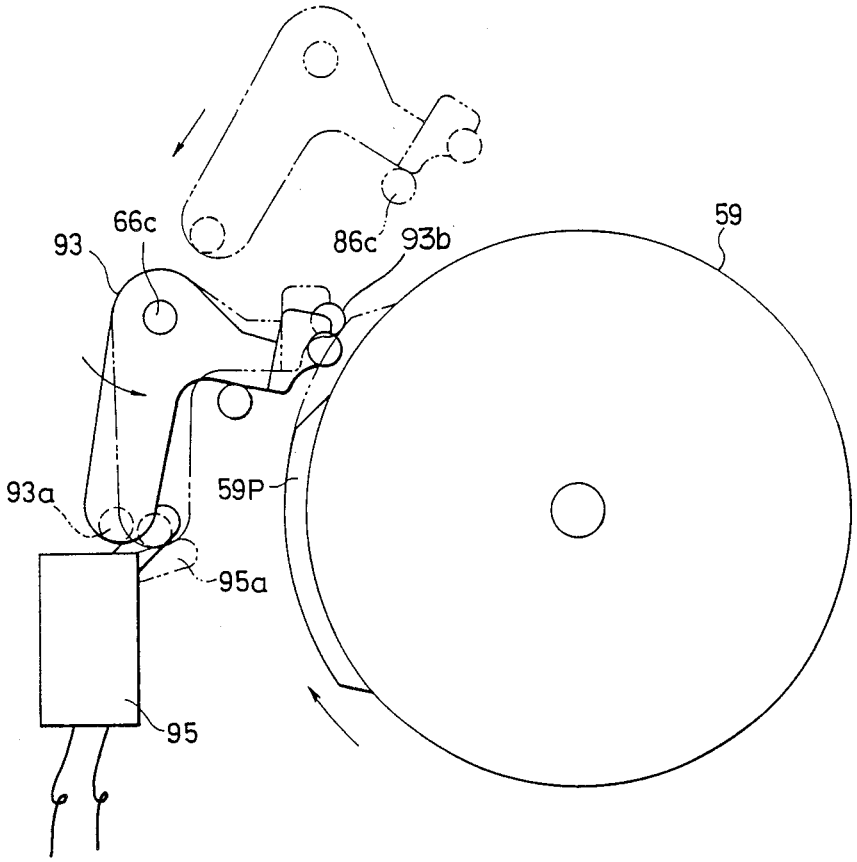
FIG. 20 is a detailed diagram of a detecting mechanism of a down sensor.

FIG. 20 shows a detailed diagram of a mechanism to detect the state at the lowest position (standby mode). When the ribbon guide 66 descends to the lowest position, a convex portion 59*p* of the outer peripheral portion of the rotary cam 59 acts on a boss portion 93*b* of the down sensor chip 93, thereby allowing, the sensor chip 93 to be rotated counterclockwise. A boss portion 93*a* presses the contact lever 95*a* of the down sensor 95 to turn on down sensor 95. In this manner, the lowest position can be accurately detected. The down sensor 95 is turned on in the lowest state of FIG. 19-4, so that the feed motor 19 is stopped to stop a series of operations.

The references of the motion of the cam system all correspond to the lowest state in which a high level signal (ON signal) is generated from the down sensor 95. The cam system is driven in an open control manner from this state.

Figures 1, 21:
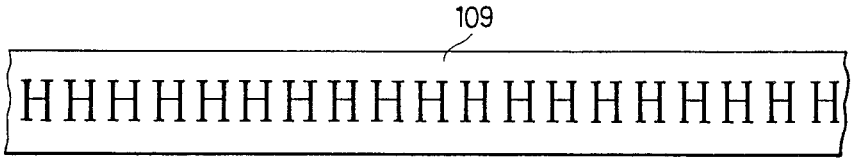
Figures 2, 21:
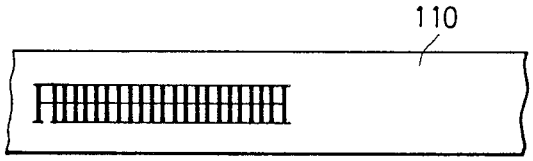
Figures 3, 21:
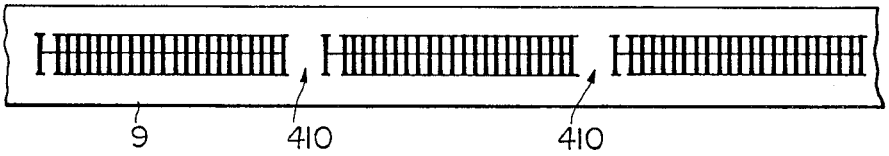

Generally, in typewriters, there are mainly two kinds of methods of feeding the ink ribbon for printing. One method is a type A109 (correctable ribbon, one-time ribbon, or the like) in which the ink ribbon is certainly fed by an amount of the printed characters as shown in FIG. 21-1 and when an overlap occurs, the space is printed. FIGS. 21-1 to 21-3 illustrate the states of the ribbon after completion of the print. FIG. 21-1 shows a correctable one-strike ribbon 109 while FIG. 21-2 shows a multistrike ribbon 110.

The other method relates to the case where it is possible to print on the ribbon a plurality of times as shown in FIG. 21-2 and is a type B110 (multistrike ribbon or the like) in which an amount of ribbon feed is set to a small value and the print on the ribbon is slightly overlappingly performed, thereby increasing the number of repetition times of the print which can be executed per one cassette.

Figures 1, 22:
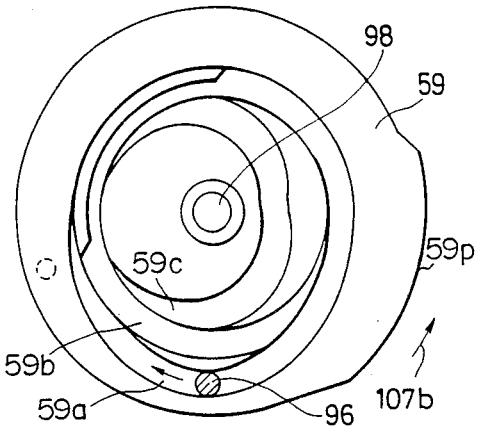
Figures 2, 22:
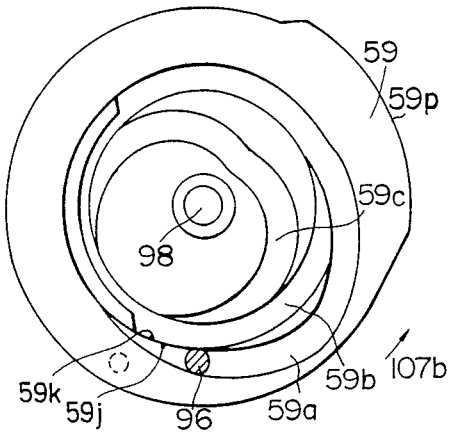
Figures 3, 22:
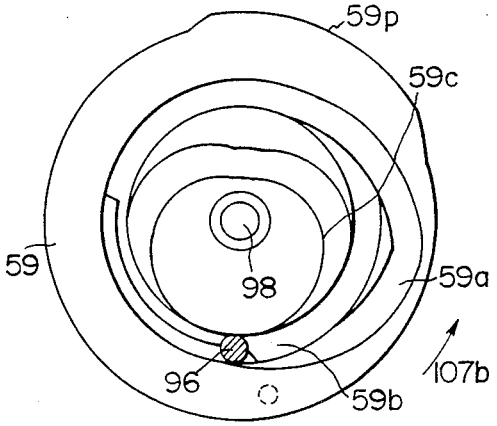
Figures 4, 22:
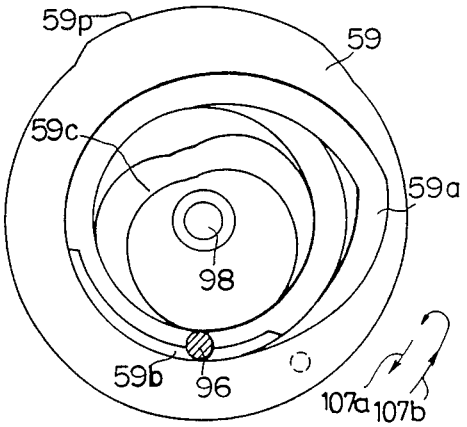
Figures 5, 22:
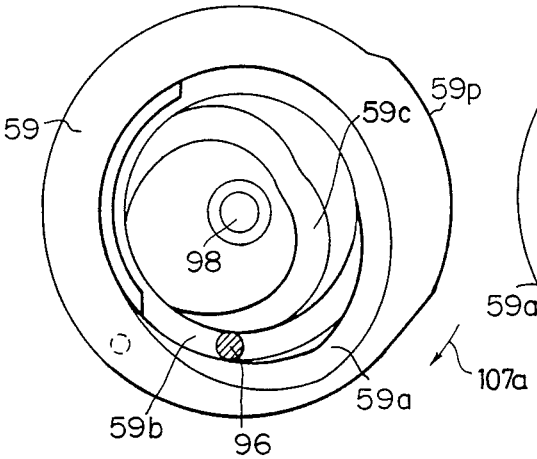
Figures 6, 22:
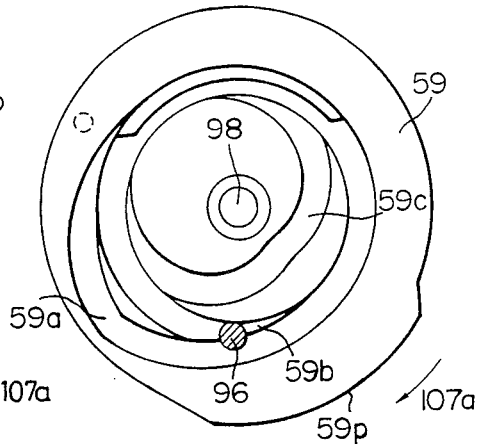

In this apparatus, in the process in which the height of ribbon is changed from the lowest state of FIG. 18-1 to the printing state of FIG. 18-3, there is provided the mechanism having the gear ratio and belt ratio so as to simultaneously feed the ribbon of the type A109 by an amount of one character. The time necessary to raise and take up the ink ribbon 9 when the type A109 ribbon is used is minimized, thereby reducing the printing period of time as short as possible. In this mechanism, in the case of printing by use of the type B110 ribbon, if the print is continuously executed while the ink ribbon is set into the printing state, an amount of ribbon which is used can be reduced by always setting the ribbon feed amount to a proper small amount. However, after the apparatus enters the standby mode by bringing down the ink ribbon during the printing operation, the ink ribbon of the type B110 is fed by one character as much as that in the case where the type A109 ribbon is used according to the sequence of FIGS. 18-1 to 18-7. Consequently, as shown in FIG. 21-3, the large unused feed portion 410 caused to exist between the sets of the characters which were continuously printed. Sequence diagrams to prevent the occurrence of such a phenomenon are shown in FIGS. 22-1 to 22-6. By rotating the rotary cam 59 in the direction of the arrow 107*b* from the lowest position of the ribbon of FIG. 22-1, the blade guide pin 96 can be raised to the height in the printing state. At this time, as mentioned above, the ink ribbon 9 is not taken up and the rotating direction of the rotary cam 59 is inverted to the direction of the arrow 107*a* from the state of FIG. 22-4 in which the blade guide pin 96 is certainly led to the height in the printing state. In this case, since the portion at 59*j* is relatively higher than the portion at 59*k* in the vertical direction of the paper, the guide pin 96 is led as shown in FIG. 22-5. By simultaneously feeding a necessary amount of ribbon, the continuous printing state is held similarly to the case of FIGS. 18-1 to 18-7, so that the ribbon feed system which doesn't cause the unused feed portion 410 is realized. A sensor 412 or the like may be used to discriminate which one of the type A109 (FIG. 21-1) ribbon and the type B110 (FIG. 21-2) ribbon is used as shown in FIG. 54. Or, the user may instruct the type of ribbon which is to be used by operating the keyboard 5.

Correcting state

Figures 1, 2, 3, 23:
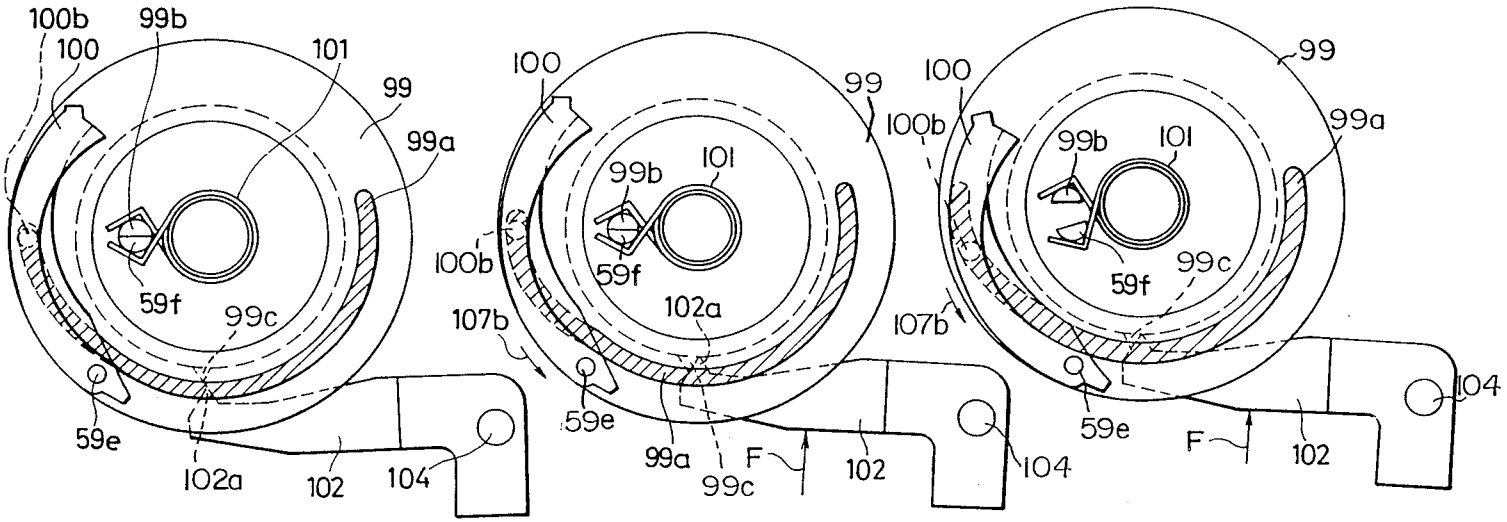
Figures 4, 23:
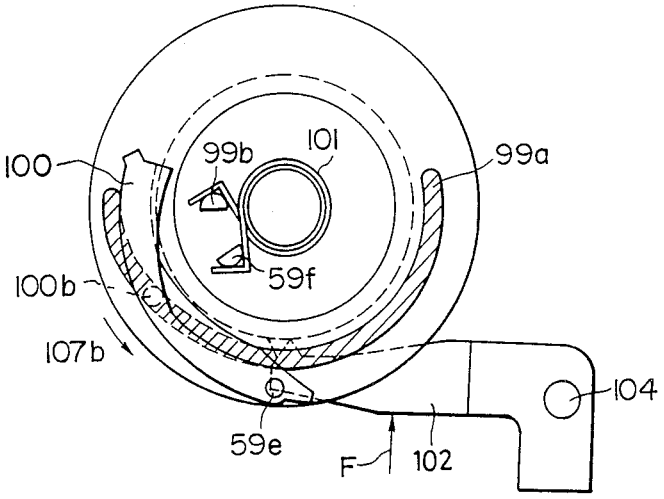
Figures 5, 23:
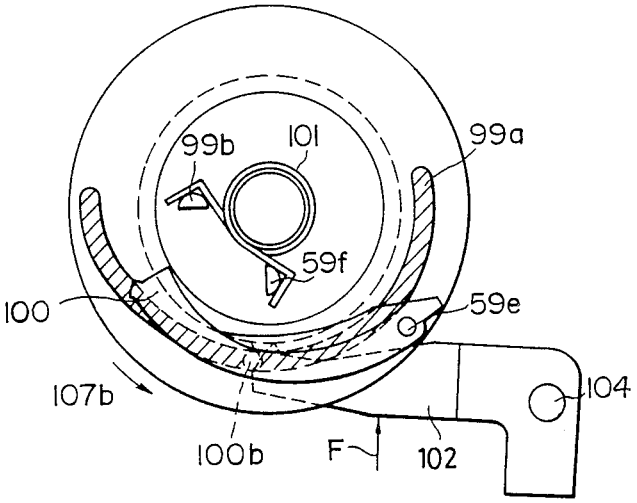
Figures 6, 23:
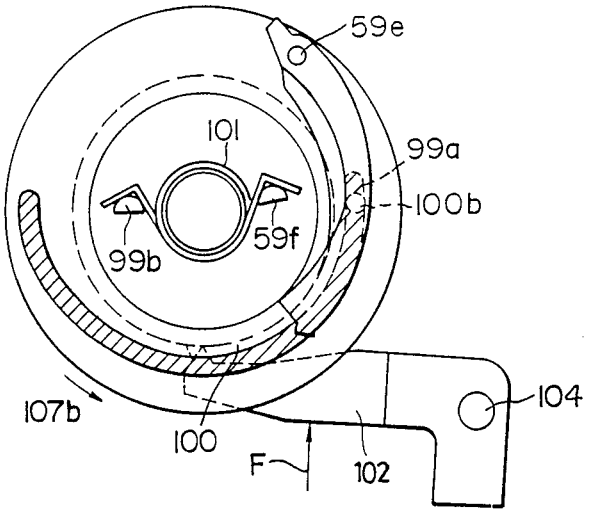
Figures 7, 23:
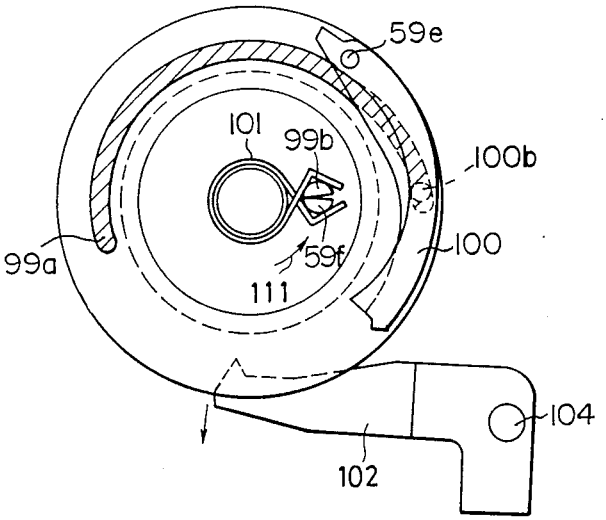

An explanation will then be made with respect to the process in which the blade guide pin 96 is led into the cam groove 59*c* shown in FIG. 15 and the apparatus enters the correcting state of FIG. 13-3. FIGS. 23-1 to 23-7 are sequence diagrams showing the motions of the shift cam 99, cam element 100, shift cam return spring 101, and trigger lever 102 in the case where the rotary cam 59 is seen from the direction indicated by the arrow 108 in FIG. 16A. When the trigger solenoid 103 is energized as mentioned above from the state of FIG. 23-1 corresponding to the lowest state of the ribbon 9 of FIG. 13-1, the trigger lever edge portion 102*a* rotates around trigger lever shaft 104 and engages shift cam claw portion 99*c* (FIG. 23-2). Shift cam return spring 101 is retained on shift cam projection 99*b*, thereby biasing shift cam 99, which is stopped due to the abutment of projection 99*b* and rotary cam projection 59*f*. In addition, shaft portion 100*b* is inserted into cam groove portion 99*a* of shift cam 99. Thereafter, by rotating the control rod 14 in the direction of the arrow 106*b* (78*b*) to rotate the rotary cam 59 in the direction of the arrow 107*b*, the shaft portion 59*e* as a part of the rotary cam 59, the projection 59*f*, and the cam element 100 which is rotatably come into engagement with the shaft portion 59*e* start moving in the direction of the arrow 107*b* as shown in FIG. 23-2. However, the shift cam 99 cannot rotate in the direction of the arrow 107*b* due to the trigger lever 102, so that it stops. Therefore, the cam 59, i.e., the projection 59*f* in FIG. 23 rotates against the torque of the shift cam return spring 101 (FIG. 23-3). In association with this rotation, the position corresponding to the cam groove 99*a* of the point shaft portion 100*b* which engages the cam groove 99*a* also changes. The edge portion of the cam element 100 moves so as to approach the rotational center of the rotary cam 59 (FIG. 23-5) due to the shape of the cam. This state is held (FIG. 23-6). The trigger solenoid 103*a* is deenergized in the state of FIG. 23-6 to release the trigger lever 102. Thus, the shift cam 99 instantaneously rotates in the direction indicated by an arrow 111 in FIG. 23-7 due to the charging force of the return spring 101 until the projection 99*b* abuts on the projection 59*f*. In association with this rotation, the point shaft 100*b* also moves along the cam groove 99*a* in a opposite to the above case. The edge portion the cam element 100 also moves in the direction so as away from the rotational center of the rotary c and is returned to the initial state (FIG. 23-7).

Figures 1, 24:
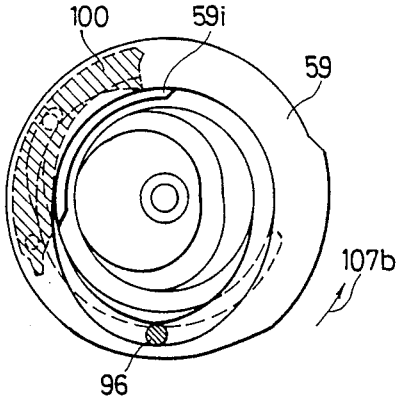
Figures 2, 24:
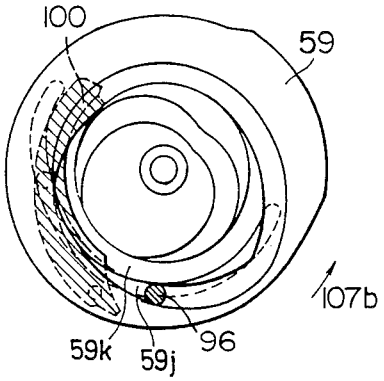
Figures 3, 24:
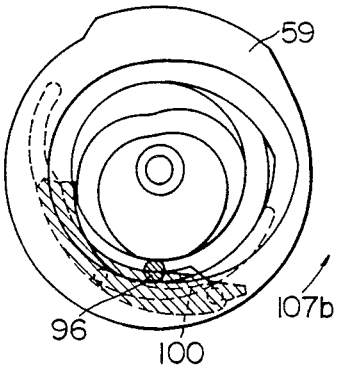
Figures 4, 24:
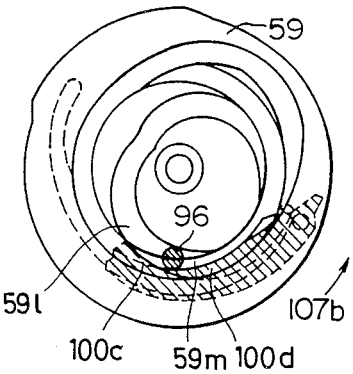
Figures 5, 24:
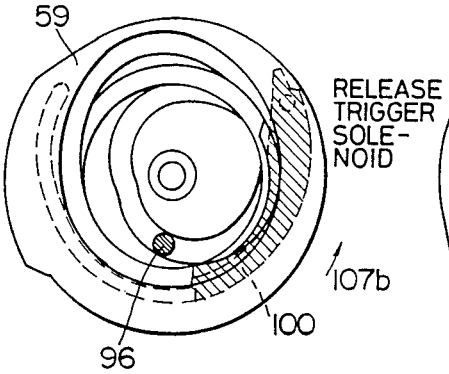
Figures 6, 24:
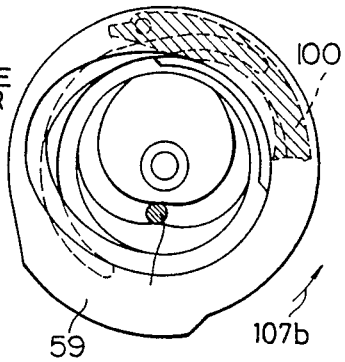
Figures 7, 24:
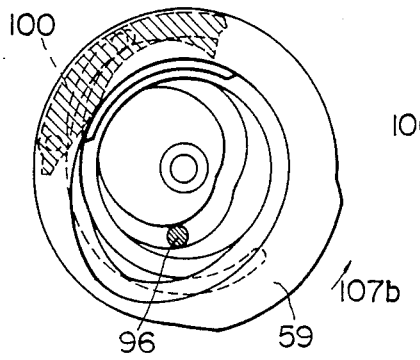
Figures 8, 24:
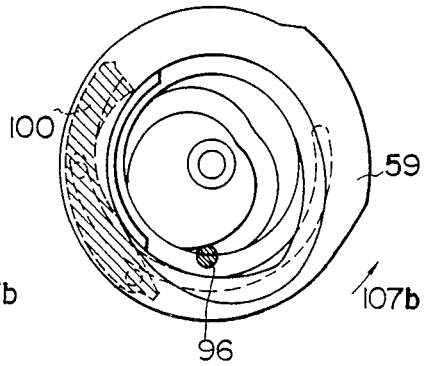
Figures 9, 24:
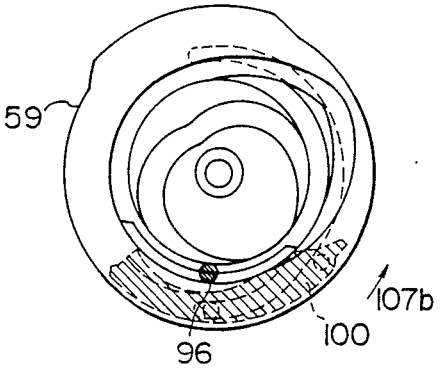
Figures 10, 24:
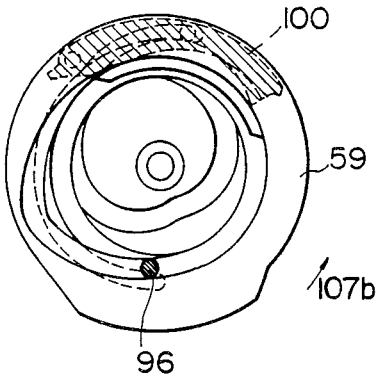
Figures 11, 24:
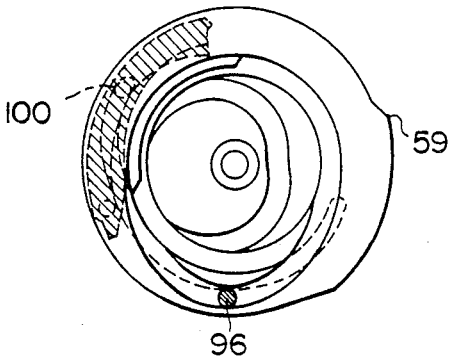

FIGS. 24-1 to 24-11 are sequence diagrams showing the synthesized of the motions of the cam element 100 and rotary cam 59. As mentioned above, the trigger lever 102 is lifted up from the lowest state (FIG. 24-1) and the rotary cam 59 starts rotating in the direction of the arrow 107*b*. In FIGS. 24-2 and 24-3, the cam element 100 projects from the hole 59*i* of the rotary cam 59 due to the action of the shift cam 99. In FIG. 24-4, the heights of the respective portions 100*c*, 100*d*, 59*l*, and 59*m* in the vertical direction of the paper are such that 100*c*>100*d*>59*l*>59*m*. Thus, the guide pin 96 is led in the direction of the cam groove 59*l*. When the cam further continuously rotates and becomes the state of FIG. 24-6, the pin 96 is located in the cam groove 59*c* in FIG. 15. This position corresponds to the state of FIG. 13-3. By stopping the rotation at this position and hitting the type wheel by the hammer 10, the printed character is corrected. The timing relation between the motions of the cam element 100 and shift cam 99 shown in FIGS. 23-1 to 23-7 is such that the operation to release the trigger lever 102 (FIG. 23-7) is inserted between the state of FIG. 24-5 and the state of FIG. 24-6. After completion of the correction print, the rotary cam 59 is further continuously rotated in the direction of the arrow 107*b* and the guide pin 96 is led as shown in FIGS. 24-7 to 24-9. The pin then descends. Thereafter, the pin is moved along the same route as shown in FIGS. 19-1 to 19-4 and returned to the standby position of FIG. 24-11. At this time, the rotation is stopped and the sequence is completed. In this case, since the rotary cam 59 rotates in the direction of the arrow 107*b*, the control rod 14 rotates in of the arrow 106*b* (78*b*). Thus, the ink ribbon 9 is not taken up and unnecessary ribbon feed is not performed.

The sequence for the correction printing. operation is executed one character by character irrespective of the continuous correction printing mode or the single correction printing mode. The operation timings in this case will be explained hereinafter.

Hammer hitting for correction print

The operation in the case of the hammer hitting for the correction print will now be described in detail. The same type as the printed character is brought to the same position as that of the printed character. The correction ribbon is disposed in front of this type. Then, the same type is hit by the hammer to take off the printed character (lift-off) or to cover the white character on the printed character (cover), thereby correcting the printed character. For this correcting operation, high accuracies are required to position the whole carriage 12 and type wheel 7. If these accuracies are bad, the printed character cannot be completely corrected, so that a part of the printed character is left and the typing paper becomes bad-looking. As a means for solving this problem, there has been well-known the means for covering the deviation of position in a manner such that the carriage 12 is finely shifted near the position of a desired character upon correction print and the same type as the printed character is hit by the hammer 10 a plurality of times. In the apparatus of the invention as well, the printed character is corrected by hitting the hammer 10 a total of three positions: namely, the position of the printed character to be corrected and the positions where the carriage 12 is moved to the right and left by an amount of 1/240 inch from the position of the character to be corrected. By repeating the sequence to lift up the correction ribbon three times, the correcting time and an amount of correction ribbon 11 which is consumed increase. (The correction ribbon take-up mechanism will be described hereinafter.) On the other hand, even if the hammer hitting operation is executed three times without feeding the correction ribbon as well, the printed character can be corrected. The means for realizing this method is already known. However, the position of the type and the relative position of the correction ribbon do not change in three hammer hitting operations, so that only the same position on the correction ribbon 11 is used. Therefore, the correction ribbon 11 is not effectively used.

Figure 25:
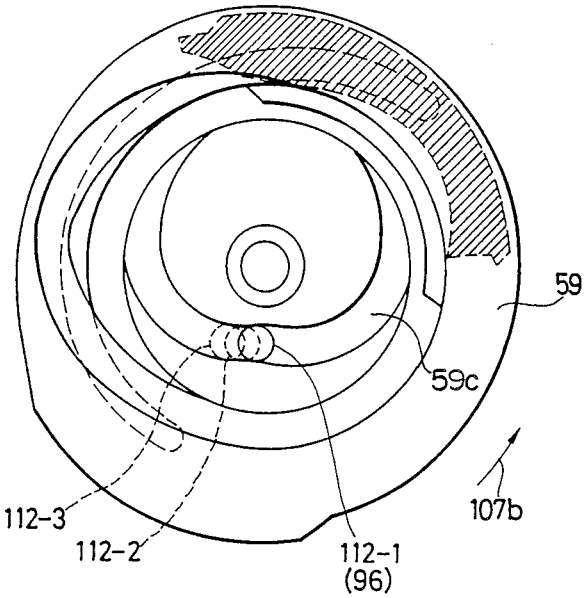
FIGS. 25 and 26 are explanatory diagrams showing in detail the correction printing operation.
Figure 26:
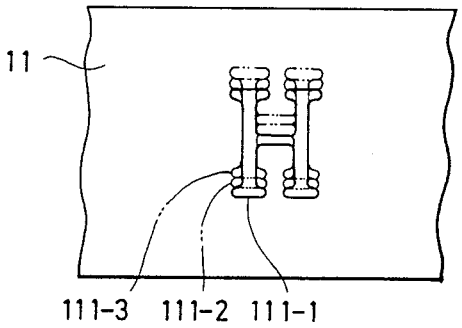

A method of embodying the apparatus of the invention in consideration of the above-mentioned point will be described hereinbelow. FIG. 25 is an explanatory diagram showing the state which is equivalent to the state of FIG. 24-6. The guide pin 96 is led into the cam groove 59*c* in the correcting state. By hitting the hammer for correction at a position 112-1, the printed character portion is taken off at a position 111-1 in FIG. 26 showing the correction ribbon 11. Thereafter, when the rotaty cam 59 rotates by a fine angle in the direction of the arrow 107*b* and the guide pin 96 comes to a position 112-2, the rotation is stopped. At this time, the guide pin 96 descends by a fine distance due to the shape of the cam groove, so that the correction ribbon 11 also falls by a fine amount from the printing position. Therefore, by hitting the hammer for correction at this position, the remaining printed character portion which could not be corrected by the first correction operation is taken off in the new region on the correction ribbon 11 at a position (111-2) which is slightly higher than the position of the region used by rotary cam 59 rotates by a fine angle in the direction of the arrow 107*b* and the blade guide pin 96 comes to a position 112-3, the operation similar to the above is carried out. Thus, the remaining portion of the printed character comes to a position 111-3 on the correction ribbon and the further new region of the correction ribbon 11 can be used to correct the remaining character portion which could not be corrected.

As mentioned above, the position of the carriage 12 is also shifted in the hammer hitting operations of three times. By together executing the shifting operations of the positions of the correction ribbon 11 and carriage 12, the better correcting quality can be obtained.

Correction ribbon take-up mechanism

Figure 27:
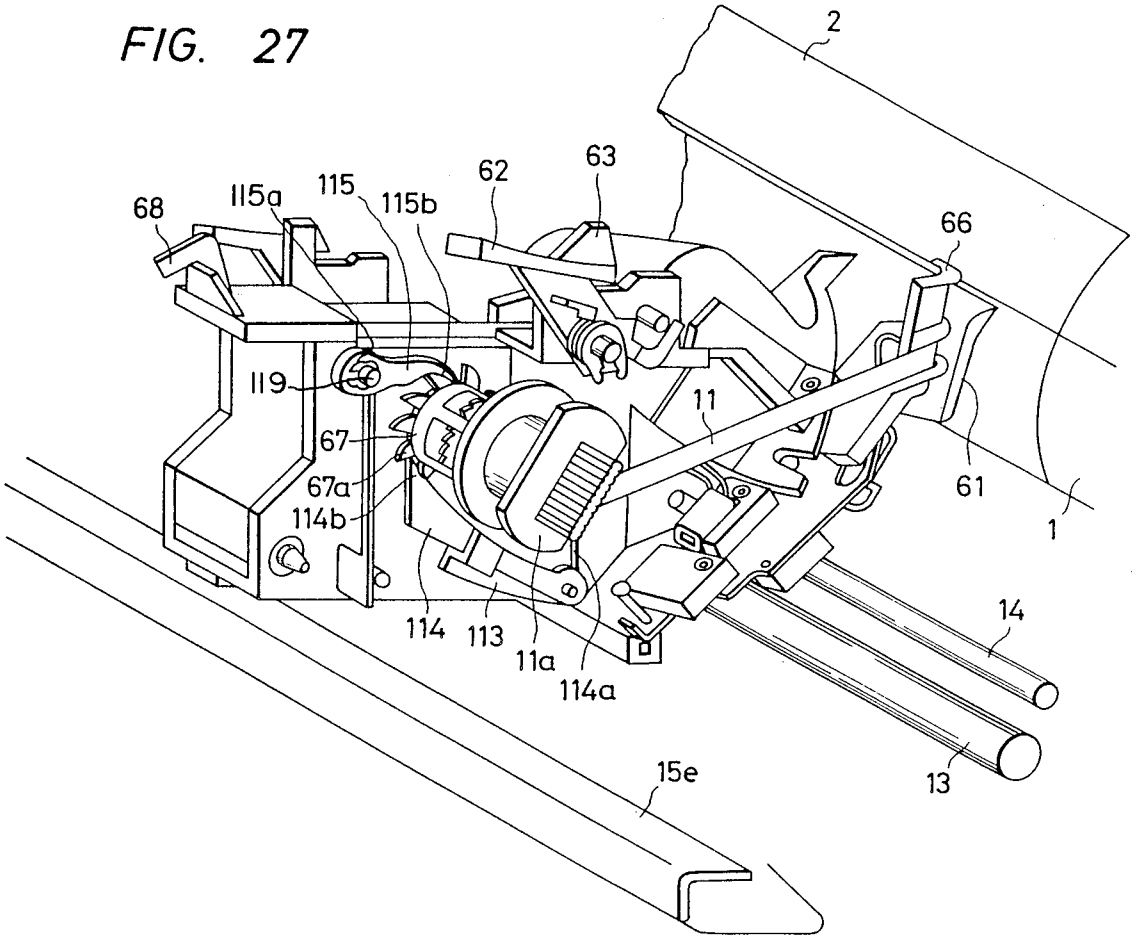
FIG. 27 is a perspective view of a correction ribbon take-up mechanism.

FIG. 27 shows a perspective view showing the take-up mechanism of the correction ribbon 11 in the case where the carriage 12 is seen from the opposite side of FIG. 9. In FIG. 27, the correction ribbon 11 passes through the ribbon guide 66 on the side of the platen 1 and is wrapped around a take-up core 11*a*. The take-up core 11*a* is detachably supported on the take-up spool 67. A claw portion 67*a* is formed in the outer peripheral portion of the take-up spool 67. The take-up spool 67 rotates due to the actions of a ratchet 114 and a pawl 115 to prevent the reverse rotation, thereby allowing the correction ribbon 11 to be fed. The feed mechanism will now be described in detail with reference to FIG. 15. The feed mechanism comprises: the take-up spool 67 rotatably attached to a take-up shaft 117 fixed to the carriage 12; a correction lever 113 rotatably attached to an shaft 116, as a rotational central shaft, fixed to the carriage 12; the ratchet 114 rotatably mounted on a shaft portion 113*a* projected from the correction lever 113; and the pawl 115 rotatably attached to a shaft portion 118 fixed to the carriage 12. Correction lever 113 is a third feed mechanism for feeding the correction ribbon 11. A correction lever edge portion 113*b* is mounted on the projection 86*d* of the ribbon blade 86. The correction lever 113 also rotates in association with the motion of the projection 86*d*. The ratchet 114 has a portion 114*a*, by which a clockwise rotational force is applied to a ratchet edge portion 114*b* of the ratchet 114 such that the edge portion 114*b* abuts on the take-up spool claw portion 67A. Further, the pawl 115 also has a beard edge portion 115*b*. The edge portion 115*b* is retained on a shaft portion 119 fixed against the carriage 12, by which a clockwise rotational force is applied to a pawl edge portion 115*b* of the pawl 115 such that the edge portion 115*b* abuts on the take-up spool claw portion 67*a*.

In the above-mentioned mechanism, in the case where the blade guide pin 96 reciprocates between the cam grooves 59*a* and 59*b*, namely, in the ordinary printing mode in which the ribbon height repeatedly changes between the standby and printing states, the ratchet edge portion 114*b* moves between two positions, one shown in solid lines and the other shown by an alternate long and two short dashes line as illustrated in FIG. 15. Thus, the ratchet 114 doesn't act on the claw portion 67*a* of the take-up spool 67 and the correction ribbon is not taken up.

Ascent and descent of the correction ribbon

Figures 1, 28:
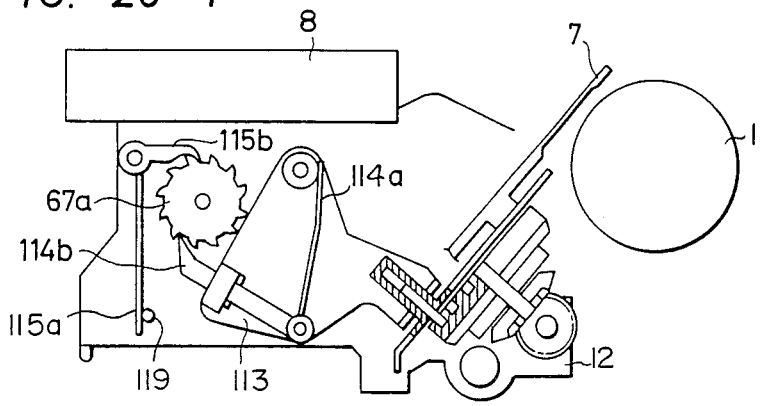
Figures 2, 28:
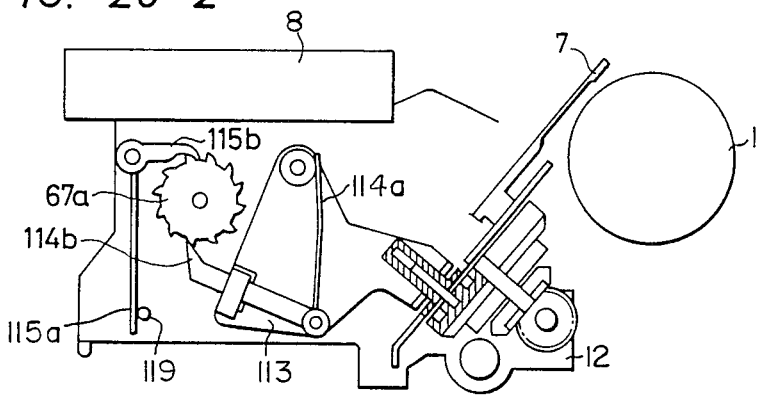
Figures 3, 28:
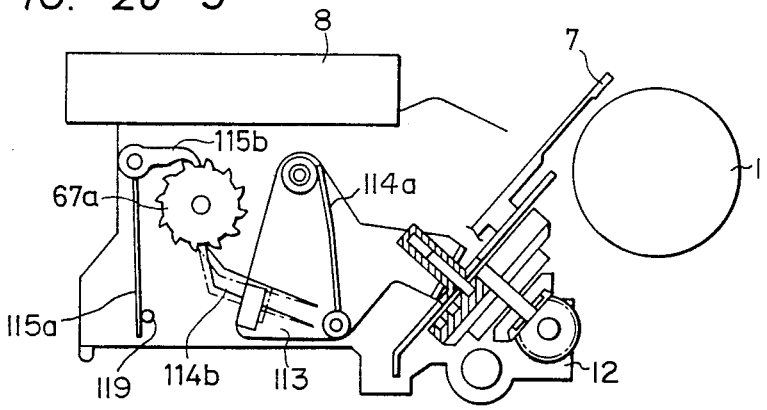

FIGS. 28-1 to 28-3 are sequence diagrams showing the motions of the ribbon blade 86 and correction lever 113 when the correction ribbon is lifted up to the position adapted to perform the correction print. When the correction ribbon passes through the ribbon position (FIG. 28-2) in the printing state from the standby state (FIG. 28-1) and reaches the correcting state (FIG. 28-3), the ratchet edge portion 114*b* lies on the take-up spool claw portion 67*a*. In the process to bring down the correction ribbon to the lowest position in the standby state, the take-up spool 67 is rotated clockwise. In this state (FIG. 28-1), the pawl edge portion 115*b* lies on the take-up spool claw portion 67*a*. Thus, the rotation as much as one tooth of the take-up spool claw portion 67*a* is executed, thereby allowing the correction ribbon 11 to be fed by an amount of one character.

Hammer driving system

Figures 30A, 30B:
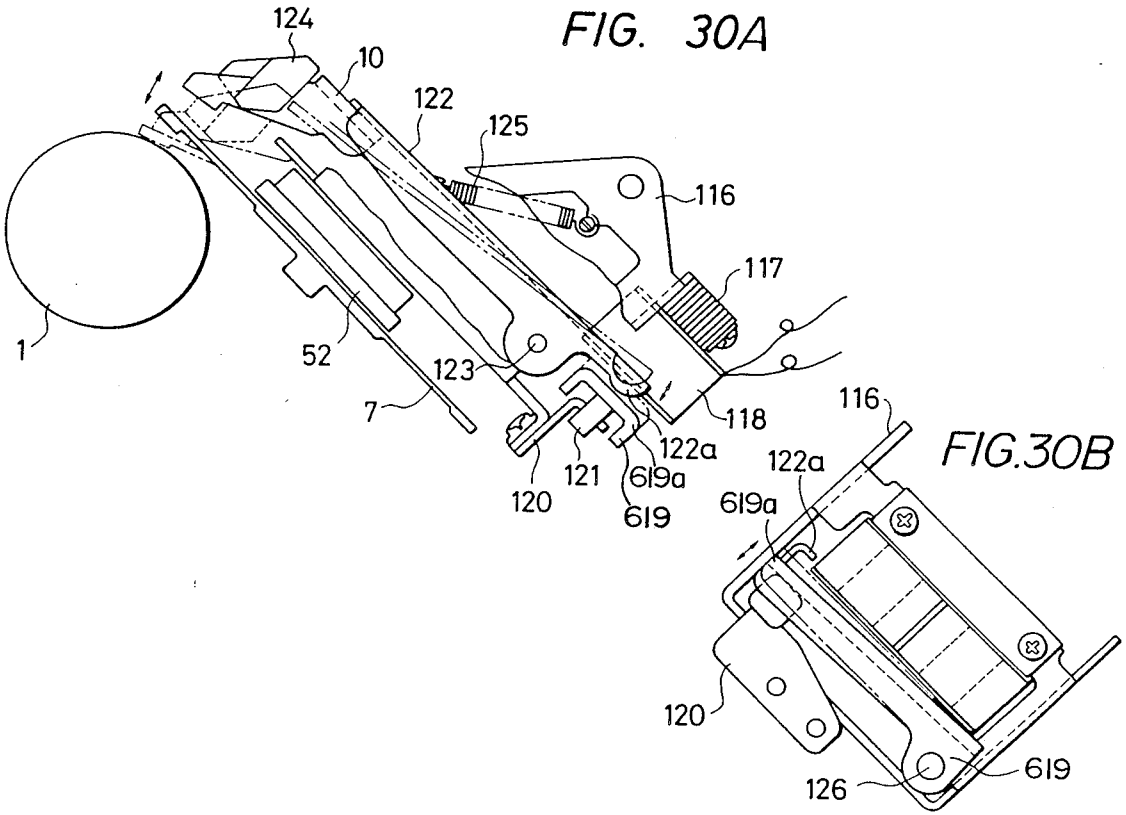
FIGS. 30A and 30B are side and top views, respectively, of a structural diagram of the hammer system.

The system to drive the hammer 10 will now be described in detail. FIG. 29 is a perspective view showing the hammer driving system. FIGS. 30A and 30B show the structure of this system. The whole hammer system is attached to a motor base 116 made of a U-shaped metal plate. Two winding coils 118 are wound around a horseshoe laminated yoke 117. By supplying a current to the coils 118 to energize it, an armature 619 is attracted by the yoke 117 (in the direction indicated by arrows ⟷ in FIG. 29), thereby obtaining the energy. The armature 619 is rotatably inserted onto a shaft 126 rotational central axis, fastened to the motor base 116. On the side opposite to the yoke 117, a rubber stopper 121 is attached to the adjustment plate 120. When the coils 118 are not energized, the armature 619 abuts on the rubber stopper 121 and stops. An armature edge portion 619*a* abuts on an edge portion 122*a* of a hammer lever 122. The hammer lever 122 is rotatably supported on a shaft 123, as a rotational central shaft, fastened to the motor base 116. Thus, when the edge portion 122*a* rotates counterclockwise due to the action of the armature edge portion 119*a*, the hammer lever 122 and the hammer 10 fixed thereto are made operative to hit the type wheel 7 against the tensile force of a hammer return spring 125, thereby allowing a desired character to be printed through the ink ribbon. In this case, to secure a proper hitting energy, a weight 124 having a proper mass is fixed to the hammer 10. When the winding coils 118 are deenergized, the hammer lever 122 rotates clockwise due to the spring force of the hammer return spring 125. The hammer lever edge portion 122*a* presses the armature edge portion 619*a*, so that the armature 619 abuts on the rubber stopper 121 and stops. The attracting force due to the energization varies in dependence on the position of the armature 619 in the stationary state. Therefore, the hitting force of the hammer 10 is controlled by adjusting the fixing position of the adjustment plate 120.

Wheel loading mechanism

The mechanism to load the type wheel 7 will now be described.

Figure 31:
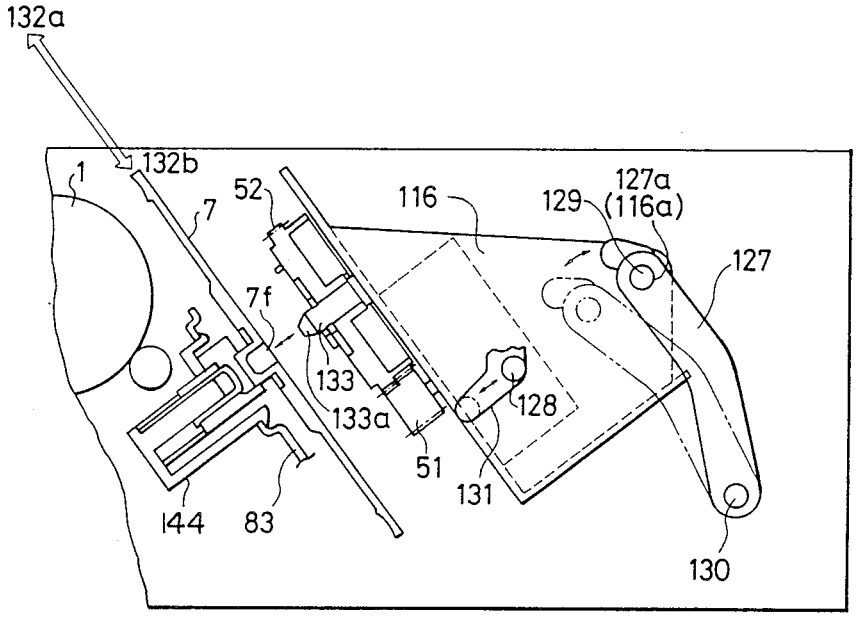
FIG. 31 is a diagram of a whole type wheel loading mechanism.

The outline of the loading mechanism is shown in FIG. 31. The motor base 116 to support the wheel motor 18 and hammer system is positioned at two locations based on two kinds of engagements. Namely, one is the engagement between a shaft 128 fastened to the right and left sides and a longitudinal groove 131 on the main body side of the carriage 12. The other is the engagement between a motor base hole 116*a* and a shaft 129 penetrating an edge portion hole 127*a* of a release lever 127 which is rotatably supported on a shaft 130, as a rotational central shaft, fixed to the carriage main body. On one hand, when the user moves the release lever 127 clockwise around the shaft 130 as a rotational central shaft, the motor base 116 also slides to the right in FIG. 31 together with the shaft 129. The engagement between the type wheel 7 and the driving section 117–127 on the side of the motor base 116 is released, thereby enabling the user to detach the type wheel in the direction indicated by an arrow 132*a*. On the contrary, when the user brings down the type wheel in the direction indicated by an arrow 132*b* in this state and moves the release lever 127 counterclockwise to set the motor base 116, the apparatus enters the printing state. When the motor base 116 is set, a central hole 7*f* of the type wheel 7 is led to a tapered edge portion 133*a* of a wheel shaft 133 fastened to the motor base 116 and finally engages the wheel shaft 133. In this manner, the rotational center of the type wheel 7 is positioned, but the rotational position is not positioned.

Descent and engagement of the wheel

The type wheel loading mechanism will now be described hereinbelow with reference to mechanical diagrams of FIGS. 32-1A, 32-1B, 32-2A, 32-2B. Rectangular projections 52*a*, 52*b*, and 52*c* are formed at three positions on the type wheel contacting surface of the wheel supporting gear 52, which rotates around the wheel shaft 133 as a rotational central shaft such that their dimensions and positions from the center differ, respectively. On the other hand, three rectangular holes (*7a*, *7b*, *7c*) are also formed in the type wheel 7 such that their dimensions and positions from the center differ, respectively. The positions from the center and dimensions of the rectangular projection 52*a* and rectangular hole *7a* are the same, respectively, so that they can be come into engagement with, each other. The same shall apply to the case of projection 52*b* and hole *7b* and the case of projection 52c and hole *7c*. The rectangular projections 52a to 52c and the rectangular holes *7a* to *7c* are formed so as to have the dimensions and shapes such that they cannot engage at the positions other than the rotating position. Namely, the rectangular projections 52a–52c and rectangular holes *7a–7c* are not formed at regular intervals (for every 120°) or they are not formed on the circumference of the same radius. Their engagement dimensions have a high accuracy so that the wheel supporting gear 52 and type wheel 7 can substantially integrally rotate after the engagement.

FIG. 32-1A and 32-1B show the state in which the motor base 116 was set after the type wheel had been loaded. In this state, the positions of the rectangular projections of the wheel supporting gear 52 do not coincide with the positions of the rectangular holes of the type wheel 7, so that the type wheel 7 abuts the top portions of the rectangular projections. The position of the type wheel 7 is shifted to the left in the cross sectional view of FIGS. 32-1A and 32-1B by only an amount of the height of each of the rectangular projections as compared with the type wheel contacting surface of the wheel supporting gear 52.

On the other hand, the front seat plate 83 is disposed on the left side of the type wheel 7. A drop casing 144 is inserted and fixed into the notched hole portion 440 of the plate 83 at the positions of claw portions 144b and 144c. A wheel presser 145 engages an shaft portion 144a formed integrally with the drop casing 144 so as to be movable in the thrust direction. Further, a wheel lock 146 engages the outer peripheral portion of the shaft portion 144a so as to be likewise movable in the thrust direction. A wheel press spring 147 independently acts on the wheel presser 145 and a wheel lock spring 148 independently acts on the wheel lock 146, respectively, thereby allowing the wheel presser 145 and wheel lock 146 to be pressed to the right in the diagram. In addition, the motion in the rotating direction of the wheel lock 146 is restricted (not shown) by the drop casing 144, so that the wheel lock 146 can move in the thrust direction but doesn't rotate. An edge portion 146a of the wheel lock 146 is formed so as to have a ratchet shape as indicated by FIG. 32-2C. On the other hand, the type wheel 7 is also formed with the ratchet *7e* having the shape so as to come into engagement with the ratchet-shaped edge portion 146a. Consequently, in the state of FIGS. 32-1A and 32-1B, those ratchet portions *7e*, 146a come into engagement with each other and the type wheel 7 is held so that it cannot rotate in the direction of an arrow 149. A central convex portion *7d* of the type wheel 7 abuts on the wheel presser 145. The type wheel is always pressed to the right in the diagram by the wheel press spring 147. When the wheel supporting gear 52 is rotated in the direction of the arrow 149 in this state, the rectangular holes *7a* to *7c* coincide with the rectangular projections 52a to 52c while the wheel rotates by an angle of up to 360° C. The wheel is shifted to the right due to the action of the wheel presser 145 and those rectangular holes engage the rectangular projections 52a–52c. This state is shown in FIGS. 32-2A and 32-2B. In this state, the wheel presser 145 abuts on the type wheel central convex portion *7d*. However, the wheel lock edge portion 146a is disengaged from the ratchet *7e* of the type wheel 7 since the wheel lock 146 serves as a stopper (not shown) for inhibiting the movement, to the right from the state of FIGS. 32-1A and 32-1B. The type wheel 7 is freely positioned on the wheel supporting gear 52 and rotates integrally therewith, thereby enabling a desired character to be selected and printed. In the initial operation after the type wheel 7 is loaded, the gear 52 is rotated about twice, i.e., by an angle of about 720° for safety. The type wheel automatic loading can be realized due to the above-mentioned mechanism.

Operation control

The control of the operation of the above-mentioned apparatus will then be described in detail.

FIG. 45-1 is a block diagram of a control circuit. FIG. 45-2 is a diagram showing a detailed constitution of a controller logic circuit 201 in FIG. 45-1.

As already mentioned above, the controller logic circuit 201 comprises the MPU (microprocessing unit) 230, ROM (read only memory) 231, RAM (random access memory) 232, timer 233, and I/O expander circuit 234. Each of these circuits 230–234 is connected by an MPU bus 414. With such a circuit constitution, the MPU 230 executes arithmetic operations and controls in accordance with microinstructions which have preliminarily been stored in the ROM 231. The MPU 230 also receives and transmits the data from and to a keyboard controller circuit 202 and performs the input/output control with a printer controller circuit 418. The D timer 233 generates reference time information, measures the elapsed time or generates an interruption request (INT2) signal in accordance with the control condition of the timer 233, and controls the real time of the controller logic circuit 201 under control of the MPU 230. Programs which are shown in respective control flowcharts, which will be explained hereinafter, are stored in the ROM 231.

In the controller circuit block diagram, a keyboard controller circuit 202 recognizes the operation of the keyboard 5 in a keyboard switch section 203, generates an interrupt request (INT 1) signal, and provides the micro-coded keyboard operation information to the controller logic circuit 201.

In response to the keyboard operation information, the controller logic circuit 201 controls the printer through the I/O circuit 234 in accordance with a predetermined control sequence.

A printer driver power supply (P/S) circuit 204 is the constant voltage power supply circuit which is controlled by a VPE signal (namely, it is turned off when VPE=0; it is turned on when VPE=1) and supplies a driving current of a predetermined voltage to each driver circuit (which will be explained later). The P/S circuit 204 also generates a signal Vpp and monitor signal VBL of this output voltage to the controller logic circuit 201 (VBL=0 when the output voltage is a predetermined level; VBL=1 when it is lower than the predetermined level).

A feed motor driver circuit 205 is a constant current circuit which is controlled by $\overline{FM1}$ to $\overline{FM4}$ signals corresponding respectively to the first to fourth phases of a feed motor 206 and supplies a predetermined driving current necessary to excite the feed motor.

A carrier motor driver circuit 207 is also a constant current circuit which is controlled by $\overline{CM1}$ to $\overline{CM4}$ signals corresponding respectively to the first to fourth phases of a carrier motor 208 and supplies a predetermined driving current necessary to excite the carrier motor. This current is set to two stages by another control signal CMH. (namely, this current is set to a large current value when CMH=0; it is set to a small current value when CMH=1)

The functions of a wheel motor driver circuit 209, a wheel motor 210, and control signals $\overline{WM1}$ and $\overline{WM4}$ WMH are similar to the case of the carrier motor 208.

A hammer solenoid driver circuit 211 is a constant current driver circuit which is controlled by an $\overline{HMR}$ signal (i.e., it is turned off when $\overline{HMR}=1$; it is turned on when $\overline{HMR}=0$) and supplies a predetermined current to a hammer solenoid 212. A clutch solenoid driver circuit 213 is also a constant current driver circuit which is controlled by an FCLT signal (i.e., it is turned on when FCLT=1; it is turned off when FCLT=0) and supplies a predetermined current to a clutch solenoid 214. This current is set to a high level in the case of the initial current supply state (when the clutch solenoid 214 is attracted) and to a low level after completion of the initial current supply (for the period of time when the clutch solenoid 214 is held).

A trigger solenoid driver circuit 215 is controlled by a TSOL signal and controls the attraction and holding current of a trigger solenoid 216 in a manner similar to the clutch solenoid driver circuit 213.

A waveform shaping circuit 217 converts the ON/-OFF state of a left limit switch 218 into a proper voltage level as an input signal LLMT of the controller logic circuit 201.

Waveform shaping circuits 219 an 221 convert the ON/OFF states of ribbon down switch 220 and a wheel index detector, 222 into proper voltage levels as input signals RDWN and WHX of the controller logic circuit 201, respectively. The driver circuits 205, 207, 209, 211, 213, 215 are formed by the foregoing constitution.

Programs to control the operation of the foregoing apparatus by a hardware constitution will now be described.

Figure 33:
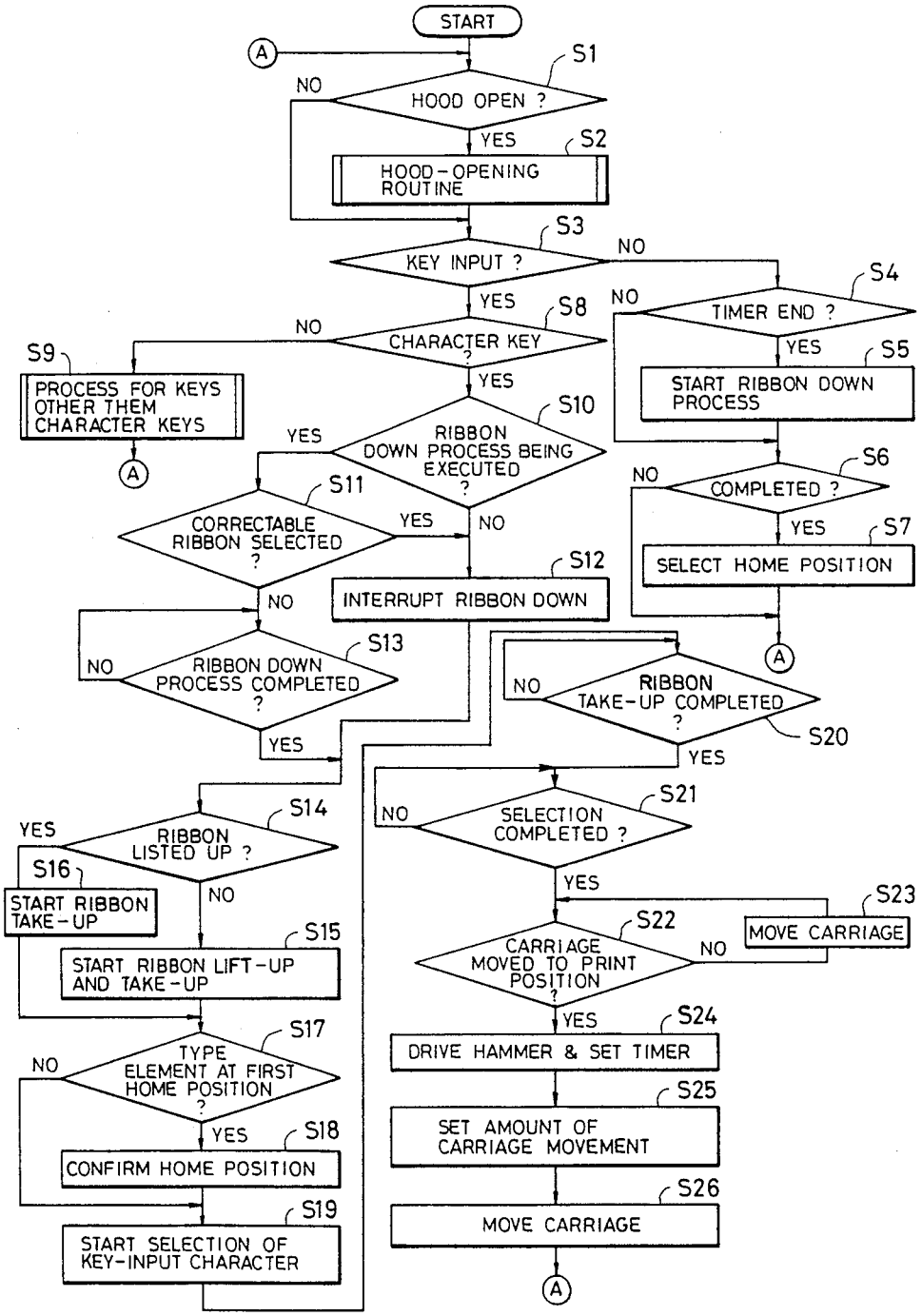
FIG. 33 is a control flowchart for an output sequence.

FIG. 33 shows a control flowchart for an output sequence by the MPU 230. A check is made to see if the hood 3*a* is, open or not in step S1. If YES, the hood opening routine (step S2), which will be explained hereinafter, is executed to inhibit the operations of the foregoing printing mechanism and the like. A check is made to see if a key has been inputted or not in step S3. The elapsed time from the precedent printing operation is checked in step S4. The ribbon down process to bring down the ink ribbon from the printing position is executed in step S5 due to the elapsed time. A check is made to see if the ribbon down process has been finished or not in step S6. If YES, the home position of the type element is selected in step S7.

There are two kinds of home positions of the type wheel in the printing apparatus described in this invention. These home positions will be first explained hereinbelow. Namely, two kinds of home positions of the type wheel correspond to the following two cases. One is the case where the carriage moves to the right (in the printing direction) due to the key input such as print key 420, space key 422, tabulator key 424 all shown in FIG. 55 or the like immediately before step S1 in the flowchart of FIG. 33. (This case is referred to the first home position.) The other is the case where the carriage is returned to the direction opposite to the printing direction in order to execute the correcting operation or the like by the back space key 426 as shown in FIG. 55. (This case is referred to as the second home position.) The home position which is used in this specification means not only the position for positioning the wheel location to select a desired character but also the standby position until the next operation after completion of each printing operation.

Figure 34:
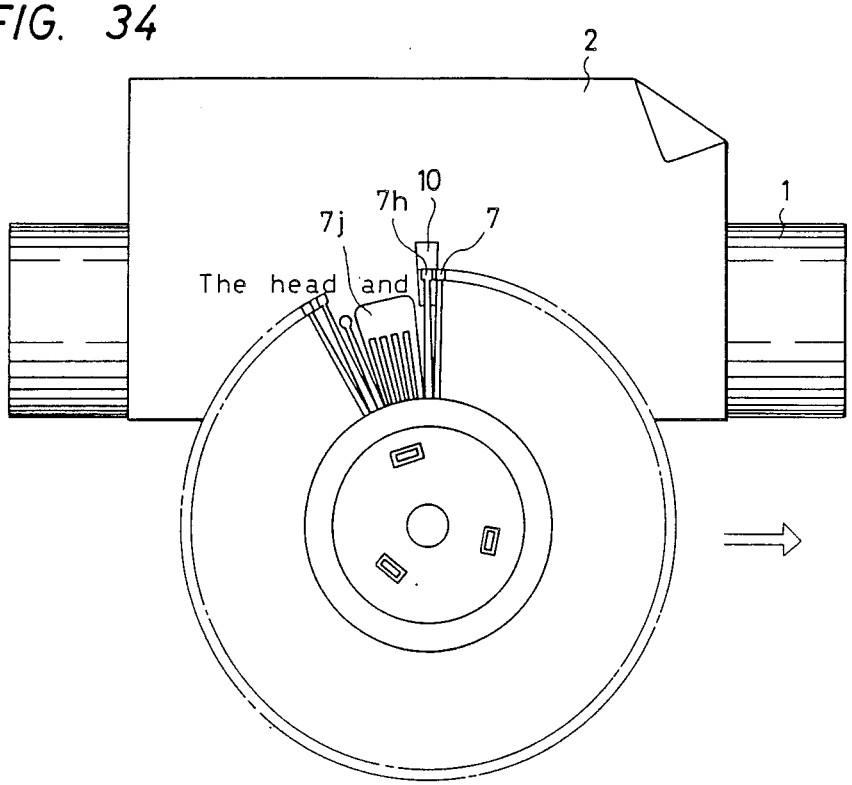
FIGS. 34 to 36 are explanatory diagrams of the home position of the type wheel.

FIG. 34 shows the first home position of the type wheel immediately after completion of the printing operation in the printing direction in the former case. In the diagram, reference numeral 1 denotes the platen; 2 is the print paper; 7 the type wheel; and 10 the hammer. Since this diagram shows the state just after the character has been printed, the carriage is moved to the right by an amount of one character and a predetermined type 7*h* of the type wheel 7 comes to the position corresponding to the hammer 10. At this position, a notched portion 7*j* of the type wheel is located under the printed characters. Thus, the operator can see the printed characters without being obstructed by the type wheel.

Figure 35:
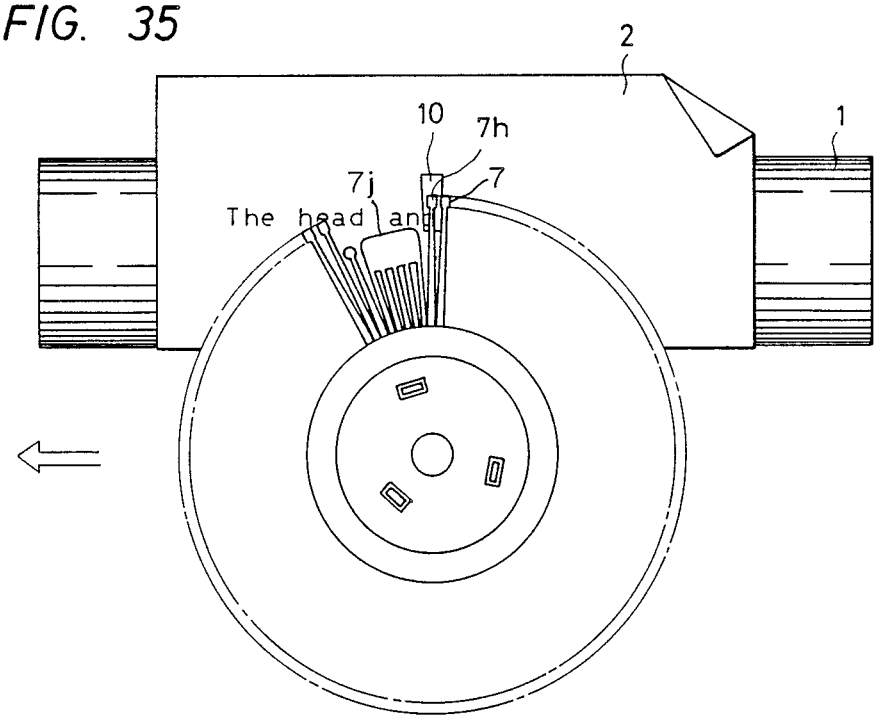
Figure 36:
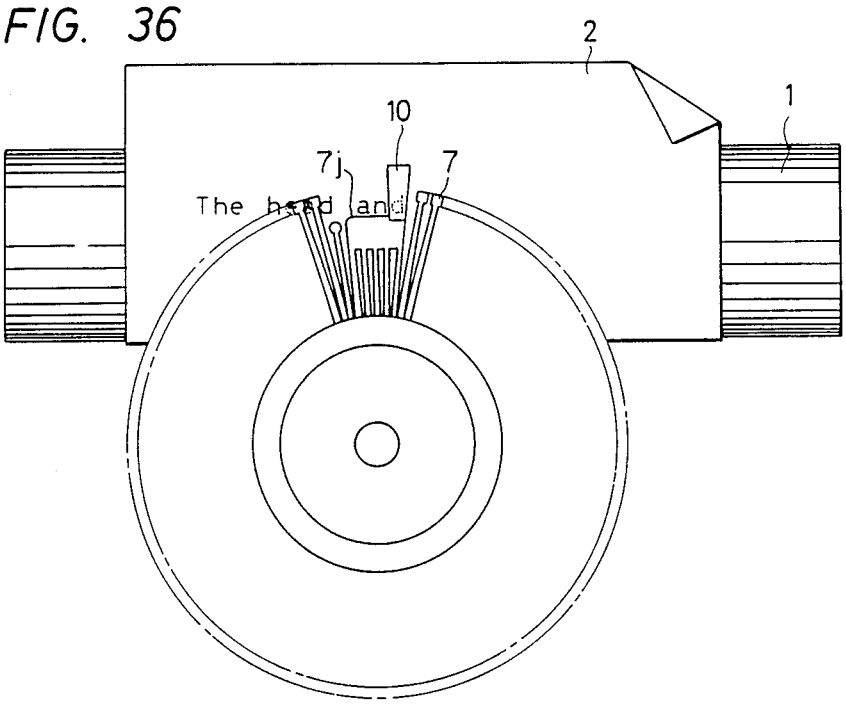

Next, the back space key 426 is pressed from the foregoing state to shift the carriage to the left by an amount of one character. Due to this, the type 7*h* comes to the position over the printed character "d" according to the conventional apparatus as shown in FIG. 35. In this state, the type 7*h* hinders viewing the character "d", so that when the back space key has once been pressed, it is difficult to see the character which has been printed immediately before the backspace operation. Therefore, it is difficult to confirm, for example, whether the hammer has been located to the position corresponding to the character to be corrected, or the like. On the other hand, FIG. 36 is an explanatory diagram of the second home position of the apparatus of the invention. When the back-space operation is executed from the initial position of FIG. 34, the carriage is returned by an amount of one character in the direction opposite to the printing direction; however, the type wheel is moved to the second home position at this time. Due to this, the hammer 10 faces the character "d" and by pressing the back space key by the operator, the position where the carriage was returned can be easily known.

In FIG. 33, if YES in step S3, a check is made to see if the key is a character key or not in step S8. In NO, the process for keys other than character keys (which will be explained hereinafter with reference to FIG. 40) is executed in step S9. If YES in step S8, a check is made in step S10 to see if the ribbon down process is being executed or not. If YES, a check is made in step S11 to see if the kind of ink ribbon loaded at present is the correctable ink ribbon or not. The kind of ribbon may be instructed by the key input of the user or by providing a sensor 412 to discriminate the kind of ink ribbon loaded as shown in FIG. 54. If YES in step S11, or if NO in step S10, the ribbon down operation is interrupted in step S12. Thus, the ribbon lift-up operation can be executed without waiting for the end of ribbon down operation, resulting in an improvement in response speed for the character key input in step S8.

If it is determined in step S11 that the ink ribbon loaded is not the correctable ink ribbon but the multi-strike ink ribbon or the like, the apparatus waits for the end of ribbon down operation in step S13. Next, a check is made in step S14 to see if the ink ribbon has been lifted up to the printing position or not. If YES, the ribbon is taken up in step S16. If NO in step S14, the ribbon is lifted up to the printing position in step S15. At this time, if it is the first ribbon lift-up operation after the hood 3*a* was opened in step S2, the ribbon is lifted up by an amount larger than an ordinary necessary rotation amount, thereby making it possible to eliminate the slack or the like of the ink ribbon due to the loading and unloading operations of the ribbon or the like by the operator when the hood is opened.

Home position search

Figure 37:
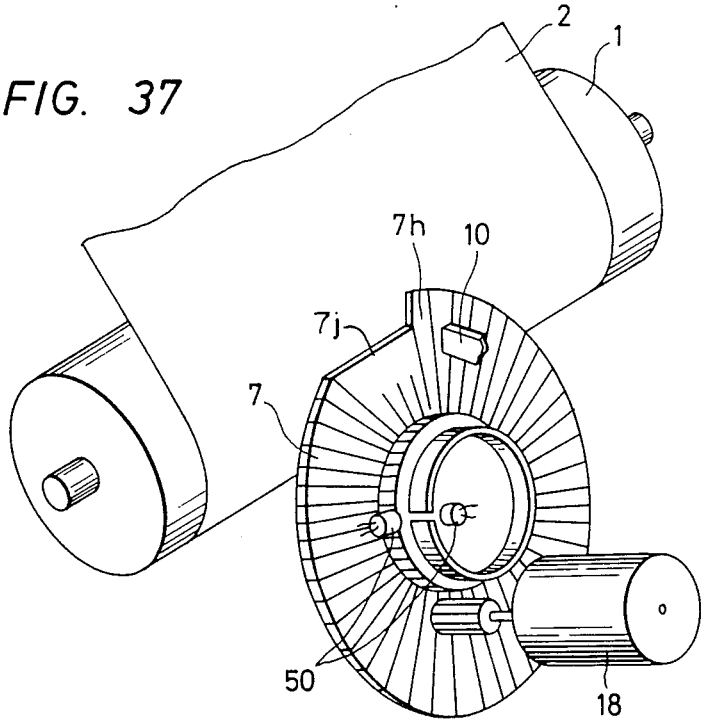
FIG. 37 is a perspective view illustrating a home position detecting mechanism.

Next, a check is made in step S17 to see if the type element is located at the first home position or not. If the home position cannot be detected, the home position is searched to detect the home position in step S18. FIG. 37 shows the home position detecting state. In this state, the position of the predetermined type spoke 7*h* coincides with the position of the hammer 10 and at the same time, a signal (WHX) such that the controller logic circuit 201 (which will be explained hereinafter with reference to FIG. 45) can recognize the home position is outputted through the waveform shaping circuit 221 shown in FIG. 45-1 from a detector 50 which can generate a signal synchronously with each rotation of the type wheel.

If no signal is outputted from the detector 50 in spite of the fact that the controller logic circuit 201 indicates the home position, there can be considered the case where some external forces are applied to the type wheel, so that the excitation phase of the wheel motor 210 differs from the phase which is instructed by the MPU 230, or the like. In this case, the apparatus intends to return the type wheel to the home position by rotating it.

Figure 38:
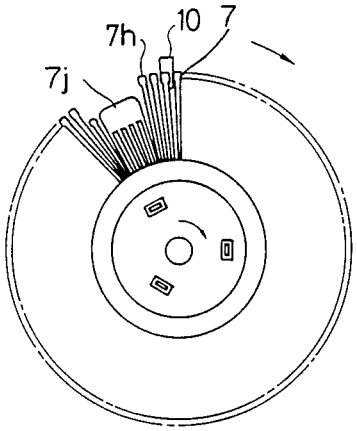
FIGS. 38 and 39 are diagrams for explaining a method of searching the home position.
Figure 39:
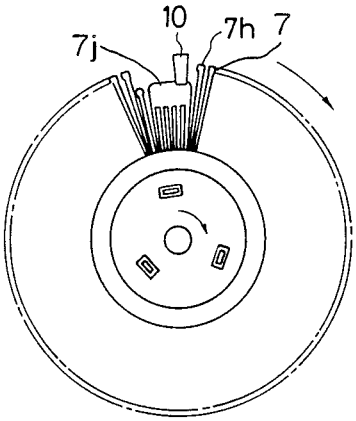

A counter 442 shown in FIG. 59 is reset at the position where the detection signal is generated. The case where the rotating direction is determined to one direction is considered. For example, when it is assumed that the rotating direction is the clockwise direction when seeing from the back side of the type wheel, the position where the type spoke 7*h* coincides with the hammer 10, i.e., the home position can be soon found out in FIG. 38. However, in the case of FIG. 39, the type wheel can be returned to the home position only when it rotates almost once, so that it takes a long time for detection.

However, in general, such a situation frequently occurs due to the external disturbance such as vibration or the like. Therefore, it is considered a possibility that a deviation amount from the home position lies within a range of a few type spokes is high.

In the printing apparatus according to the invention, when the home position is not detected, the type wheel is first rotated clockwise from this position by an amount of four type spokes and a check is made to see if the signal is generated from the detector 50 or not. If no signal can be detected, the type wheel is rotated once from this position in the opposite direction.

This searching method is very effective to detect the home position in a short time. In this case, the rotating direction was set to the clockwise direction and the amount of rotation of the type wheel was set to four type spokes; however, they may be also changed in dependence on the apparatus.

Next, the key-input character is selected in step S19.

Then, the apparatus waits until the printing conditions in steps S20 to S23 are satisfied.

First, in step S20, a check is made to see if the ribbon take-up operation, ribbon lift-up operation, and the like have been completed or not. In step S21, a check is made to see if the character selecting operation in step S19 and the like have been completed or not. In steps S22 and S23, a check is made to see if the carriage has moved to the printing position or not. In the next step S24, the hammer is driven to hit and print the type selected in step S24 and the timer 233 is set so as to perform the next key input and ribbon shift-down control. An amount of movement of the carriage is set to move the carriage to the next printing position in step S25. Then, the carriage is moved in step S26. The processing routine is returned to Ⓐ and the above control procedure is again executed.

Process for keys other than character keys

Figure 40:
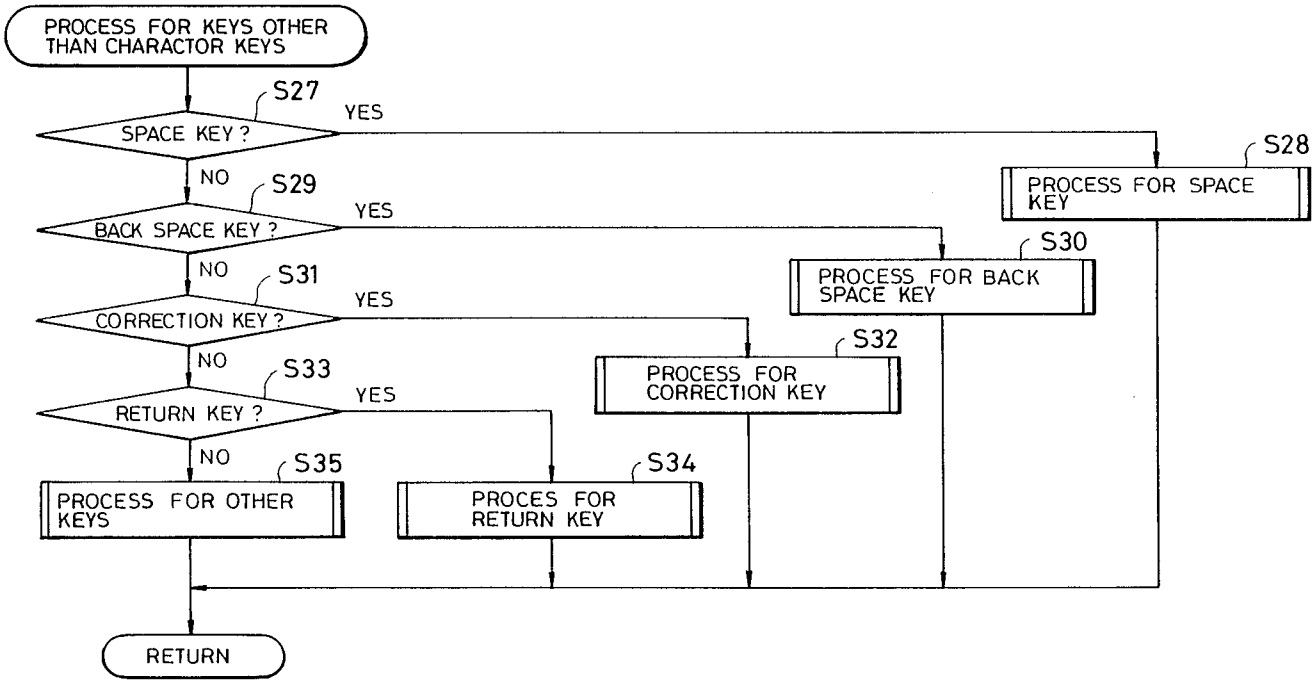
FIGS. 40 to 44 are control flowcharts.

FIG. 40 is a control flowchart showing the process for keys other than character keys shown in step S9 in FIG. 33.

First, if the space key 422 was inputted in step S27, the process for the space key is executed in step S28. If the space key is not inputted in step S27, a check is made in step S29 to see if the back space key 426 has been inputted or not. If YES in step S29, the process for the back space key is executed in step S30. If NO in step S29, a check is made in step S31 to see if the correction key 428, shown in FIG. 55 has been inputted or not. If YES in step S31, the process for the correction key is executed in step S32. If NO in step S31, a check is made in step S33 to see if the return key 430, shown in FIG. 55 has been inputted or not. If YES in step S33, the process for the return key is executed in step S34. If NO in step S33, the process for other keys is executed in step S35.

Figure 41:
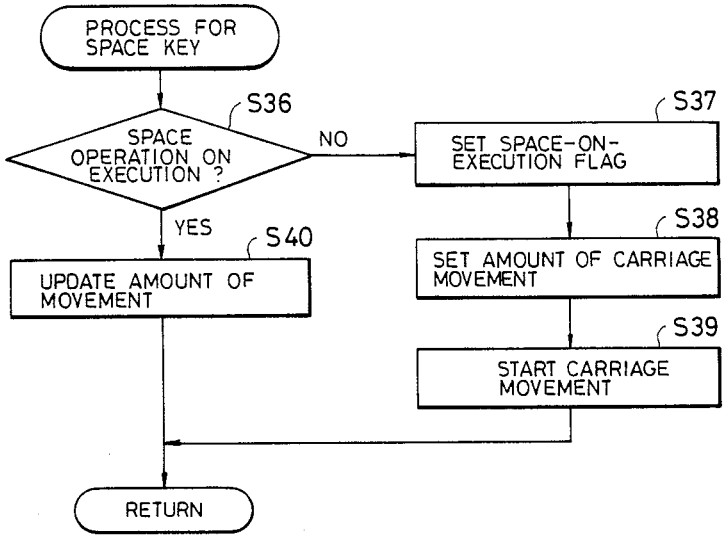
Figure 42:
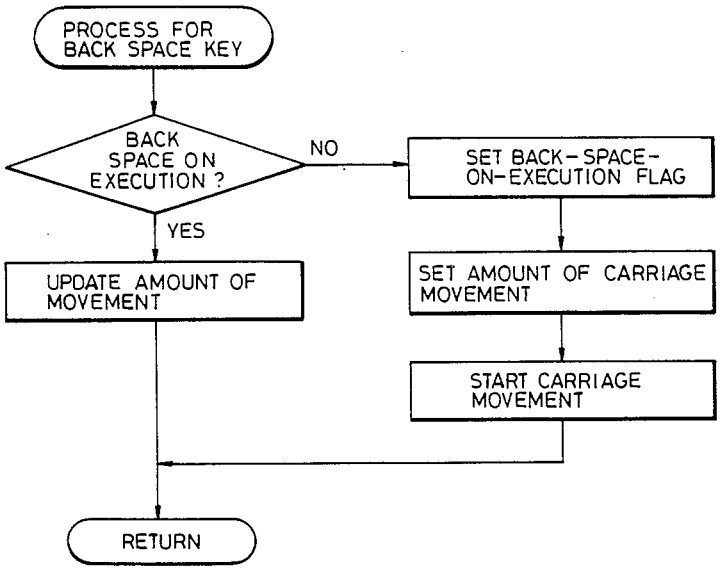

FIG. 41 is a control flowchart showing in detail the process for the space key shown in step S28 in FIG. 40. FIG. 42 is a control flowchart showing in detail the process for the back space key shown in step S30 in FIG. 40. Since the control procedures of the processes for the space key and back space key are similar excluding that the moving directions differ, only the process for the space key in FIG. 41 will be described.

First, in step S36, a check is made to see if the space moving operation has already been being executed (repeated) or not. If NO, or in the case of the first space moving operation, step S37 follows and a space-on-execution flag for the next discrimination in step S36 is set. An amount of carriage movement is set in step S38 and the carriage is moved in step S39. If YES in step S36, the amount of movement is updated in step S40 and the space movement is continued.

The amounts of movement spaces at the start of the apparatus differ in dependence on the pitch selected by a print pitch selector and are set to, for instance, 1/15, 1/12, or 1/10 inch (amount of one space), or the like.

Process for the correction key

Figure 43:
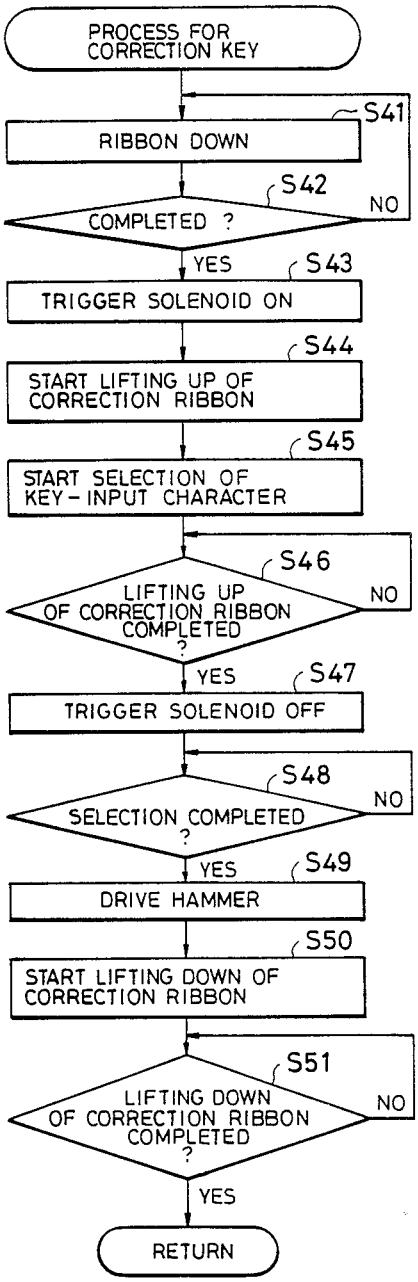

The process for the correction key shown in step S32 in FIG. 40 will now be described with reference to a control flowchart of FIG. 43. The ribbon down operation is executed in step S41. A check is made in step S42 to see if the ribbon down operation has been completed or not. As described in FIGS. 16, 23, and 24, the trigger solenoid 103*a* is turned on in step S43, thereby enabling the ribbon guides 65 and 66 to be lifted up to the correction printing position in the subsequent operations. In step S44, the lift-up operation is started to move the correction ribbon to the correction printing position. In step S45, the type selecting operation is started to select the character to be corrected, i.e., the character which has been precedently key-inputted.

A check is then made in step S46 to see if the correction ribbon has been lifted up to the position near the correction printing position (states in FIGS. 24-5 and 24-6) or not. If YES, the trigger solenoid 103*a* is turned off in step S47. A check is made in step S48 to see if the character selecting operation in step S45 has been completed or not. If YES, the hammer 10 is driven to delete the character in step S49. The process to lift down the correction ribbon is started in step S50 and a check is made in step S51 to see if it has been completed or not.

Process for the return key

Figure 44:
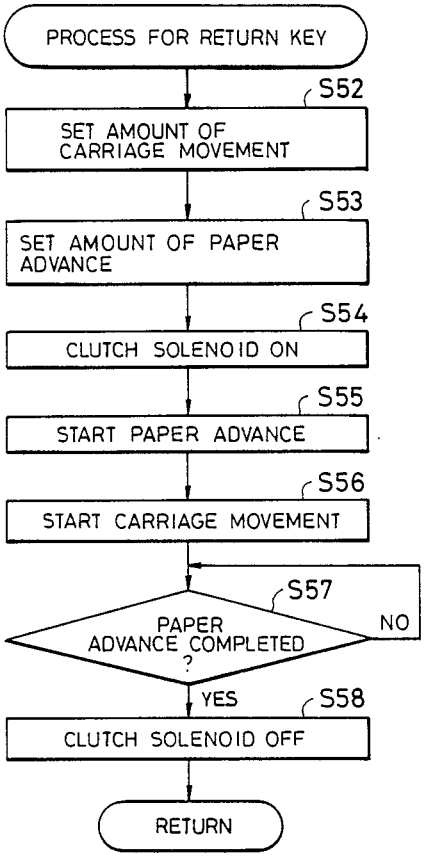

The process for the return key shown in step S34 in FIG. 40 will now be described with reference to a control flowchart of FIG. 44. First, in step S52, an amount of carriage movement is obtained from the current position of the carriage and the position to be returned, e.g., left margin position, or the like and set. An amount of paper advance is set in step S53. Next, the clutch solenoid 20 described in FIG. 3 is turned on in step S54, thereby enabling the paper to be advanced in the subsequent operation. The paper advance is started in step S55. The carriage movement is started in step S56.

A check is made in step S57 to see if the paper advance operation has been completed or not. If YES, the clutch solenoid 20 is turned off in step S58 to make it possible to perform the ribbon take-up operation, ribbon lift-up operation, and the like for the ribbon. Then, the processing routine is finished.

The amounts of paper advance differ in dependence on the pitch selected by a new-line pitch selector 444 shown in FIG. 60 and are set to 1, 1.5, and 2 lines (amount of one new line).

The driving of each motor 17, 18, 19 mentioned above will be further described. The wheel motor 18 to select a desired character, carriage motor 17 to move the carriage, and feed motor 19 to lift up and down the ribbon and take up the ribbon or advance the paper are driven in the following manner. Namely, a pattern of an excitation phase is first written into the address corresponding to each motor 17, 18, 19 in the I/O expander circuit 234 shown in FIG. 45-2. The excitation is performed. The exciting time is also set to the timer 233 at this time. After an expiration of a desired period of time set to the timer, the operation of the MPU is interrupted by the interruption signal (INT2). The pattern of the next exciting phase and the exciting time are set in the interrupting process and then the interrupting process is ended. Thereafter, this process is repeated a number of times as many as only the set number of steps. A flag indicative of the processing state and the like are set during this process. After completion of this process, this flag and the like are reset.

This flag and the like are stored in the RAM 232.

The patterns of the exciting phases, table of the exciting time, and the like are stored in the ROM 231. The timer 233 has a few timer counters 432 therein. When a value is set to the timer counter, its value is counted down for every constant period of time. When the count value becomes 0, the operation of the MPU is interrupted by the interruption signal (INT2). Those several timer counters are used to obtain the exciting time of each motor 17–19, the period of time until the ribbon lift-down operation after the printing operation, and the like.

The character selecting process of the wheel motor 18 will now be described. The position of the type element corresponding to the input character key is obtained from the type element position table 446 or the like in the ROM 231 shown in FIG. 61. The rotating direction, the number of movement steps which are necessary to select the character, and the like are obtained by the MPU 230 on the basis of the difference between the position obtained and the current position, thereby driving the wheel motor 18.

Operation time chart of the printing sequence

The printing sequence of the above-mentioned printing apparatus will now be described with reference to an operation time chart.

Correctable ribbon, signle-strike print

Figure 46:
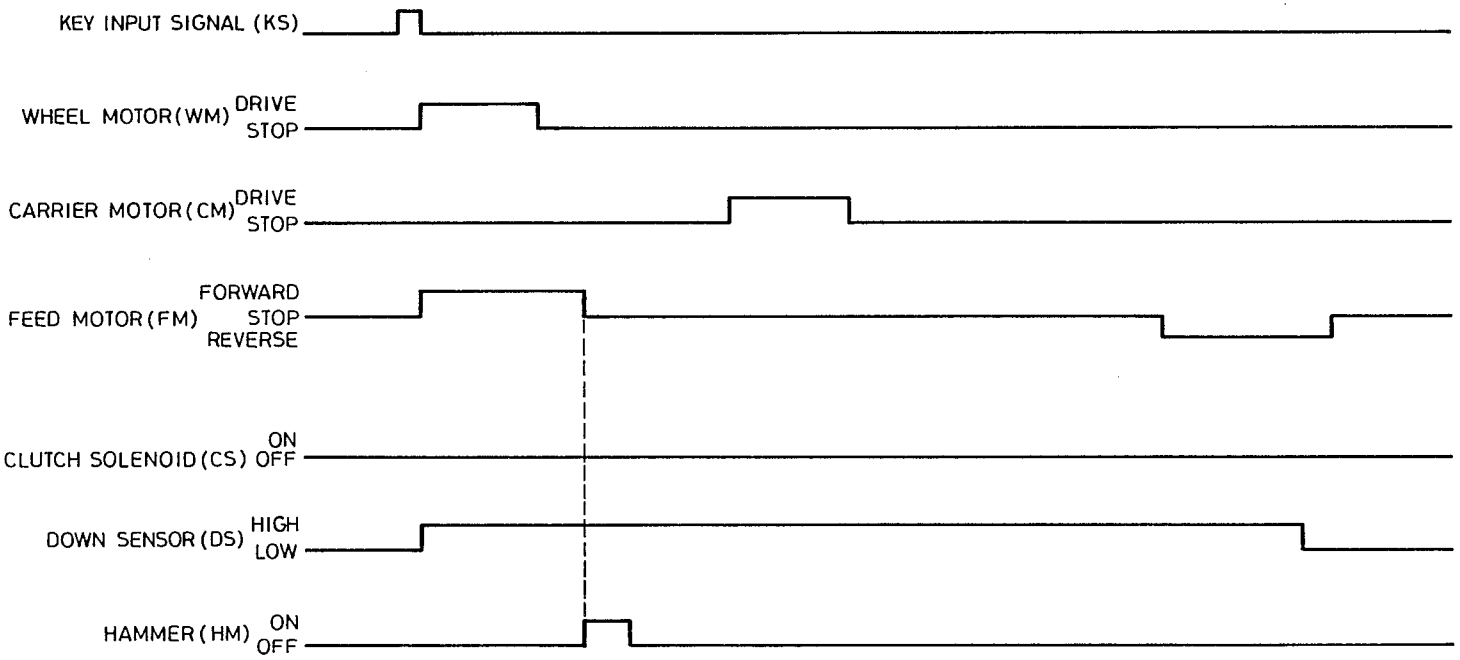
FIGS. 46 to 53 are operation time charts for each operation.

FIG. 46 is an operation time chart showing the printing sequence in the single-strike printing mode in the case where the correctable ribbon is loaded. First, the wheel motor 18 (WM) is driven by inputting a key input signal (KS). The type corresponding to this key input is selected. At the same time, the feed motor 19 (FM) is rotated forwardly (in the direction of the arrow A 436 in FIG. 3). The ribbon is lifted up to the printing position. A predetermined amount of ribbon is taken up. (Refer to FIG. 13-2). After completion of the type selecting operation, ribbon take-up operation, and the like, the hammer (HM) 10 is driven to print the selected character. After completion of the print, the carriage motor 17 (CM) is driven to move the carriage 12 to the next printing position. Then, the feed motor 19 (FM) is driven reversely to lift down the ribbon. When the down position of the ribbon is detected by the down sensor 95 shown in FIG. 20, the feed motor 19 (FM) is stopped. A low level signal of the down sensor 95 indicates the detecting state. As shown in FIG. 20, the down sensor chip 93 depresses the contact lever 95*a* of the down sensor 95 and the down position is detected. FIGS. 13-1 and 20 show the down position of the ribbon.

Correctable ribbon, continuous print

Figure 47:
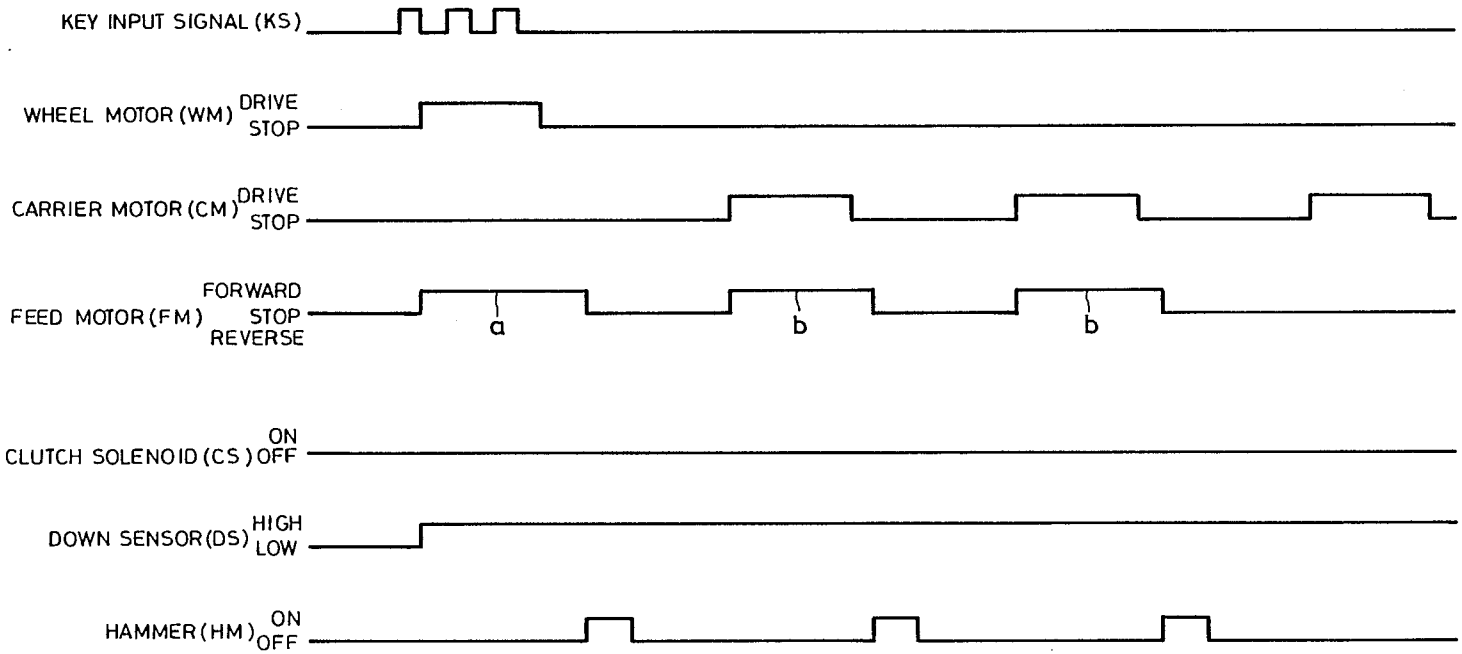

FIG. 47 shows an operation time chart in the case where the continuous print was executed by the key signal from the down state of the ribbon when the correctable ribbon is loaded.

First, the wheel motor 18 (WM), feed motor 19 (FM), and hammer 10 (HM) are driven by inputting the key input signal (KS) in a manner similar to the single-strike printing sequence. If the key input is again executed within a predetermined period of time, namely, for example, if the key input is executed while the carriage is moving to the next printing position, the ribbon is not lifted down but held in the lift-up state and the ribbon is taken up. As shown in FIG. 13-2, the ribbon is fed with the printing position held to print the next character.

According to the printing apparatus described in this invention, when the ribbon is shifted from the standby position to the printing position, the ribbon is simultaneously taken up. On the contrary, when the ribbon is shifted down from the printing position to the standby position, the ribbon is not reversely rotated due to the one-way mechanism as described before.

However, in the case of reversely rotating the feed motor 19 in the non-printing direction, the slack in the gear, belt, and the like 22–27, 30, 31 from the feed motor 19 to the ribbon take-up are taken up in one direction. Even if the operator forwardly rotates the feed motor to take up the ribbon again to print as well, the foregoing mechanical slacks are merely taken up on the opposite side (printing side) until a predetermined angle of rotation of the feed motor 19 has occurred and during this time the ribbon is not fed. According to the experiments of the applicants of this invention, it has been found that this angle of rotation of the feed motor was about 15°. On the other hand, assuming that no slack exists theoretically, the angle of rotation of the feed motor 19 which is necessary to feed the ribbon by an amount of one character was 240°. Therefore, in the case of taking up the ribbon by the key input, the feed motor 19 is rotated by an angle of 255° (=240°+15°) irrespective of the case where the feed motor 19 was rotating reversely immediately before the ribbon take-up operation. On the other hand, in the case of continuously printing, the ribbon is not lifted down but fed at the printing position. Thus, the foregoing slacks are still taken up in the printing direction and there is no need to additionally rotate the feed motor by an angle of 15° corresponding to the slacks.

Consequently, in the forward rotation pulse of the feed motor 19 shown in FIG. 47, the first pulse a corresponds to the angle of 255° (=240°+15°) and the subsequent pulse b corresponds to the angle of 240°.

In the printing apparatus of the invention, such an amount of mechanical slacks is corrected by individually changing the angle of rotation of the wheel motor 18.

Correctable ribbon

Figure 48:
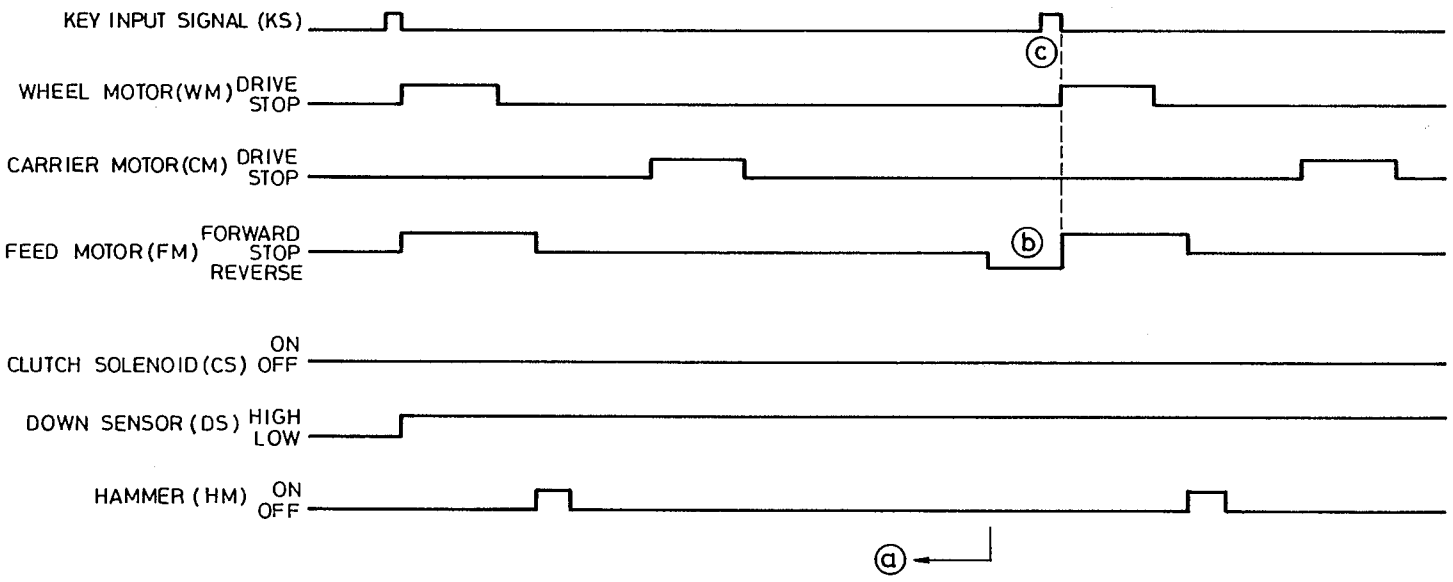

FIG. 48 is an operation time chart showing the printing sequence in the case where the key input was executed while the ribbon is being lifted down when the correctable ribbon is loaded. The operation before point ⓐ is similar to the single-strike printing sequence (FIG. 46). Next, in the case where the key input is again executed (at point ⓒ) while the ribbon is being lifted down (at point ⓑ) after completion of the print, the wheel motor (WM) is driven. The type element corresponding to the key input is selected. At the same time, the reverse rotation of the feed motor (FM) is stopped to stop the lift-down operation of the ribbon. The forward rotation of the feed motor (FM) is started to again lift up the ribbon. The ribbon is then stopped at the printing position. Simultaneously, a predetermined amount of ribbon is taken up. Thereafter, the hammer (HM) is driven to print.

Multistrike ribbon

Figure 49:
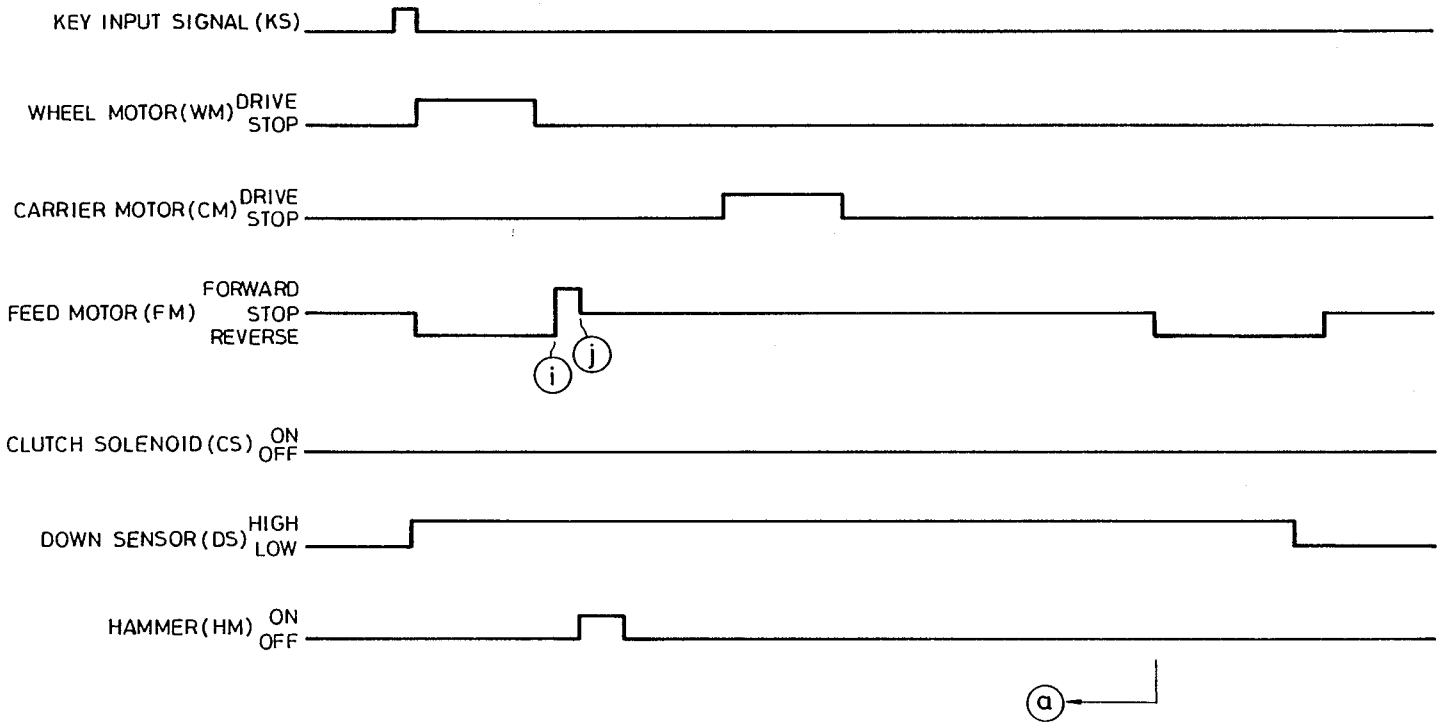

A printing sequence in the case where the multistrike ribbon is loaded will now be described. FIG. 49 is an operation time chart showing the printing sequence in the single-strike printing mode. First, the wheel motor (WM) is driven to select the type element corresponding to the key input and at the same time, the feed motor (FM) is reversely rotated to shift up the ribbon without taking up the ribbon. (Refer to the description in FIGS. 22-1 to 22-6.)

Next, the feed motor (FM) is forwardly rotated to take up a predetermined amount of ribbon for the period of time between points ⓘ and ⓙ in FIG. 49. Then, the hammer (HM) is driven to print. The carriage motor (CM) is driven to move the carriage to the next printing position. Thereafter, the feed motor (FM) is reversely rotated to shift down the ribbon since other key inputs are not executed.

The driving of the feed motor is stopped after the down position of the ribbon is detected by the down sensor 95.

Multistrike ribbon, continuous print

Figure 50:
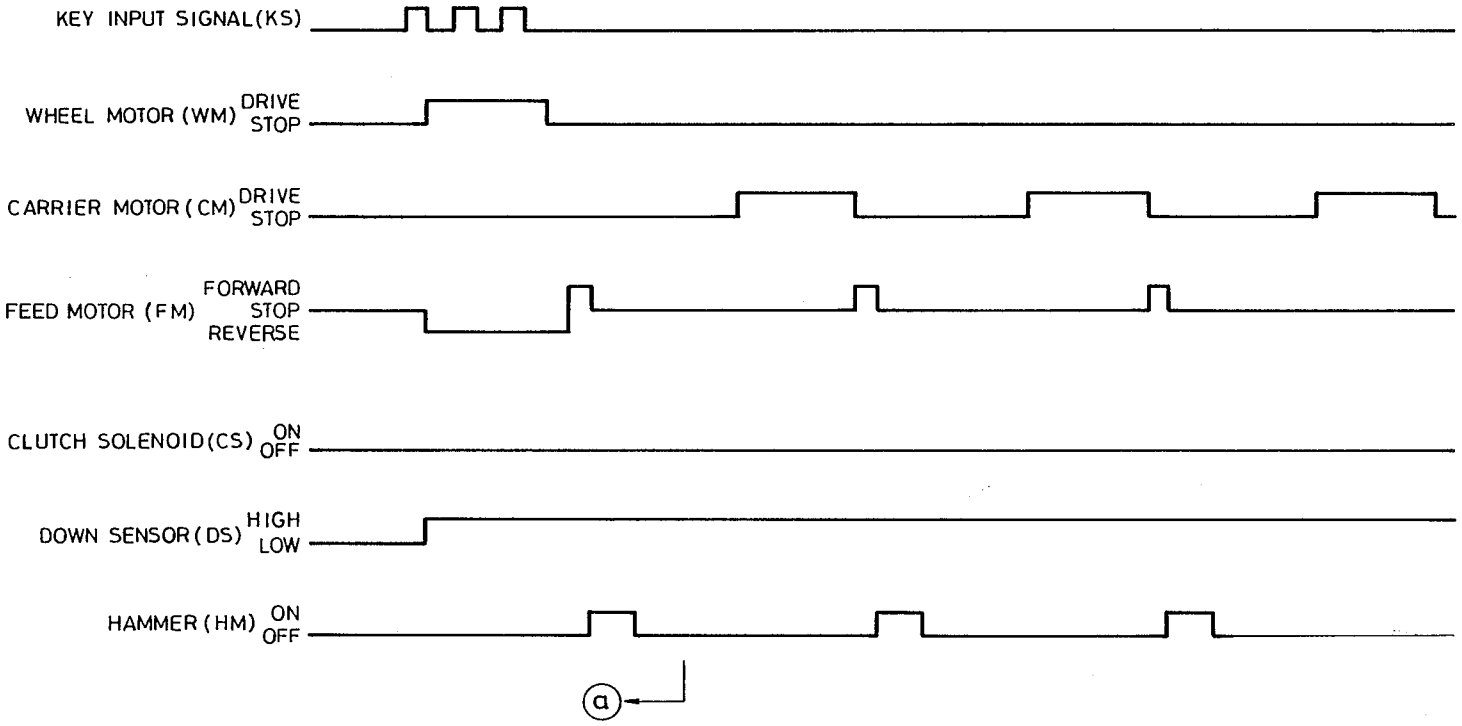

The continuous printing mode when the multistrike ribbon is loaded will now be described with reference to an operation time chart for the printing sequence of FIG. 50. Since the operation until point ⓐ is similar to the operation in FIG. 49, its description is omitted. In this mode, if the period when the key input is continuously executed lies within a predetermined period of time similarly to FIG. 47, the continuous printing operation can be performed without shifting down the ribbon as shown in FIG. 47. A different point from FIG. 47 is that the multistrike ribbon is loaded in the case of FIG. 50. A ribbon take-up amount is small, namely, the period of time when the feed motor is forwardly rotated is short. Therefore, in the continuous printing mode of the same characters, the time required to print can be reduced as compared with the case where the correctable ribbon is loaded.

Figure 51:
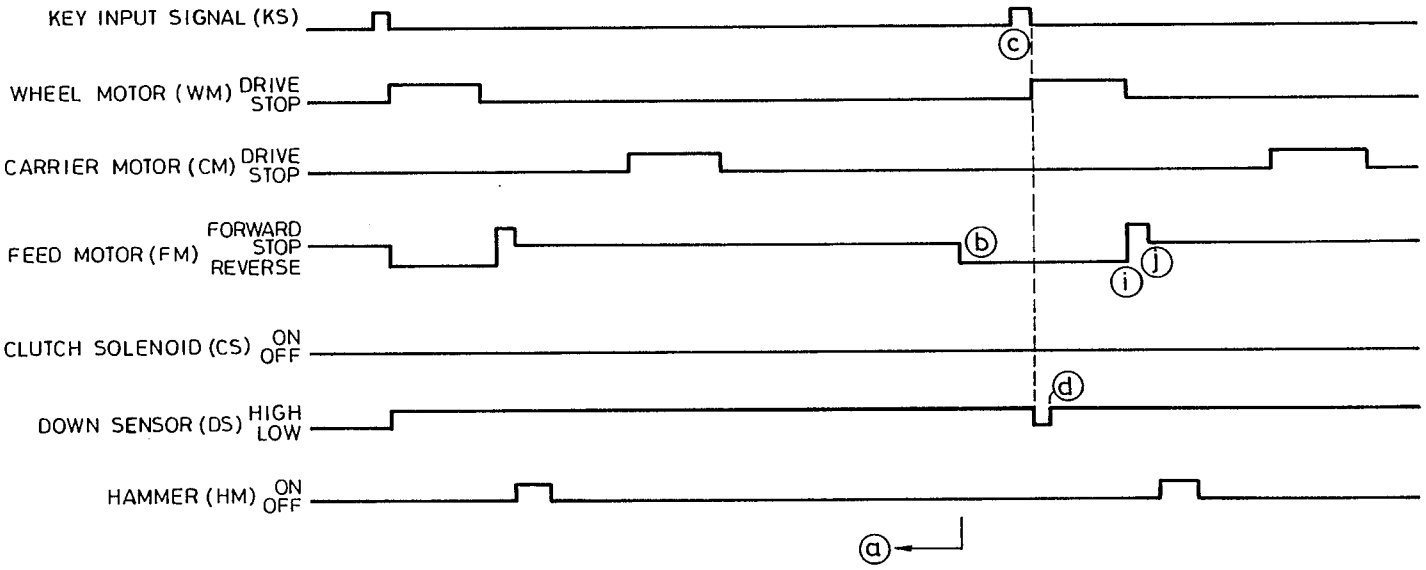

The case where the key input was executed during the ribbon shift-down operation when the multistrike ribbon is loaded will now be described with reference to an operation time chart for the printing sequence of FIG. 51. Since the operation until point ⓐ is similar to the operation until point ⓐ in FIG. 49, its description is omitted. The feed motor (FM) is then reversely rotated to shift down the ribbon from point ⓑ. If the key input is executed (at point ⓒ) during this reverse rotating period as will be obvious from the diagram, the ribbon is shifted down. After the ribbon down was detected by the down sensor as well, the feed motor is continuously reversely rotated to lift up the ribbon. Then, as explained in FIG. 49, after point ⓓ, the feed motor is reversely rotated until the ribbon is lifted up to the printing position. As already described in FIG. 49, the feed motor is forwardly rotated to take up a predetermined amount of ribbon for the period of time between points ⓘ and ⓙ On the other hand, while the feed motor is reversely rotated, the wheel motor is driven to select the type element to be printed. After point ⓙ, the hammer is driven to hit the selected type element.

Correction printing sequence

The correction printing sequence will now be described with reference to an operation time chart of FIG. 52. First, the correction key is pressed and the characters to be corrected are inputted. The character to be corrected may be, for example, the precedently printed character which has been stored in a memory 434, as shown in FIG. 56 or the like. The character to be corrected automatically may be selected by inputting the correction key. If the correction print is instructed in this way, the wheel motor is rotated to select the type element corresponding to the character to be corrected. At the same time, the carriage motor (CM) is driven to move the carriage to the position of the precedently printed character. Also, the trigger solenoid **103*a* (TS) is energized as described in FIG. 16 to lift up the correction ribbon to the correction printing position (maximum lift position) shown in FIG. 13-3**.

Next, by reversely rotating the feed motor, the lift-up of the ink ribbon 9 and correction ribbon 11 is started toward the correction printing position through the mechanism of the rotary cam 59 shown in FIGS. 24-1 to 24-11. The feed motor 19 is reversely driven until the ink ribbon 9 and correction ribbon 11 are lifted up to the correction printing position. After the correction ribbon 11 is lifted up to the correction printing position (maximum lift position), the trigger solenoid **103*a*** is turned off and the hammer is driven to type the correction ribbon. Thus, the character to be corrected is erased. However, according to the printing apparatus described in the invention, as already mentioned, the correcting quality is improved by slightly varying the correction position and vertical position of the correction ribbon.

The timing to turn off the trigger solenoid 103*a* is not limited to the timing after completion of the lift-up operation. It may be turned off at the timing when the blade guide pin 96 ha entered the correction cam route as shown in the operation explanatory diagrams of FIGS. 24-1 to 24-11. The correction ribbon may be the lift-off tape or over-lap tape. After the character is erased, the correction ribbon is lifted down (point ⓐ). This operation is the same as the ribbon down operation.

The carriage motor (CM) is driven to move the carriage to the position which is deviated to the right by 1/240 inch from the center of the character to be corrected. At the same time, by typing the correction ribbon at the position indicated at numeral 111-1 in FIG. 26, the right side of the character is erased. Then, the carriage is moved to the central position of the character to be corrected in order to erase the central portion of this character at point ⓐ in FIG. 52. Simultaneously, the correction ribbon is moved to the position indicated at 111-2 in FIG. 26 and typed by the hammer.

Figure 52:
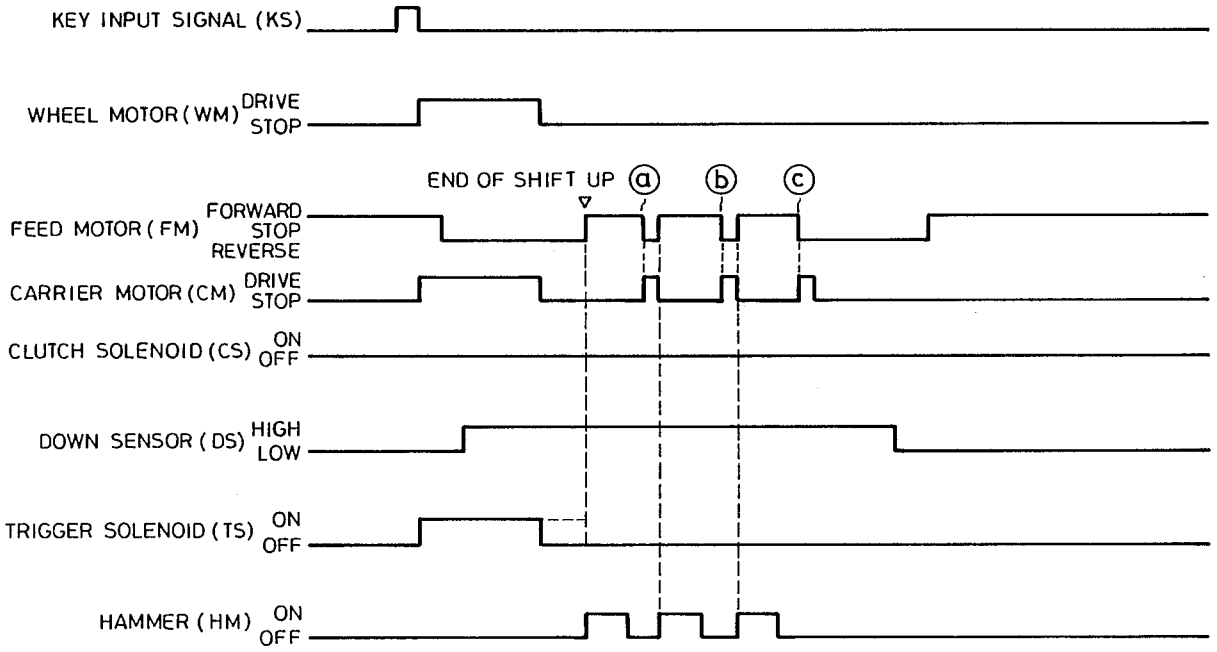

Next, the carriage is moved, to the position which is deviated to the left by 1/240 inch from the center of the character to be corrected in order to erase the left side of this character at point ⓑ in FIG. 52. At the same time, the correction ribbon is moved to the position indicated at numeral 111-3 in FIG. 26 and types to erase the character. At point ⓒ, the carriage is moved to the center of the erased character so as to enable the next character, e.g., the character which is retyped to be printed at the same position as that of the erased character.

Figure 53:
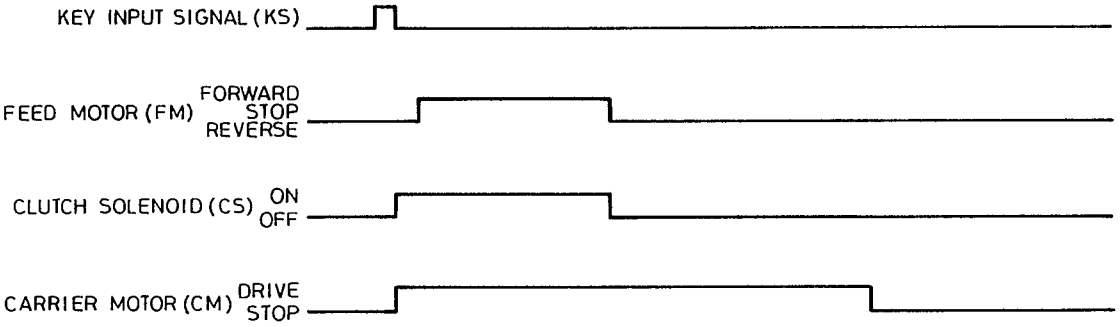

The operating sequence for the paper advance by inputting the return key 430 or the like will now be described with reference to an operation time chart of FIG. 53. First, when the return key or the like is inputted, as described in FIGS. 2 and 3, the clutch solenoid 20 (CS) is energized to advance the paper. The feed motor (FM) is forwardly rotated to rotate the platen 1.

If the carriage needs to be moved, the carriage motor is driven simultaneously with the forward rotation of the feed motor. The feed motor is continuously forwardly rotated until a desired amount of paper is advanced. After completion of the paper advance, the feed motor is stopped and the clutch solenoid is turned off. After completion of a desired amount of carriage movement, the carriage motor is stopped.

As described in detail above, according to the invention, since there is the possibility such that the ribbon cassette was newly loaded after the cover of the apparatus had been opened and closed, the ribbon take-up operation is executed and the take-up mechanism can be set. This control is limited to the operation before the next printing operation is performed after the cover was opened and closed, thereby enabling the unnecessary ribbon advance to be prevented.

If the next printing operation is requested while the ribbon is being shifted down, the shift-up operation can be started without waiting for completion of the ribbon shift down.

In addition, on index 436 shown in FIG. 57 is detected at the home position of the wheel and when an error occurs (namely, when the home position cannot be detected), the portion near the home position is preferentially sought, thereby enabling the seeking time to be reduced. This is because in the case where the wheel is driven from the home position and after completion of the print, the wheel is returned to the home position and then the home position is checked at this time or when the printing section is activated, if an error occurs as well, the probability that the index 436 exists near the stop position is high.

Further, two home positions of the wheel are set and after the carriage is moved to the right, the notched portion *7j* of the wheel is set to the (first) home position so that the printed character can be seen. After the carriage is moved to the left, on one hand, the wheel position is set to the second home position to be rotated so that the character at the hammer position can be seen.

Due to this, a desired type element *7h* of the wheel can be extremely smoothly selected in accordance with the sequence.

One motor was commonly used to feed the paper and ribbon and shift the ribbon in this embodiment. In the manual operation, the platen may be disengaged from the driving system, thereby making it possible to prevent an unnecessary load from being applied.

By merely dropping the wheel, the wheel can be easily loaded. In addition, by vertically or horizontally moving the correction ribbon by slightly rotating the ribbon shift cam in the correcting operation, the correction ribbon can be efficiently used. Also, the operation and timing control of the carriage can be accurately performed.

The height of ribbon can be changed while making constant an angle of contacting surface of the ribbon at the ribbon guide 65, 66 in accordance with an angle of inclination with respect to the vertical direction of the type wheel. Moreover, even if the height differs as well, the length of ribbon pulled out of the cassette can be made always constant (so that the slack and the like can be absorbed).

In the case of shifting the ribbon from the standby position to the printing position, the ribbon is taken up and thereby enabling the print to be smoothly performed. The play of the gear, belt, and the like 22–27, 30, 31 can be absorbed by varying an angle of rotation of the feed motor in accordance with each sequence.

On the other hand, the foregoing various kinds of operations of the ribbon can be easily controlled due to the cam having various kinds of radii. The hammer section may be rotated so that hammer faces upward in order to further easily exchange the wheel.

As described above, according the invention, the low-cost output apparatus having a driving power, excellent functions, and good operating efficiency can be provided.

What is claimed is:

1. An output apparatus for outputting information to a recording medium by means of an ink sheet, said apparatus comprising:

output means for outputting information to the recording medium through the ink sheet;

a first feed mechanism for feeding said recording medium;

a second feed mechanism for feeding the ink sheet;

a third feed mechanism for feeding an ink correction sheet;

a motor for generating a driving force;

first transfer means for transferring the driving force generated by said motor selectively to (a) said first feed mechanism and (b) to one said second feed mechanism and said third feed; and second transfer means for switching the driving force generated by said motor between said second feed mechanism and said third feed mechanism in response to a change in the direction of rotation of said motor.

2. An output apparatus according to claim 1, wherein said first transfer means comprises a clutch mechanism with a serrated engagement member.

3. An output apparatus according to claim 1, wherein said third feed mechanism also is operable to shift the correction ink sheet vertically relative to the recording medium.

4. An apparatus according to claim 1, wherein said motor is a stepper motor.

5. An apparatus according to claim 1, further comprising means for selectively mounting a plurality of kinds of ink sheets in said apparatus.

6. An apparatus according to claim 1, wherein said first feed mechanism feeds said recording medium in a forward or reverse direction in response to the direction of rotation of said motor.

7. An apparatus according to claim 6, wherein said motor is a stepping motor.

8. An apparatus according to claim 1, wherein said first transfer means comprises a clutch mechanism and a solenoid and wherein when said solenoid is in its off state, said clutch mechanism is connected to said second and third feed mechanism but not to said first feed mechanism.

9. An apparatus according to claim 8, wherein said motor is a stepping motor.

10. An apparatus according to claim 1, wherein said output apparatus is an electronic typewriter.

11. An apparatus according to claim 10, wherein said motor is a stepping motor.

12. An apparatus according to claim 1, wherein said output means comprising a hammer and said apparatus comprises means for erasing one character by hitting the character with said hammer through the ink correction sheet a plurality of times and wherein said third feed mechanism moves the ink correction sheet upward or downward during the hitting operation.

13. An apparatus according to claim 12, wherein said motor is a stepping motor.

14. An apparatus according to claim 1, further comprising means for controlling said motor to make an additional rotation by a predetermined amount of angle rotation immediately after the change in the direction of rotation of said motor.

15. An apparatus according to claim 14, wherein the predetermined amount of angle rotation is approximately 15°.

16. An apparatus according to claim 14, wherein the direction of rotation of said motor is a direction in which the ink sheet is fed in respond to the operation of said second transfer means and said second feed mechanism.

17. An apparatus according to claim 14, wherein said motor is a stepping motor.

18. An apparatus according to claim 1, further comprising key means for inputting data and control means for controlling said apparatus in accordance with the data input by said key means.

19. An apparatus according to claim 18, wherein said motor is a stepping motor.

20. An apparatus according to claim 18, wherein said control means controls said motor to make an additional rotation by a predetermined amount of angle rotation immediately after the change in the direction of rotation of said motor.

21. An apparatus according to claim 20, wherein said motor is a stepping motor.

22. An apparatus according to claim 18, wherein said control means comprises a keyboard controller, an apparatus controller and a print controller.

23. An apparatus according to claim 22, wherein said motor is a stepping motor.

24. An output apparatus for outputting information to a recording medium by means of an ink sheet, said apparatus comprising:

output means for outputting information to the recording medium through the ink sheet;

a first feed mechanism for feeding the recording medium;

a second feed mechanism for selectively feeding one of the ink sheet and an ink correction sheet;

a motor for generating a driving force;

first transfer means including a solenoid and a clutch mechanism, for switching transfer of the driving force generated by said motor through said solenoid and said clutch mechanism and for transferring the driving force generated by said motor to one of said first feed mechanism and said second feed mechanism; and second transfer means for switching between forward and reverse feed directions of said first feed mechanism in response to a change in the direction of rotation of said motor.

25. An output apparatus according to claim 24, wherein said clutch mechanism includes a serrated engagement member.

26. An output apparatus according to claim 24, wherein said second feed mechanism also is operable to shift said correction ink sheet vertically relative to the recording medium.

27. An apparatus according to claim 24, wherein said motor is a stepping motor.

28. An apparatus according to claim 24, further comprising means for selectively mounting a plurality of kinds of ink sheets in said apparatus.

29. An apparatus according to claim 24, wherein said output means comprises a hammer and said apparatus comprises means for erasing one character by hitting the character with said hammer through the ink correction sheet a plurality of times and wherein said second feed mechanism moves the ink correction sheet upward or downward during the hitting operation.

30. An apparatus according to claim 29, wherein said motor is a stepping motor.

31. An apparatus according to claim 24, wherein when said solenoid is in its off state, said clutch mechanism is connected to said second feed mechanism but not to said first feed mechanism.

32. An apparatus according to claim 31, wherein said motor is a stepping motor.

33. An apparatus according to claim 24, wherein said output apparatus is an electronic typewriter.

34. An apparatus according to claim 33, wherein said motor is a stepping motor.

35. An apparatus according to claim 24, wherein said second feed mechanism selectively feeds one of the ink sheet and the ink correction sheet through said first transfer means in response to the direction of rotation of said motor.

36. An apparatus according to claim 35, further comprising means for controlling said motor to make an additional rotation by a predetermined amount of angle rotation immediately after the change in the direction of rotation of said motor.

37. An apparatus according to claim 35, wherein said motor is a stepping motor.

38. An apparatus according to claim 24, further comprising key means for inputting data and control means for controlling said apparatus in accordance with the data input by said key means.

39. An apparatus according to claim 38, wherein said motor is a stepping motor.

40. An apparatus according to claim 38, wherein said control means controls said second feed mechanism to selectively feed one of the ink sheet and the ink correction sheet through said first transfer means in response to the direction of rotation of said motor.

41. An apparatus according to claim 40, wherein said motor is a stepping motor.

42. An apparatus according to claim 38, wherein said control means comprises a keyboard controller, an apparatus controller and a print controller.

43. An apparatus according to claim 42, wherein said motor is a stepping motor.

* * * * *

UNITED STATES PATENT AND TRADEMARK OFFICE

CERTIFICATE OF CORRECTION

PATENT NO. : 4,986,677 Page 1 of 5

DATED : January 22, 1991

INVENTOR(S) : Hiroatsu KONDO, et al.

It is certified that error appears in the above-identified patent and that said Letters Patent is hereby corrected as shown below:

In the Drawings:

SHEET 31 OF 48 OF THE DRAWINGS

Fig. 33, "THEM" should read --THAN--.

COLUMN 1

Line 26, "are," should read --are--.

COLUMN 2

Line 12, "movement" should read --rotation--.

COLUMN 4

Line 34, "types" should read --types (not shown)--.

COLUMN 5

Line 57, "rotatably axially" should be deleted.
Line 65, "25and" should read --25a and--.

COLUMN 7

Line 49, "18," should read --18--.
Line 61, "the," should read --the--.

UNITED STATES PATENT AND TRADEMARK OFFICE

CERTIFICATE OF CORRECTION

PATENT NO. : 4,986,677

DATED : January 22, 1991

INVENTOR(S) : Hiroatsu KONDO, et al.

It is certified that error appears in the above-identified patent and that said Letters Patent is hereby corrected as shown below:

COLUMN 8

Line 12, "mechanism" should read --mechanism 11a, 66, 67, and 113-115 shown in Fig. 27--; and "correction ribbon" should read --correction ribbon 11--.
Line 13, "11a, 66, 67 and 113-115 shown in Fig. 27" should be deleted.
Line 23, "and" should read --and 66--.
Line 33, "cassette," should read --cassette--.
Line 47, "entangled" should read --entangling--.

COLUMN 9

Line 33, "clutch," should read --clutch--.

COLUMN 10

Line 18, "on," should read --on--.

COLUMN 11

Line 7, "cam groove 59a" should read --cam groove 59a,--.
Line 8, ", the state" should read --the state--.
Line 28, "surface 100 c" should read --surface 100c--.
Line 62, "then" should be deleted.

UNITED STATES PATENT AND TRADEMARK OFFICE

CERTIFICATE OF CORRECTION

PATENT NO. : 4,986,677

DATED : January 22, 1991

INVENTOR(S) : Hiroatsu KONDO et al.

It is certified that error appears in the above-identified patent and that said Letters Patent is hereby corrected as shown below:

COLUMN 13

Line 12, "allowing," should read --allowing--.
Line 47, "type A109" should read --type 109--.
Line 49, "type A109" should read --type 109--.
Line 52, "type B110" should read --type 110--.

COLUMN 14

Line 66, "as away" should read --as to be away--.
Line 67, "rotary c" should read --rotary cam 59--.

COLUMN 15

Line 2, "synthesized" should read --synthesized motion--.
Line 36, "one" should be deleted.

COLUMN 16

Line 33, "used by rotary" should read --used by the first correction operation. Further, when the rotary--.

COLUMN 17

Line 12, "against" should read --on--.
Line 58, "shaft 126" should read --shaft 126, as--

UNITED STATES PATENT AND TRADEMARK OFFICE

CERTIFICATE OF CORRECTION

PATENT NO. : 4,986,677

DATED : January 22, 1991

INVENTOR(S) : Hiroatsu KONDO et al.

It is certified that error appears in the above-identified patent and that said Letters Patent is hereby corrected as shown below:

COLUMN 18

Line 1, "edge portion 119a" should read --edge portion 619a--.
Line 66, "be" should be deleted.

COLUMN 19

Line 28, "an" should read --a--.
Line 66, "movement," should read --movement--.

COLUMN 20

Line 68, "CMH=1)" should read --CMH=1).--.

COLUMN 21

Line 26, "an" should read --and--.
Line 28, "detector," should read --detector--.
Line 37, "is," should read --is--.

COLUMN 22

Line 38, "In" should read --If--.

COLUMN 29

Line 6, "ha" should read --has--.
Line 64, "the" should read --a--.

UNITED STATES PATENT AND TRADEMARK OFFICE

CERTIFICATE OF CORRECTION

PATENT NO. : 4,986,677 Page 5 of 5

DATED : January 22, 1991

INVENTOR(S) : Hiroatsu KONDO et al.

It is certified that error appears in the above-identified patent and that said Letters Patent is hereby corrected as shown below:

COLUMN 30

Line 32, "ribbon guide" should read --ribbon guides--.
Line 67, "one" should read --one of--.
Line 68, "third feed;" should read --third feed mechanism;--.

COLUMN 31

Line 55, "respond" should read --response--.

Signed and Sealed this

Fourth Day of February, 1997

*Attest:*

Bruce Lehman

BRUCE LEHMAN

*Attesting Officer*

*Commissioner of Patents and Trademarks*